US010280906B2

(12) United States Patent
Fukuda et al.

(10) Patent No.: US 10,280,906 B2
(45) Date of Patent: May 7, 2019

(54) HYDRAULIC SYSTEM FOR WORK MACHINE

(71) Applicant: KUBOTA CORPORATION, Osaka (JP)

(72) Inventors: Yuji Fukuda, Osaka (JP); Kazuyoshi Arii, Osaka (JP); Ryohei Sumiyoshi, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 64 days.

(21) Appl. No.: 15/615,056

(22) Filed: Jun. 6, 2017

(65) Prior Publication Data

US 2017/0350095 A1 Dec. 7, 2017

(30) Foreign Application Priority Data

Jun. 7, 2016 (JP) ..... 2016-113600
Dec. 28, 2016 (JP) ..... 2016-255462
Dec. 28, 2016 (JP) ..... 2016-255463

(51) Int. Cl.
*F15B 21/04* (2006.01)
*F15B 11/00* (2006.01)
(Continued)

(52) U.S. Cl.
CPC ..... *F04B 1/26* (2013.01); *E02F 9/2025* (2013.01); *E02F 9/2285* (2013.01);
(Continued)

(58) Field of Classification Search
CPC ..... B64C 13/40; E02F 3/425; E02F 3/325; E02F 9/226; E02F 9/2235; E02F 9/2285;
(Continued)

(56) References Cited

U.S. PATENT DOCUMENTS 6,964,162 B2 * 11/2005 Takahashi ..... F15B 1/26 137/565.19
8,484,962 B2 * 7/2013 Behr ..... B64C 13/40 244/99.5
(Continued)

FOREIGN PATENT DOCUMENTS

JP 2013-036274 2/2013
JP 2013-117253 6/2013
(Continued)

*Primary Examiner* — Robert E Pezzuto
(74) *Attorney, Agent, or Firm* — Greenblum & Bernstein, P.L.C.

(57) ABSTRACT

A hydraulic system for a work machine includes an operation member, a prime mover, a hydraulic pump driven by the prime mover, the hydraulic pump configured to output an operation fluid, a first temperature sensor to measure a temperature of the operation fluid, a first fluid tube connected to the hydraulic pump, an operation valve connected to the first fluid tube, the operation valve configured to control, in accordance with an operation extent of the operation member, a pressure of the outputted operation fluid, a hydraulic apparatus driven by the operation fluid outputted from the operation valve, a second hydraulic tube connecting the operation valve to the hydraulic apparatus, a discharge fluid tube to discharge the operation fluid included in the second fluid tube; and an actuation valve disposed on the discharge fluid tube, the actuation valve configured to control an aperture of the actuation valve based on the temperature.

4 Claims, 23 Drawing Sheets

(51) Int. Cl.

| | |
|---|---|
| ***E02F 9/22*** | (2006.01) |
| ***F04B 1/26*** | (2006.01) |
| ***E02F 9/20*** | (2006.01) |
| *E02F 3/34* | (2006.01) |
| *E02F 9/16* | (2006.01) |

(52) U.S. Cl.
CPC ..... *E02F 9/2292* (2013.01); *E02F 3/3414* (2013.01); *E02F 9/166* (2013.01)

(58) Field of Classification Search
CPC ..... E02F 9/2292; E02F 9/2296; E02F 9/2025; E02F 9/2278; E02F 9/2095; F04B 1/26; F15B 11/028; F15B 21/042; F15B 21/046; F15B 21/06; F15B 1/26; F16H 61/4052
USPC ..... 37/309, 347, 348; 60/453, 456, 468; 137/565.19, 565.33; 172/2–11
See application file for complete search history.

(56) References Cited

U.S. PATENT DOCUMENTS

| | | | | |
|---|---|---|---|---|
| 8,523,139 | B2 * | 9/2013 | Sakamoto | E02F 3/964 251/30.01 |
| 9,080,311 | B2 * | 7/2015 | Yoshida | F02D 41/029 |
| 9,618,015 | B2 * | 4/2017 | Morselli | F15B 1/26 |

FOREIGN PATENT DOCUMENTS

| | | |
|---|---|---|
| JP | 5687970 | 3/2015 |
| JP | 2016-148446 | 8/2016 |

* cited by examiner

HYDRAULIC SYSTEM FOR WORK MACHINE

CROSS-REFERENCE TO RELATED APPLICATIONS

The present application claims priority under 35 U.S.C. § 119 to Japanese Patent Application No. 2016-113600, filed Jun. 7, 2016, to Japanese Patent Application No. 2016-255462, filed Dec. 28, 2016, to Japanese Patent Application No. 2016-255463, filed Dec. 28, 2016. The contents of these applications are incorporated herein by reference in their entirety.

BACKGROUND OF THE INVENTION

Field of the Invention

The present invention relates to a hydraulic system for a work machine.

Discussion of the Background

Japanese patent application publication No. 2013-117253 disclosed a conventional technique for warming up a work machine.

The work machine disclosed in Japanese patent application publication No. 2013-117253 includes a pilot pressure control valve configured to control a pressure of a pilot fluid that is outputted from a pump to be supplied to a target device and includes a valve body incorporating the pilot pressure control valve. The technique disclosed in Japanese patent application publication No. 2013-117253 disposes a heat-up fluid tube on the valve body, the heat-up fluid tube being configured to supply the pilot fluid outputted from the pump. In this manner, the technique supplies the pilot fluid passing through the heat-up fluid tube to an operation fluid tank through a relief valve or a throttle, and thereby heating up the valve body.

In addition, a work machine disclosed in Japanese patent application publication No. 2013-36274 includes an engine, an HST pump configured to be driven by a motive power of the engine, a travel operation device configured to operate the HST pump, a pressure control valve configured to control a travel primary pressure that is a pressure on a primary side of the travel operation device, and a control device to control the pressure control valve.

The control device controls the pressure control valve on the basis of a no-load characteristic line employed when a load is free and a drop characteristic line employed when a predetermined load or more is applied to the engine, thereby preventing the engine stall.

Japanese patent publication No. 5687970 reduces an output power of a travel pump when a predetermined load or more is applied to the engine, the travel pump being one of hydraulic devices. In particular, a work machine disclosed in Japanese patent publication No. 5687970 includes an engine, a travel pump configured to be driven by the engine, a travel operation lever, an operation valve configured to change a pressure of a pilot fluid (a pilot pressure) in accordance with operation of the travel operation lever, and a pressure control valve disposed on an upper stream side of the operation valve.

A work machine disclosed in Japanese patent application publication No. 2016-148446 includes an operation valve configured to change a pressure of an operation fluid in accordance with an operation amount of an operation lever, a travel pump configured to change an output power on the basis of the pressure of the operation fluid changed by the operation valve, and travel motor configured to be driven by the operation fluid outputted from the travel pump.

SUMMARY OF THE INVENTION

Problems to be Solved by the Invention

A hydraulic system for a work machine includes an operation member, a prime mover, a hydraulic pump to be driven by the prime mover, the hydraulic pump being configured to output an operation fluid, a first temperature sensor to measure a temperature of the operation fluid, a first fluid tube connected to the hydraulic pump, an operation valve connected to the first fluid tube, the operation valve being configured to control, in accordance with an operation extent of the operation member, a pressure of the operation fluid to be outputted, a hydraulic apparatus to be driven by the operation fluid outputted from the operation valve, a second hydraulic tube connecting the operation valve to the hydraulic apparatus, a discharge fluid tube to discharge the operation fluid included in the second fluid tube; and an actuation valve disposed on the discharge fluid tube, the actuation valve being configured to control an aperture of the actuation valve based on the temperature.

A hydraulic system for a work machine includes an operation member, a hydraulic pump to output an operation fluid, a first fluid tube connected to the hydraulic pump, an operation valve disposed on the first fluid tube, the operation valve being configured to control, in accordance with an operation extent of the operation member, a pressure of the operation fluid to be outputted, a hydraulic apparatus to be driven by the operation fluid outputted from the operation valve, a second hydraulic tube connecting the operation valve to the hydraulic apparatus, an actuation valve disposed on the first fluid tube between the operation valve and the hydraulic pump, a third fluid tube connecting the second fluid tube to an intermediate section of the first fluid tube between the operation valve and the actuation valve, and a check valve disposed on the third fluid tube, the check valve being configured to supply the operation fluid from the second fluid tube to the first fluid tube and block the operation fluid flowing from the first fluid tube to the second fluid tube.

A hydraulic system for a work machine includes an operation member to be moved to one direction and to the other direction, a hydraulic pump to output an operation fluid;

a first fluid tube connected to the hydraulic pump, a first operation valve connected to the first fluid tube, the first operation valve being configured to control, in accordance with the movement to the one direction of the operation member, a pressure of the operation fluid to be outputted, a second operation valve connected to the first fluid tube, the first operation valve being configured to control, in accordance with the movement to the other direction of the operation member, a pressure of the operation fluid to be outputted, a hydraulic apparatus to be driven by the operation fluid outputted from the first operation valve or from the second operation valve, and a pressure changer to differentiate a pressure of the operation fluid that is supplied from the first operation valve to the hydraulic apparatus when the operation member is moved to the one direction from a pressure of the operation fluid that is supplied from the second operation valve to the hydraulic apparatus when the operation member is moved to the other direction.

A hydraulic system for a work machine includes an operation member to be moved to a first direction and to a second direction perpendicular to the first direction, a hydraulic pump to output an operation fluid, a first fluid tube connected to the hydraulic pump, a first operation valve connected to the first fluid tube, the first operation valve being configured to control, in accordance with the movement to one direction in the first direction of the operation member, a pressure of the operation fluid to be outputted, a second operation valve connected to the first fluid tube, the first operation valve being configured to control, in accordance with the movement to the other direction in the first direction of the operation member, a pressure of the operation fluid to be outputted, a third operation valve connected to the first fluid tube, the first operation valve being configured to control, in accordance with the movement to one direction in the second direction of the operation member, a pressure of the operation fluid to be outputted, a fourth operation valve connected to the first fluid tube, the first operation valve being configured to control, in accordance with the movement to the other direction in the second direction of the operation member, a pressure of the operation fluid to be outputted, a hydraulic apparatus to be driven by the operation fluid outputted from at least one of the first operation valve, the second operation valve, the third operation valve, and the fourth operation valve, and a pressure changer to differentiate a pressure of the operation fluid that is supplied from the first operation valve or the second operation valve to the hydraulic apparatus when the operation member is moved to the first direction from a pressure of the operation fluid that is supplied from the third operation valve or the fourth operation valve to the hydraulic apparatus when the operation member is moved to the second direction.

A hydraulic system for a work machine includes a hydraulic pump to output an operation fluid, a first hydraulic fluid connected to the hydraulic pump, a travel device to be activated by the operation fluid, a first operation device connected to the travel device, including a first operation member to be moved to one direction and to the other direction, a first operation valve connected to the first fluid tube, the first operation valve being configured to control, in accordance with the movement to the one direction of the first operation member, a pressure of the operation fluid, and a second operation valve connected to the first fluid tube, the first operation valve being configured to control, in accordance with the movement to the other direction of the first operation member, the pressure of the operation fluid, a second operation device connected to the travel device, the second operation device being other than the first operation device, including a second operation member to be moved to one direction and to the other direction, a third operation valve connected to the first fluid tube, the third operation valve being configured to control, in accordance with the movement to the one direction of the second operation member, the pressure of the operation fluid, and a fourth operation valve connected to the first fluid tube, the fourth operation valve being configured to control, in accordance with the movement to the other direction of the second operation member, the pressure of the operation fluid, a first select valve including an output port to output higher any one of the pressure of the operation fluid outputted from the first operation valve and the pressure of the operation fluid outputted from the third operation valve, a second select valve including an output port to output higher any one of the pressure of the operation fluid outputted from the second operation valve and the pressure of the operation fluid outputted from the fourth operation valve, a third select valve including an output port to output higher any one of the pressure of the operation fluid outputted from the output port of the first operation valve and the pressure of the operation fluid outputted from the output port of the second operation valve, a fourth fluid tube connected to the output port of the third select valve, and a brake device connected to the fourth fluid tube, the brake device to release a braking state of the travel device when the pressure of the operation fluid is applied to the brake device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
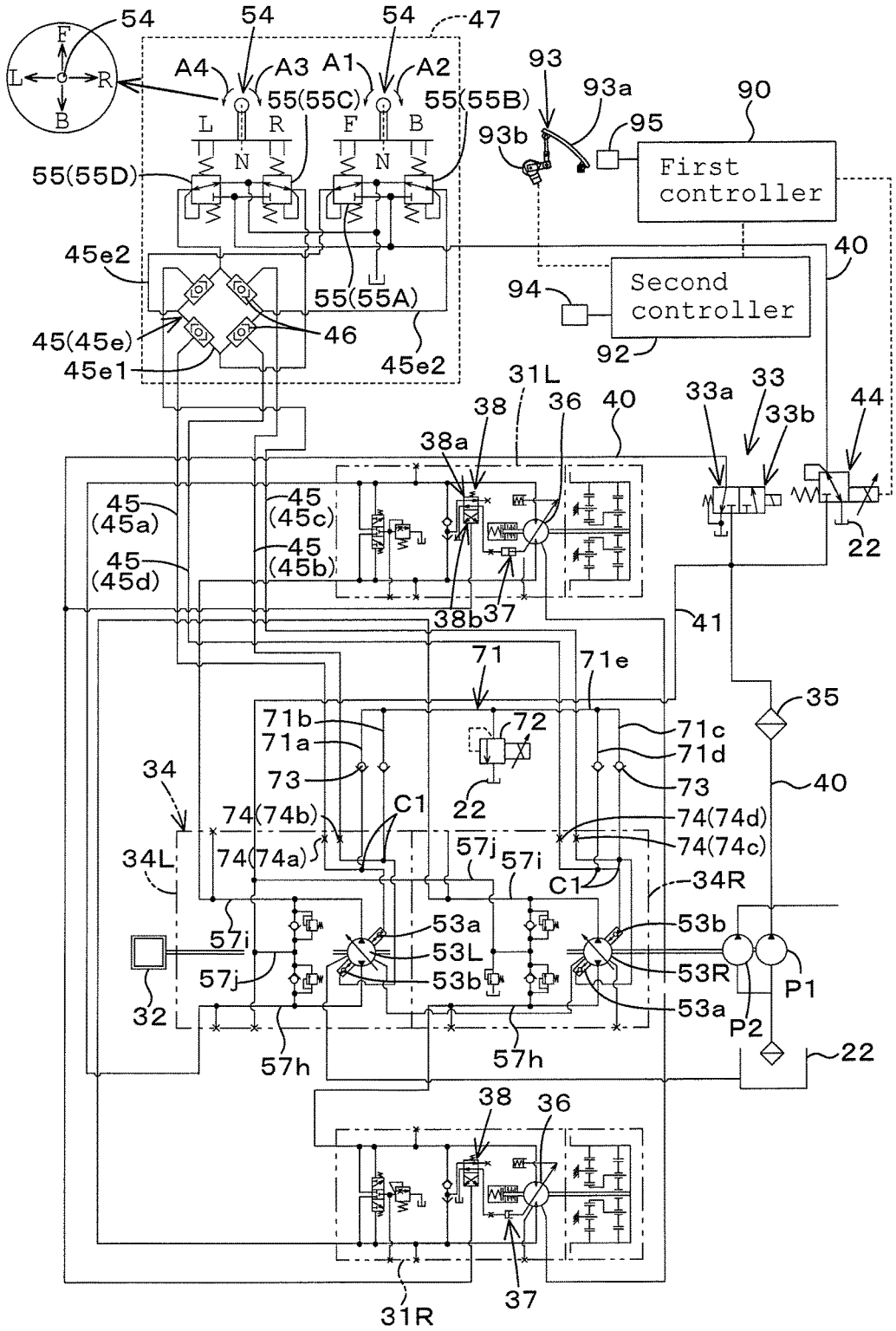
FIG. 1 is a view illustrating a hydraulic system for travel (a hydraulic circuit) for a work machine according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Referring to drawings, a hydraulic system and a work machine having the hydraulic system according to embodiments of the present invention will be described below.

First Embodiment

Figure 21:
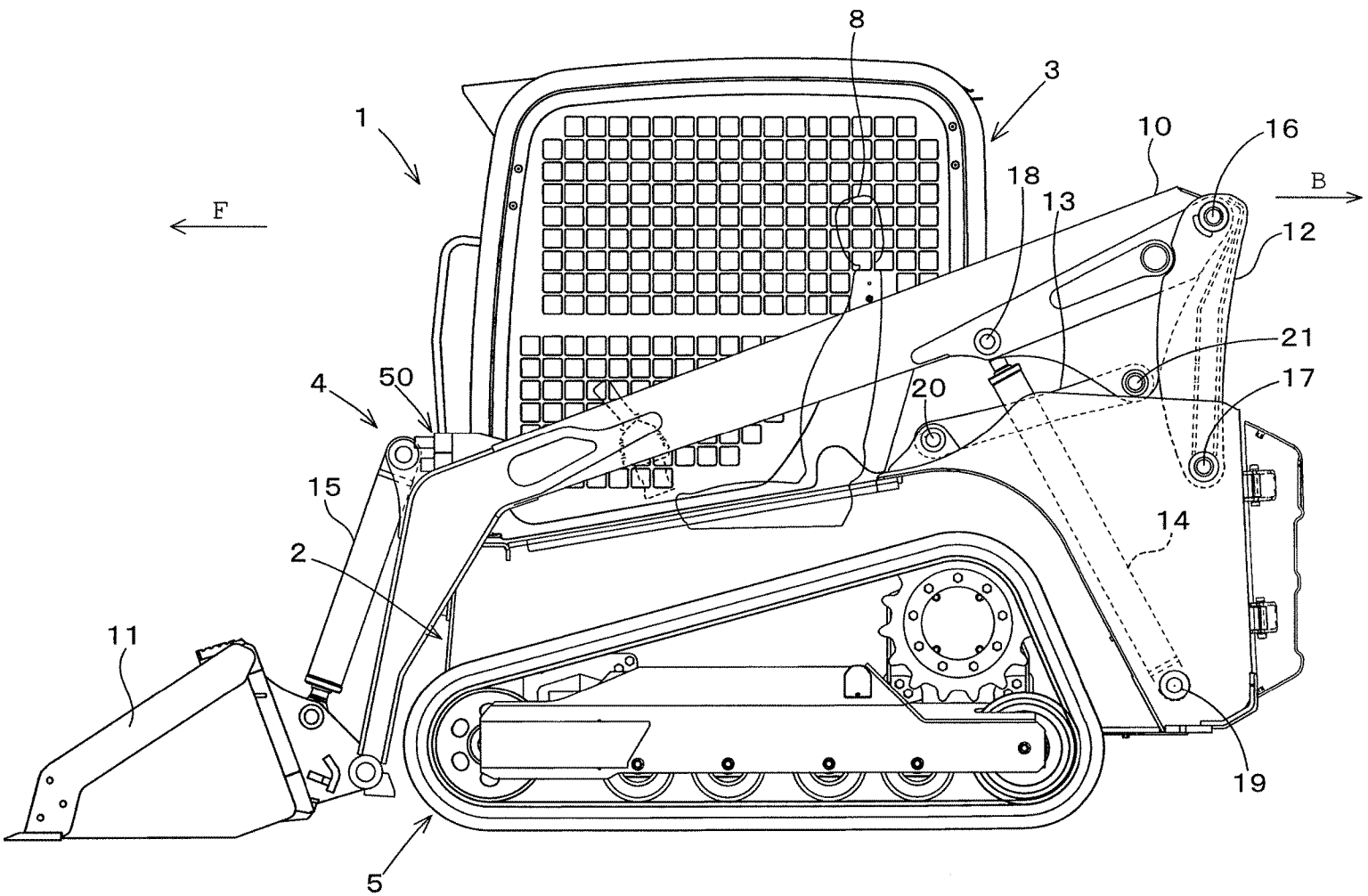
FIG. 21 is a side view illustrating a track loader exemplified as a work machine according to the embodiments of the present invention.

FIG. 21 illustrates a side view of a work machine according to a first embodiment of the present invention. FIG. 21 illustrates a compact track loader exemplified as the work machine. However, the work machine according to the embodiment is not limited to the compact track loader, and may be another type of a loader work machine such as a skid steer loader for example. In addition, the work machine may be other than the loader work machine.

Figure 22:
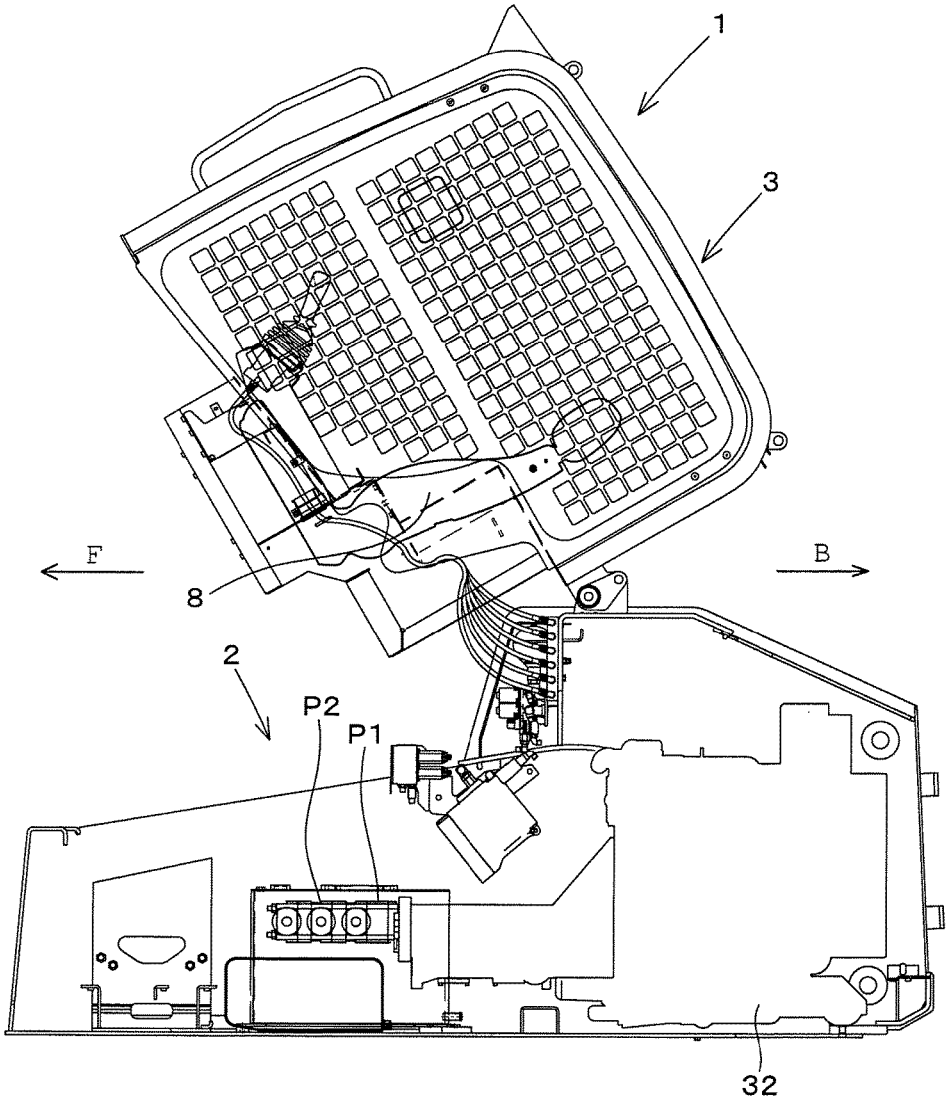
FIG. 22 is a side view illustrating a part of the track loader lifting up a cabin according to the embodiments.

As shown in FIG. 21 and FIG. 22, the work machine 1 includes a machine body 2, a cabin 3, an work device 4, and a travel device 5.

Hereinafter, in explanations of all the embodiments of the present invention, a forward direction (a direction toward a left side in FIG. 21) corresponds to a front side of an operator seating on an operator seat 8 of the work machine 1, a backward direction (a direction toward a right side in FIG. 21) corresponds to a back side of the operator, a leftward direction (a direction toward a front side from the back of FIG. 21) corresponds to a left side of the operator, and a rightward direction (a direction toward a back side from the front of FIG. 21) corresponds to a right side of the operator. In the explanations, a machine width direction corresponds to a horizontal direction perpendicular to the forward direction and the backward direction. A machine outward direction corresponds to a direction from a center portion of the machine body 2 toward the right and corresponds to a direction from the center portion of the machine body 2 toward the left.

In other words, the machine outward direction is equivalent to the machine width direction and is a direction stepping away from (separating from) a center of the machine width direction. A direction opposite to the machine outward direction is referred to as a machine inward direction. In other words, the machine inward direction is equivalent to the machine width direction and is a direction stepping up to (being closed to) the center of the machine width direction.

The cabin 3 is mounted on the machine body 2. The cabin 3 is provided with the operator seta 8. The work device 4 is attached to the machine body 2. The travel device 5 is disposed on an outer side of the machine body 2. An prime mover is mounted internally on a rear portion of the machine body 2.

The work machine 4 includes a boom 10, a work tool 11, a lift link 12, a control link 13, a boom cylinder 14, and a bucket cylinder 15.

The booms 10 are arranged to the right of the cabin 3 and to the left of the cabin 3, and are capable of swinging upward and downward. The work tool 11 is a bucket, for example. The bucket 11 is disposed on the tip end portions (the front end portions) of the booms 10, and is capable of swinging upward and downward.

The lift link 12 and the control link 13 supports the base portions (the rear portions) of the booms 10, and thus the booms 10 are capable of swinging upward and downward.

The boom cylinder 14 is stretched and shortened to move the booms 10 upward and downward. The bucket cylinder 15 is stretched and shortened to swing the bucket 11.

A front portion of the boom 10 arranged to the left is connected by a deformed connection pipe to a front portion of the boom 10 arranged to the right. A base portion (a rear portion) of the boom 10 arranged to the left is connected by a cylindrical connection pipe to a base portion (a rear portion) of the boom 10 arranged to the right.

The lift links 12, the control links 13, and the boom cylinders 14 are arranged to the left of the machine body 2 and to the right of the machine body 2, corresponding to the boom 10 disposed on the left and the boom 10 disposed on the right.

The lift links 12 are disposed on the rear portions of the base portions of the booms 10, and extend in a vertical direction. The upper portions (one end sides) of the lift links 12 are pivotally supported by pivotal supports shafts 16 (first pivotal support shafts), being closer to the rear portions of the base portions of the booms 10, and are capable of turning about the lateral axis.

In addition, the lower portions (the other end sides) of the lift links 12 are pivotally supported by pivotal supports shafts 17 (second pivotal support shafts), being closer to the rear portions of the base portions of the booms 10, and are capable of turning about the lateral axis. The second pivotal support shafts 17 are arranged below the first pivotal support shafts 16.

The upper portions of the boom cylinders 14 are pivotally supported by pivotal support shafts 18 (third pivotal support shafts), and are capable of turning about the lateral axis. The third pivotal support shafts 18 are disposed on the base portions of the booms 10 and specifically on the front portions of the base portions.

The lower portions of the boom cylinder 14 are pivotally supported by pivotal support shafts 19 (fourth pivotal support shafts), and are capable of turning about the lateral axis. The fourth pivotal support shafts 19 are disposed below the third pivotal support shafts 18, being closer to the lower portion of the rear portion of the machine body 2.

The control links 13 are arranged in front of the lift links 12. One ends of the control links 13 are pivotally supported by pivotal supports shafts 20 (fifth pivotal supports shafts), and are capable of turning about the lateral axis. The fifth pivotal support shafts 20 are disposed on the machine body 2 and specifically on corresponding positions in front of the lift links 12.

The other ends of the control links 13 are pivotally supported by pivotal supports shafts 21 (sixth pivotal supports shafts), and are capable of turning about the lateral axis. The sixth pivotal support shafts 21 are disposed on the booms 10 in front of the second pivotal support shafts 17 and above the second pivotal support shafts 17.

When the boom cylinder 14 is stretched and shortened, the booms 10 swing upward and downward about the first pivotal support shafts 16 with the base portions of the booms 10 supported by the lift links 12 and the control links 13, and thus the tip end portions of the booms 10 move upward and downward.

The control links 13 swing upward and downward about the fifth pivotal support shafts 20 in accordance with the upward swinging and the downward swinging of the booms 10. The lift links 12 swing forward and backward about the second pivotal support shafts 17 in accordance with the upward swinging and the downward swinging of the control links 13.

The front portions of the booms 10 are capable of attaching other work tools instead of the bucket 11. The following attachments (auxiliary attachments) are exemplified as the other work tools; for example, a hydraulic crusher, a hydraulic breaker, an angle broom, an earth auger, a pallet fork, a sweeper, a mower, a snow blower, and the like.

A connection member 50 is disposed on the front portion of the boom 10 disposed on the left. The connection member 50 is a device for connecting a hydraulic device of an auxiliary attachment to a first tube member pipe such as a pipe disposed on the boom 10.

Specifically, the first tube member is capable of being connected to one end of the connection member 50, and a second tube member is capable of being connected to the other end of the connection member 50, the second tube member being connected to the hydraulic device of the auxiliary attachment. In this manner, an operation fluid flowing in the first tube member is supplied to the hydraulic device through the second tube member.

The bucket cylinders 15 are arranged on portions close to the front portions of the booms 10. The bucket cylinders 15 are stretched and shortened to swing the bucket 11.

Each of the travel device 5 disposed on the left and the travel device 5 disposed on the right employs a travel device of a crawler type (including a semi-crawler type) in the embodiment. Each of the travel devices 5 may employ a travel device of a wheel type having the front wheels and the rear wheels.

The hydraulic system for the work machine according to the embodiment will be explained below.

As shown in FIG. 1, a hydraulic system for travel is a system for driving the travel device 5. The travel device 5 includes a left travel motor device 31L (a first travel motor device), a right travel motor device 31R (a second travel motor device), and a hydraulic device 34. The hydraulic system for travel includes a prime mover 32, a direction switch valve 33, and a first hydraulic pump P1.

The prime mover 32 is constituted of an electric motor, an engine, or the like. In the embodiment, the prime mover 32 is the engine. The first hydraulic pump P1 is a pump configured to be driven by a driving force of the prime mover 32. The first hydraulic pump P1 is constituted of a constant displacement gear pump.

The first hydraulic pump P1 is configured to output the operation fluid stored in the tank 22. In particular, the first hydraulic pump P1 outputs the operation fluid mainly used for the control.

For convenience of the explanation, the tank 22 for storing the operation fluid may be referred to as an operation fluid tank. In addition, of the operation fluid outputted from the first hydraulic pump P1, the operation fluid used for the control is referred to as a pilot fluid, and a pressure of the pilot fluid is referred to as a pilot pressure.

An output fluid tube (an output fluid path) 40 is disposed on an output side of the first hydraulic pump P1, the output fluid tube 40 being configured to supply the operation fluid (the pilot fluid). The output fluid tube (a first fluid tube) 40 is provided with a filter 35, the direction switch valve 33, the first travel motor device 31L, and the second travel motor device 31R.

A charge fluid tube 41 is arranged between the filter 35 and the direction switch valve 33, the charge fluid tube 41 being branched from the output fluid tube 40. The charge fluid tube 41 reaches the hydraulic device 34.

The direction switch valve 33 is an electromagnetic valve configured to change revolutions of the first travel motor device 31L and the second travel motor device 31R. The direction switch valve 33 is constituted of a two-position switch valve being switched to a first position 33*a* and to a second position 33*b* by magnetization. The direction switch valve 33 is switched by an operation member and the like not shown in the drawings.

The first travel motor device 31L is a motor configured to transmit a motive power to a drive shaft of the travel device 5, the travel device 5 being arranged to the left of the machine body 2. The second travel motor device 31R is a motor configured to transmit a motive power to a drive shaft of the travel device 5, the travel device 5 being arranged to the right of the machine body 2.

The first travel motor device 31L includes an HST motor (a travel motor) 36, a swash-plate switch cylinder 37, and a travel control valve (a hydraulic switch valve) 38. The HST motor 36 is a variable displacement axial motor having a swash plate, and is a motor capable of changing a vehicle speed (revolution) to a first speed and to a second speed. In other words, the HST motor 36 is a motor capable of changing a thrust power of the work machine 1.

The swash-plate switch cylinder 37 is a cylinder configured to be stretched and shortened to change an angle of the swash plate of the HST motor 36. The travel control valve 38 is a valve for stretching and shortening the swash-plate switch cylinder 37 to one side and to the other side, that is, the travel control valve 38 is constituted of a two-position switch valve configured to be switched to a first position 38*a* and to a second position 38*b*.

The travel control valve 38 is switched by the direction switch valve 33 that is connected to the travel control valve 38 and arranged on an upper stream of the travel control valve 38.

As described above, when the operation member is operated to switch the direction switch valve 33 to the first position 33*a*, the first travel motor 31L releases the pilot fluid in a section between the direction switch valve 33 and the travel control valve 38, and thus the travel control valve 38 is switched to the first position 38*a*. As the result, the swash-plate switch cylinder 37 is shortened, and thus the HST motor 36 is set to the first speed.

In addition, when the operation member is operated to switch the direction switch valve 33 to the second position 33*b*, the pilot fluid is supplied to the travel control valve 38 through the direction switch valve 33, and thus the travel control valve 38 is switched to the second position 38*b*. As the result, the swash-plate switch cylinder 37 is stretched, and thus the HST motor 36 is set to the second speed.

Meanwhile, the second travel motor device 31R is operated in the manner similar to the manner of the first travel motor device 31L. The configurations and movements of the second travel motor device 31R is similar to the configurations and movements of the first travel motor device 31L. Thus, the explanation of the second travel motor device 31R will be omitted.

The hydraulic device 34 is a device configured to drive the first travel motor device 31L and the second travel motor device 31R. The hydraulic device 34 includes a drive circuit (a left drive circuit) 34L and a drive circuit (a right drive circuit) 34R. The drive circuit 34L is configured to drive the first travel motor device 31L. The drive circuit 34R is configured to drive the second travel motor device 31R.

The drive circuit 34L includes an HST pump (a travel pump) 53L, a speed-changing fluid tube (a speed-changing fluid path) 57*h*, a speed-changing fluid tube (a speed-changing fluid path) 57*i*, and a second charging fluid tube (a second charging fluid path) 57*j*. The drive circuit 34R includes an HST pump (a travel pump) 53R, the speed-changing fluid tube 57*h*, the speed-changing fluid tube 57*i*, and the second charging fluid tube 57*j*.

The speed-changing fluid tubes 57*h* and 57*i* are fluid tubes (fluid paths) connecting the HST pumps 53L and 53R to the HST motor 36.

The second charging fluid tube 57*j* is a fluid tube (a fluid path) connected to the speed-changing fluid tubes 57*h* and 57*i*, and is configured to charge the operation fluid from the first hydraulic pump P1 to the speed-changing fluid tubes 57*h* and 57*i*.

Each of the HST pumps 53L and 53R is the variable displacement axial pump having a swash plate. The variable displacement axial pump is configured to be driven by a motive power of the prime mover 32. Each of the HST pumps 53L and 53R includes a forward-movement pressure-receiving portion 53*a* (a pressure-receiving portion 53*a* ) and a backward-movement pressure-receiving portion 53*b* (a pressure-receiving portion 53*b*). The pilot pressure is applied to the forward-movement pressure-receiving portion 53*a* and the backward-movement pressure-receiving portion 53*b*. An angle of the swash plate is changed by the pilot pressure applied to the pressure-receiving portion 53*a* and the pressure-receiving portion 53*b*.

When the angle of the swash plate is changed, the changing changes the outputs (output amounts of the operation fluid) of the HST pumps 53L and 53R and changes the directions of the outputs of the operation fluid.

An operation device 47 changes the outputs of the HST pumps 53L and 53R and the directions of the outputs of the operation fluid. The operation device 47 is arranged around the operator seat 8. The operation device 47 includes an operation member 54 swingably supported and a plurality of pilot valves (operation valves) 55.

As shown in FIG. 1, the operation member 54 is an operation lever supported by the operation valve 55 and configured to be swung in the rightward and leftward directions (the machine width direction) or in the forward and backward directions. That is, the operation member 54 is configured to be moved rightward and leftward from a neutral position N that is a home position, and is configured to be moved forward and backward from the neutral position N.

In other words, the operation member 54 is configured to move at least in four directions from the home position, the neutral position N. For convenience of the explanation, the bi-direction extending forward and backward, that is, corresponding to the forward direction and the backward direction is referred to as a first direction. In addition, the bi-direction extending rightward and leftward, that is, corresponding to the lateral direction (the machine width direction) is referred to as a second direction.

In addition, the plurality of operation valves 55 are commonly operated by the operation member 54 solely. The plurality of operation valves 55 are activated in accordance with the swinging of the operation member 54. The output fluid tube 40 is connected to the plurality of operation valves 55, and thereby the operation fluid (the pilot fluid) is supplied from the first hydraulic pump P1 through the output fluid tube 40. The plurality of operation valves 55 include an operation valve 55A, an operation valve 55B, an operation valve 55C, and an operation valve 55D.

When the operation lever 54 is swung forward (in one direction) in the forward and backward directions (the first direction), that is, the operation lever 54 is operated in a forward operation, the operation valve 55A changes a pressure of the operation fluid in accordance with an operation amount (the operation) of the forward operation, the operation fluid being outputted from the operation valve 55A.

When the operation lever 54 is swung backward (in the other direction) in the forward and backward directions (the first direction), that is, the operation lever 54 is operated in a backward operation, the operation valve 55B changes the pressure of the operation fluid in accordance with an operation amount (the operation) of the forward operation, the operation fluid being outputted from the operation valve 55B.

When the operation lever 54 is swung rightward (in one direction) in the lateral direction (the second direction), that is, the operation lever 54 is operated in a rightward operation, the operation valve 55C changes the pressure of the operation fluid in accordance with an operation amount (the operation) of the rightward operation, the operation fluid being outputted from the operation valve 55C.

When the operation lever 54 is swung leftward (in the other direction) in the lateral direction (the second direction), that is, the operation lever 54 is operated in a leftward operation, the operation valve 55D changes the pressure of the operation fluid in accordance with an operation amount (the operation) of the leftward operation, the operation fluid being outputted from the operation valve 55D.

The plurality of operation valves 55 are connected to the hydraulic device 34 for travel (the travel pump 53L and the travel pump 53R) by a travel fluid tube (a second fluid tube) 45. In other words, the travel pumps 53L and 53R are hydraulic devices configured to be activated by the operation fluid outputted from the operation valves 55 (the operation valve 55A, the operation valve 55B, the operation valve 55C, and the operation valve 55D).

The travel fluid tube 45 includes a first travel fluid tube 45*a*, a second travel fluid tube 45*b*, a third travel fluid tube 45*c*, a fourth travel fluid tube 45*d*, and a fifth travel fluid tube 45*e*.

The first travel fluid tube 45*a* is a fluid tube (a fluid path) connected to the forward-movement pressure-receiving portion 53*a* of the travel pump 53L.

The second travel fluid tube 45*b* is a fluid tube (a fluid path) connected to the backward-movement pressure-receiving portion 53*b* of the travel pump 53L.

The third travel fluid tube 45*c* is a fluid tube (a fluid path) connected to the forward-movement pressure-receiving portion 53*a* of the travel pump 53R.

The fourth travel fluid tube 45*d* is a fluid tube (a fluid path) connected to the backward-movement pressure-receiving portion 53*b* of the travel pump 53R.

The fifth travel fluid tube 45*e* is a fluid tube (a fluid path) connecting the operation valves 55, the first travel fluid tube 45*a*, the second travel fluid tube 45*b*, the third travel fluid tube 45*c*, and the fourth travel fluid tube 45*d* to each other.

The fifth travel fluid tube 45*e* includes a bridge portion 45*e*1 and a connection tube (a connection path) 45*e*2. The bridge portion 45*e*1 has a plurality of shuttle valves 46. The connection tube 45*e*2 connects the operation valves 55 to a confluence portion of the bridge portion 45*e*1.

When the operation lever 54 is swung forward (in a direction represented by an arrowed line A1 in FIG. 1), the operation valve 55A is operated to output the pilot pressure from the operation valve 55A. The pilot pressure is applied to the pressure-receiving portion 53*a* of the travel pump 53L through the first travel fluid tube 45*a* and to the pressure-receiving portion 53*a* of the travel pump 53R through the third travel fluid tube 45*c*.

In this manner, output shafts of the travel motors 36 normally turn (turn forward) at a speed proportional to a swinging amount (a swinging extent) of the operation lever 54, and thus the work machine 1 travels straight forward.

In addition, when the operation lever 54 is swung backward (in a direction represented by an arrowed line A2 in FIG. 1), the operation valve 55B is operated to output the pilot pressure from the operation valve 55B. The pilot pressure is applied to the pressure-receiving portion 53*b* of the travel pump 53L through the second travel fluid tube 45*b* and to the pressure-receiving portion 53*b* of the travel pump 53R through the fourth travel fluid tube 45*d*.

In this manner, the output shafts of the travel motors 36 reversely turn (turn backward) at a speed proportional to the swinging amount (the swinging extent) of the operation lever 54, and thus the work machine 1 travels straight backward.

In addition, when the operation lever 54 is swung rightward (in a direction represented by an arrowed line A3 in FIG. 1), the operation valve 55C is operated to output the pilot pressure from the operation valve 55C. The pilot pressure is applied to the pressure-receiving portion 53*a* of the travel pump 53L through the first travel fluid tube 45*a* and to the pressure-receiving portion 53*b* of the travel pump 53R through the fourth travel fluid tube 45*d*.

In this manner, the output shaft of the travel motor 36 arranged to the left normally turns, the output shaft of the travel motor 36 arranged to the right reversely turns, and thus the work machine 1 turns rightward.

In addition, when the operation lever 54 is swung leftward (in a direction represented by an arrowed line A4 in FIG. 1), the operation valve 55D is operated to output the pilot pressure from the operation valve 55C. The pilot pressure is applied to the pressure-receiving portion 53*a* of the travel pump 53R through the third travel fluid tube 45*c* and to the pressure-receiving portion 53*b* of the travel pump 53L through the second travel fluid tube 45*b*.

In this manner, the output shaft of the travel motor 36 arranged to the left reversely turns, the output shaft of the travel motor 36 arranged to the right normally turns, and thus the work machine 1 turns leftward.

In addition, when the operation lever 54 is swung in a diagonal direction, turning directions and turning speeds of the output shafts of the travel motor 36 arranged to the left side and the travel motor 36 arranged to the right side are determined by a differential pressure between the pilot pressure applied to the pressure-receiving portion 53*a* and the pilot pressure applied to the pressure-receiving portion 53*b*, and thus the work machine 1 turns rightward or leftward traveling forward or backward.

That is, when the operation lever 54 is swung (operated) forward and diagonally-leftward, the work machine 1 turns leftward traveling forward at a speed corresponding to a swinging angle of the operation lever 54. When the operation lever 54 is swung (operated) forward and diagonally-rightward, the work machine 1 turns rightward traveling forward at a speed corresponding to a swinging angle of the operation lever 54. When the operation lever 54 is swung (operated) backward and diagonally-leftward, the work machine 1 turns leftward traveling backward at a speed corresponding to a swinging angle of the operation lever 54. When the operation lever 54 is swung (operated) backward and diagonally-rightward, the work machine 1 turns rightward traveling backward at a speed corresponding to a swinging angle of the operation lever 54.

Figure 2:
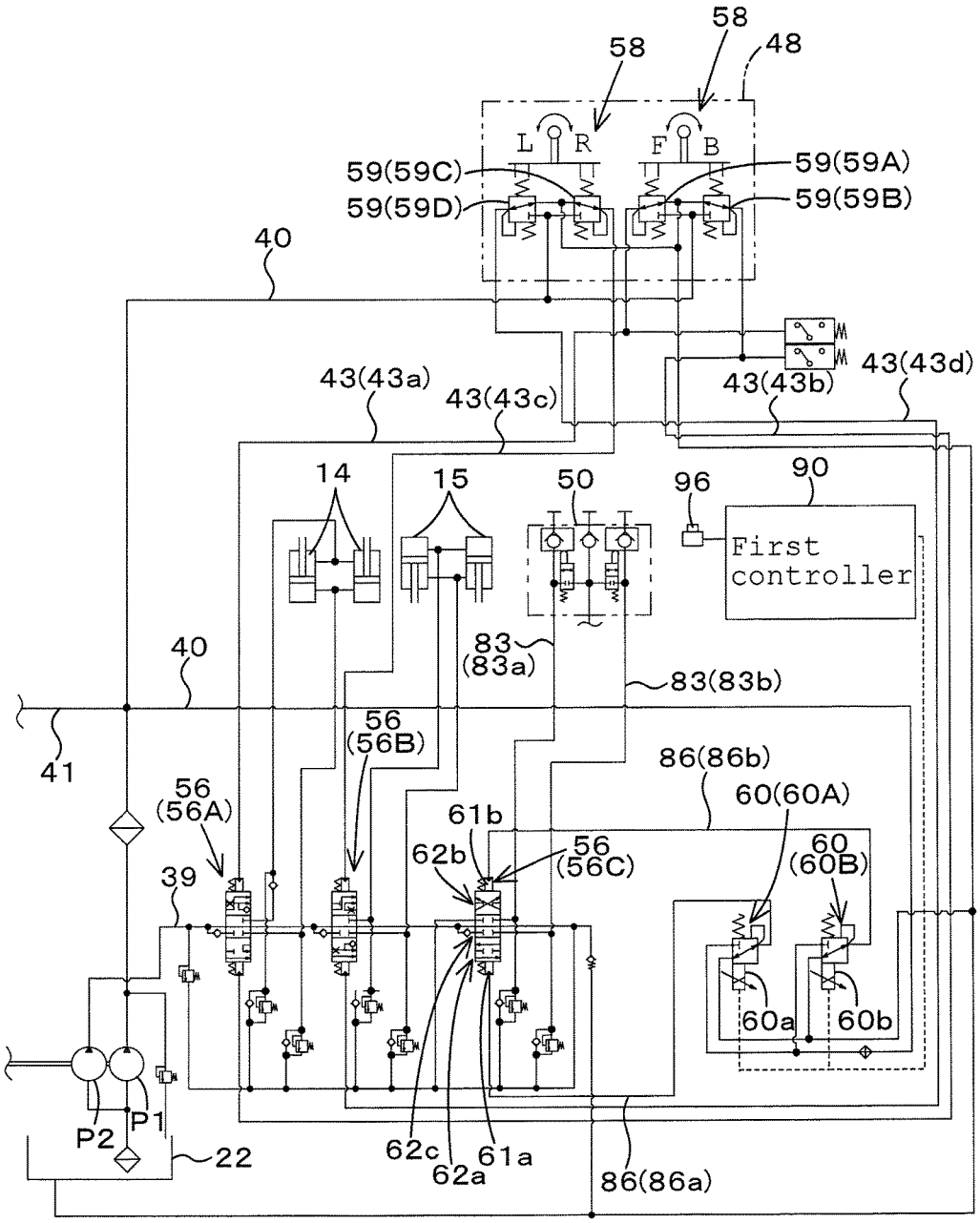
FIG. 2 is a view illustrating a hydraulic system for work (a hydraulic circuit) for the work machine according to the first embodiment.

As shown in FIG. 2, the hydraulic system for work is a system configured to operate the booms 10. the bucket 11, an auxiliary attachment, and the like. The hydraulic system for work includes a plurality of control valves 56 and an operation hydraulic pump 8*a* second hydraulic pump) P2.

The second hydraulic pump P2 is a pump arranged on a position different from the position of the first hydraulic pump P1, and is constituted of a constant displacement gear pump. The second hydraulic pump P2 is configured to output the operation fluid stored in the operation fluid tank 22. In particular, the second hydraulic pump P2 outputs the operation fluid mainly used for operating the hydraulic actuators.

A main fluid tube (a fluid path) 39 is disposed on an output side of the second hydraulic pump P2. The plurality of control valves 56 are connected to the main fluid tube 39. The control valve 56 is a valve configured to be switched by the pilot pressure of the pilot fluid, and thereby the control valve 56 is configured to change a direction of supplying of the operation fluid.

As shown in FIG. 2, the plurality of control valves 56 includes a first control valve 56A, a second control valve 56B, and a third control valve 56C.

The first control valve 56A is a valve configured to control the hydraulic cylinder (the boom cylinder) 14 for controlling the boom.

The second control valve 56B is a valve configured to control the hydraulic cylinder (the bucket cylinder) 15 for controlling the bucket.

The third control valve 56C is a valve configured to control the auxiliary hydraulic actuators attached to the auxiliary attachments such as the hydraulic crusher, the hydraulic breaker, the angle broom, the earth auger, the pallet fork, the sweeper, the mower, the snow blower.

Each of the first control valve 56A and the second control valve 56B is constituted of a three-position switch valve having a direct-acting spool that is configured to be driven by the pilot pressure. Each of the first control valve 56A and the second control valve 56B is switched by the pilot pressure to a neutral position, to a first position different from the neural position, and to a second positon different from the neutral position and the first position.

The boom cylinder 14 is connected to the first control valve 56A by a fluid tube. The bucket cylinder 15 is connected to the second control valve 56B by a fluid tube.

The boom 10 and the bucket 11 are operated by an operation device 48 arranged around the operator seat 8. The operation device 48 includes an operation member 58 and a plurality of pilot valves (operation valves) 59, the operation member 58 being supported swingably.

The operation member 58 is an operation lever supported by the operation valves 59 and configured to be swung in the rightward and leftward directions (the machine width direction) or in the forward and backward directions. In addition, the plurality of operation valves 59 are operated in accordance with the swinging of the operation member (the operation lever) 58.

The output fluid tube 40 is connected to the plurality of operation valves 59, and thus the operation fluid (the pilot fluid) is supplied from the first hydraulic pump P1 to the operation valves 59 through the output fluid tube 40.

The plurality of operation valves 59 include the operation valve 59A, the operation valve 59B, the operation valve 59C, and the operation valve 59D.

When the operation lever 58 is swung forward (a forward operation is performed), the operation valve 59A changes the pressure of the operation fluid in accordance with an operation amount (an operation extent) of the forward operation.

When the operation lever 58 is swung backward (a backward operation is performed), the operation valve 59B changes the pressure of the operation fluid in accordance with an operation amount (an operation extent) of the backward operation.

When the operation lever 58 is swung rightward (a rightward operation is performed), the operation valve 59C changes the pressure of the operation fluid in accordance with an operation amount (an operation extent) of the rightward operation.

When the operation lever 58 is swung leftward (a leftward operation is performed), the operation valve 59D changes the pressure of the operation fluid in accordance with an operation amount (an operation extent) of the leftward operation.

The plurality of operation valves 59 (the operation valve 59A, the operation valve 59B, the operation valve 59C, and the operation valve 59D) are connected to a working fluid tube 43. The working fluid tube 43 includes a first working fluid tube 43*a*, a second working fluid tube 43*b*, a third working fluid tube 43*c*, and a fourth working fluid tube 43*d*.

The first working fluid tube 43*a* is a fluid tube connected to the first control valve 56A and the operation valve 59A.

The second working fluid tube 43*b* is a fluid tube connected to the first control valve 56A and the operation valve 59B.

The third working fluid tube 43*c* is a fluid tube connected to the second control valve 56B and the operation valve 59C.

The fourth working fluid tube 43*d* is a fluid tube connected to the second control valve 56B and the operation valve 59D.

When the operation lever 58 is tilted forward, the pilot valve (operation valve) 59A for downward movement is operated to set the pilot pressure of the pilot fluid that is to be outputted from the downward movement operation valve 59A. The pilot pressure is applied to the pressure-receiving portion of the first control valve 56A, and thereby shortening the boom cylinder 14 to move the boom 10 downward.

When the operation lever 58 is tilted backward, the pilot valve (operation valve) 59B for upward movement is operated to set the pilot pressure of the pilot fluid that is to be outputted from the upward movement operation valve 59B. The pilot pressure is applied to the pressure-receiving portion of the first control valve 56A, and thereby stretching the boom cylinder 14 to move the boom 10 upward.

When the operation lever 58 is tilted rightward, the pilot valve (operation valve) 59C for bucket dumping is operated to set the pilot pressure of the pilot fluid that is to be outputted from the bucket dumping operation valve 59C. The pilot pressure is applied to the pressure-receiving portion of the second control valve 56B, and thereby stretching the bucket cylinder 15 to perform the dumping movement of the bucket 11.

When the operation lever 58 is tilted leftward, the pilot valve (operation valve) 59D for bucket shoveling is operated to set the pilot pressure of the pilot fluid that is to be outputted from the bucket dumping operation valve 59D. The pilot pressure is applied to the pressure-receiving portion of the second control valve 56B, and thereby shortening the bucket cylinder 15 to perform the shoveling movement of the bucket 11.

The third control valve 56C is constituted of a three-position switch valve having a direct-acting spool that is configured to be driven by the pilot pressure. The third control valve 56C is switched by the pilot pressure to a first position 62*a*, to a second position 62*b*, and to a third position (a neutral position) 62*c*.

That is, the third control valve 56C is switched to the first position 62*a*, to the second position 62*b*, and to the third position 62C, and thereby controls a direction, a flow rate, and a pressure of the operation fluid flowing to the auxiliary hydraulic actuator.

A supply-discharge fluid tube (a supply-discharge fluid path) 83 is connected to the third control valve 56C. One end of the supply-discharge (supply-drain) fluid tube 83 is connected to a supply-discharge port of the third control valve 56C. An intermediate portion of the supply-discharge fluid tube 83 is connected to the connection member 50. The other end of the supply-discharge fluid tube 83 is connected to the auxiliary hydraulic actuator. The supply-discharge fluid tube 83 is constituted of the first tube member and the second tube member described above.

In particular, the supply-discharge fluid tube 83 includes a first supply-discharge (supply-drain) fluid tube 83*a* that connects a first supply-discharge (supply-drain) port of the third control valve 56C to a first port of the connection member 50. In addition, the supply-discharge fluid tube 83 includes a second supply-discharge (supply-drain) fluid tube 83*b* that connects a second supply-discharge port of the third control valve 56C to a second port of the connection member 50.

That is, the operation of the third control valve 56C allows to supply the operation fluid from the third control valve 56C toward the first supply-discharge fluid tube 83*a*, and to supply the operation fluid from the third control valve 56C toward the second supply-discharge fluid tube 83*b*.

The third control valve 56C is operated by a plurality of proportional valves 60. Each of the proportional valves 60 is constituted of an electromagnetic valve configured to change an aperture of the proportional valve by being magnetized. The plurality of proportional valves 60 include a first proportional valve 60A and a second proportional valve 60B.

An output fluid tube (an output fluid path) 40 is connected to the first proportional valve 60A and the second proportional valve 60B. The proportional valves 60 (the first proportional valve 60A and the second proportional valve 60B) and the third control valve 56C are connected to each other by a fluid tube (a fluid path) 86.

The fluid tube 86 is a fluid for supplying the pilot fluid to the third control valve 56C through the proportional valves 60 (the first proportional valve 60A and the second proportional valve 60B). The fluid tube 86 is constituted of a tube member such as a steel tube, a pipe, and a hose.

The fluid tube 86 includes a first control fluid tube 86*a* and a second control fluid tube 86*b*. The first control fluid tube a connects the first proportional valve 60A to the pressure-receiving portion 61*a* of the third control valve 56C. The second control fluid tube 86*b* connects the second proportional valve 60B to the pressure-receiving portion 61*b* of the third control valve 56C.

Thus, the pilot fluid is applied to the pressure-receiving portion 61*a* of the third control valve 56C through the first control fluid tube 86*a* when the first proportional valve 60A is opened, and then the pilot pressure given (applied) to the pressure-receiving portion 61*a* on the basis of the aperture of the first proportional valve 60A.

When the pilot pressure applied to the pressure-receiving portion 61*a* is equal to or more than a predetermined pressure, the third control valve 56C is switched from the third position (the neutral position) 62*c* to the first position 62*a* by movement of the spool.

In addition, the pilot fluid is applied to the pressure-receiving portion 61*b* of the third control valve 56C through the second control fluid tube 86*b* when the second proportional valve 60B is opened, and then the pilot pressure given (applied) to the pressure-receiving portion 61*b* on the basis of the aperture of the second proportional valve 60B.

When the pilot pressure applied to the pressure-receiving portion 61*b* is equal to or more than a predetermined pressure, the third control valve 56C is switched from the third position (the neutral position) 62*c* to the second position 62*b* by movement of the spool.

The control device (the first control device) 90 magnetizes the proportional valves 60 (the first proportional valve 60A and the second proportional valve 60B). The control device 90 is constituted of a CPU and the like. A switch 96 is connected to the control device 90, the switch 96 being arranged around the operator seat 8. The control device (the first control device) 90 may be referred to as the controller (the first controller) 90

The switch 96 is constituted of a seesaw switch configured to be swung, a slide switch configured to be slid, or a push switch configured to be pushed. An operation of the switch 96 is inputted to the control device 90.

The operation of the switch 96 opens and closes the first proportional valve 60A or the second proportional valve 60B. In this manner, the auxiliary actuator is operated under the control of the control device 90.

As shown in FIG. 1, the work machine 1 includes a control device (a controller) 92 in addition to the control device 90, the control device 92 being configured to control the prime mover 32. For example, in a case where the prime mover 32 is an engine, the control device 92 is an engine control device (an engine controller).

For convenience of the explanation, the explanation will be made assuming that the prime mover 32 is an engine. In the following explanations, the control device (controller) 90 will be referred to as "a first control device (first controller) 90", and the control device (controller) 92 will be referred to as "a second control device (second controller) 92".

An ordering member 93 is connected to the second control device 92. The ordering member 93 is configured to order a target engine revolution speed (referred to as a target revolution speed of engine). The ordering member 93 includes a pedal portion 93*a* and a sensor 93*b*. The sensor 93*b* detects an operation amount (an operation extent) of the pedal portion 93*a*.

The pedal portion 93*a* is constituted of an acceleration lever supported swingably or an acceleration pedal supported swingably. The operation amount (operation extent) detected by the sensor 93*b* is inputted to the second control device 92. The operation amount (operation extent) detected by the sensor 93*b* is the target revolution speed of engine.

A sensor (measurement device) 94 is connected to the second control device 92. The sensor 94 is configured to detect an actual engine revolution speed (referred to as an actual revolution speed of the engine).

The second control device 91 provides a general engine control, and outputs the control signals representing a fuel injection amount, an injection timing, and a fuel injection rate to an injector, for example. In addition, the second control device 92 outputs the control signal representing the fuel injection pressure to a supply pump and to the common rail.

That is, the second control device controls the injector, the supply pump, and the common rail such that the actual revolution speed of the engine satisfies the target revolution speed of the engine.

The first control device 90 performs a control (an anti-stall control) to prevent an engine stall in addition to the control to the proportional valves 60 and the like. in particular, an operation valve (a second operation valve 44) is connected to the first control device 90, the operation valve 44 being disposed on the output fluid tube 40.

In the embodiment, the operation valve 44 is constituted of an electromagnetic valve (a proportional valve). The first control device 90 changes an aperture of the proportional valve 44 on the basis of a drop amount of the engine that is a difference between the target revolution speed of the engine and the actual revolution speed of the engine, thereby preventing the engine stall.

The first control device 90 is capable of obtaining the actual revolution speed of the engine and the target revolution speed of the engine. Meanwhile, the operation valve 44 may be constituted of a switch valve or may be constituted of a throttle portion.

Figure 3:
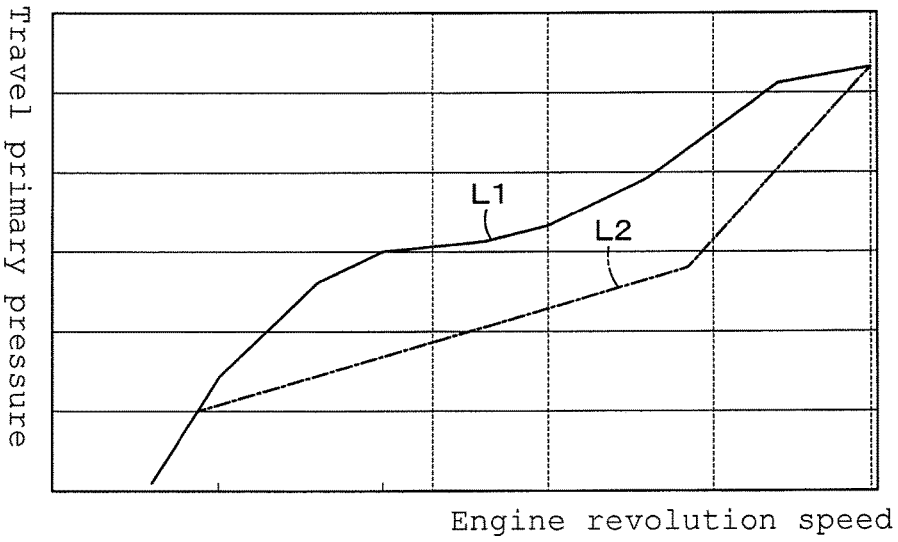
FIG. 3 is a view illustrating a relation between an engine revolution speed, a travel primary pressure, and a control line according to the first embodiment.

FIG. 3 is a view illustrating a relation between the engine revolution sped, a travel primary pressure, the control line L1, and the control line L2.

The travel primary pressure is a pressure (the pilot pressure) of the operation fluid in a section from the proportional valve 44 to the operation valves 55 (the operation valve 55A, the operation valve 55B, the operation valve 55C, and the operation valve 55D). That is, the travel primary pressure is a primary pressure of the operation fluid flowing into the the operation valves 55 disposed to the operation lever 54.

The control line L1 shows a relation between the travel primary pressure and the engine revolution speed of a case where the drop amount is less than a predetermined amount.

The control line L2 shows a relation between the travel primary pressure and the engine revolution speed of a case where the drop amount is equal to or more than the predetermined amount.

The first control device 90 adjusts the aperture of the proportional valve 44 in the case where the drop amount is less than the predetermined amount such that the relation between the actual revolution speed of the engine and the travel primary pressure corresponds to the control line L1. In addition, the first control device 90 adjusts the aperture of the proportional valve 44 in the case where the drop amount is equal to or more than the predetermined amount such that the relation between the actual revolution speed of the engine and the travel primary pressure corresponds to the control line L2.

On the control line L2, the travel primary pressure to a predetermined engine revolution speed is lower than the travel primary pressure of the control line L1. That is, at the identical engine revolution speed, the travel primary pressure of the control line L2 is lower than the travel primary pressure of the control line L1.

In this manner, the pressure (the pilot pressure) of the operation fluid flowing into the operation valves 55 is suppressed to be low under the control based on the control line L2. As the result, the swash plate angle of the HST pump 66 of the HST pump (the travel pump) 53 is adjusted, and thereby a load applied to the engine 32 is reduced to prevent the engine stall of the engine 32.

Meanwhile, the control line L2 is shown singularly in FIG. 3. However, a plurality of the control lines L2 may be provided. For example, the control lines L2 may be set for each of the engine revolution speeds. In addition, the first control device 90 may have the dada or the control parameters such as the functions representing the control line L1 and the control line L2.

Then, the hydraulic system is provided with a circuit capable of reducing the pressure (performing the pressure reduction) of the operation fluid in the travel fluid tube (the second fluid tube) 45. As shown in FIG. 1, a discharge fluid tube (a drain fluid tube) 71 is connected to the travel fluid tube (the second fluid tube) 45.

In particular, the discharge fluid tube 71 includes a first discharge fluid tube (a first drain fluid tube) 71*a*, a second discharge fluid tube (a second drain fluid tube) 71*b*, a third discharge fluid tube (a third drain fluid tube) 71*c*, a fourth discharge fluid tube (a fourth drain fluid tube) 71*d*, and a fifth discharge fluid tube (a fifth drain fluid tube) 71*e*.

The first discharge fluid tube 71*a* is a fluid tube branching from an intermediated portion of the first travel fluid tube 45*a*. The second discharge fluid tube 71*b* is a fluid tube branching from an intermediated portion of the second travel fluid tube 45*b*.

The third discharge fluid tube 71*c* is a fluid tube branching from an intermediated portion of the third travel fluid tube 45*c*. The fourth discharge fluid tube 71*d* is a fluid tube branching from an intermediated portion of the fourth travel fluid tube 45*d*.

The fifth discharge fluid tube 71*e* is a fluid tube connecting the first discharge fluid tube 71*a*, the second discharge fluid tube 71*b*, the third discharge fluid tube 71*c*, and the fourth discharge fluid tube 71*d* to each other. The fifth discharge fluid tube 71*e* is connected also to the operation fluid tank 22. An operation valve (a first operation valve) 72 is connected to an intermediate portion of the fifth discharge fluid tube 71*e*.

Check valves 73 are disposed to each of the first discharge fluid tube 71*a*, the second discharge fluid tube 71*b*, the third discharge fluid tube 71*c*, and the fourth discharge fluid tube 71*d*.

A connecting portion between the second fluid tube 45 (the first travel fluid tube 45*a*, the second travel fluid tube 45*b*, the third travel fluid tube 45*c*, and the fourth travel fluid tube 45*d*) and the discharge fluid tubes 71 (the first discharge fluid tube 71*a*, the second discharge fluid tube 71*b*, the third discharge fluid tube 71*c*, and the fourth discharge fluid tube 71*d*) is referred to as "a connecting portion C1".

In that case, the check valve 73 allows the operation fluid to flow from the connecting portion C1 to the fifth discharge fluid tube 71*e* and blocks the operation fluid flowing from the fifth discharge fluid tube 71*e* to the connecting portion C1.

A throttle portion 74 is disposed on the travel fluid tube (the second fluid tube) 45. The throttle portion 74 is configured to reduce a flow amount of the operation fluid from the operation valve 55 to the discharge fluid tube 71. The throttle portion 74 includes a first throttle portion 74*a*, a second throttle portion 74*b*, a third throttle portion 74*c*, and a fourth throttle portion 74*d*.

The first throttle portion 74*a* is a throttle that is disposed on an upper stream of the connection portion C1 connected to the first discharge fluid tube 71*a* (on a side of the operation valve 55) in the first travel fluid tube 45*a*.

The second throttle portion 74*b* is a throttle that is disposed on the upper stream of the connection portion C1 connected to the second discharge fluid tube 71*b* in the second travel fluid tube 45*b*.

The third throttle portion 74*c* is a throttle that is disposed on the upper stream of the connection portion C1 connected to the third discharge fluid tube 71*c* in the third travel fluid tube 45*c*.

The fourth throttle portion 74*d* is a throttle that is disposed on the upper stream of the connection portion C1 connected to the fourth discharge fluid tube 71*d* in the fourth travel fluid tube 45*d*.

The operation valve 72 is a variable relief valve configured to magnetize a solenoid of the operation valve 72 and thereby to change a set pressure of the operation valve 72. When the set pressure of the variable relief valve 72 is set to be lower than a predetermined pressure (to be lower than the pressure of the operation fluid in the second fluid tube 45), the variable relief valve 72 is operated (opened).

Thus, the operation fluid of the second fluid tube 45 (the first travel fluid tube 45*a*, the second travel fluid tube 45*b*, the third travel fluid tube 45*c*, and the fourth travel fluid tube 45*d*) can be supplied to the fifth discharge fluid tube 71*e* and then discharged (drained) to the operation fluid tank 22 through the variable relief valve 72.

On the other hand, when the set pressure of the variable relief valve 72 is increased (sets the set pressure to be larger than the pressure of the operation fluid in the second fluid tube 45), the variable relief valve 72 is not operated (still closed).

Thus, the operation fluid in the second fluid tube 45 dose not flow to the fifth discharge fluid tube 71*e*, and thus the pressure of the operation fluid in the second fluid tube 45 operates the travel pump 53L and the travel pump 53R.

The control device 90 changes the set pressure of the variable relief valve 72. A detection device (a first temperature sensor or a first measurement detector) 91 is connected to the control device 90. The detection device 91 is configured to detect (measure) a temperature of the operation fluid.

The first detection device 91 detects (measures) a temperature of the operation fluid in the operation fluid tank 22, a temperature of the operation fluid outputted from the first hydraulic pump P1, and the like. For example, the first measurement device 91 is disposed on a hose or a pipe connected to a suction port of the first hydraulic pump P1.

Meanwhile, the first detection device 91 may be disposed in front of the branching of the first hydraulic pump P1 and the second hydraulic pump P2 or behind the branching of the first hydraulic pump P1 and the second hydraulic pump P2. In addition, an installation site of the first detection device 91 is not limited to the above-mentioned site.

In a case where the temperature of the operation fluid (the fluid temperature) measured by the first measurement device 91 is equal to or less than a predetermined temperature, the control device 90 outputs a control signal and the like to reduce the set pressure of the variable relief valve 72 to be lower than a predetermined value (reduce the set pressure such that a secondary pressure is lower than the primary pressure of the operation valve 55), thereby opening the variable relief valve 72.

For example, in a case where the fluid temperature is equal to or less than a predetermined temperature and is a low temperature, the set pressure of the variable relief valve 72 is set to be minimum. The low temperature corresponds to a temperature range where a viscosity of the operation fluid is very high, the operation fluid having a viscosity grade (a dynamic viscosity) generally used for the work machine, and a range where the pressure of the operation fluid is increased in the fluid tube. For example, the pressure of the operation fluid is increased when the fluid temperature is 0° C. or less, especially when the fluid temperature is −10° C. or less.

Meanwhile, the aperture of the operation valve 72 (the variable relief valve 72) is not limited to the above-mentioned aperture. For example, in a case where the fluid temperature is high, the set value of the variable of relief valve 72 may be increased to make the variable relief valve 72 be closed (fully closed).

In this manner, the set pressure of the variable relief valve 72 is lowered in the case where the fluid temperature measured by the first measurement device 91 is low, and thus the operation fluid of the secondary side (the second fluid tube 45) of the operation valve 55 can be circulated, thereby easily warming up the operation fluid.

In addition, the set pressure of the variable relief valve 72 is lowered in the case where the temperature of the operation fluid is low (the pilot pressure is limited), and thus the movement of the work machine 1 can be slow down to prevent an error in operation.

Meanwhile, a measurement device (sensor) configured to measure the primary pressure and the secondary pressure of the operation valve 55 may be provided, and thereby the set pressure of the variable relief valve 72 may be changed such that "the primary pressure>the secondary pressure" is satisfied in the case where the operation fluid is at the low temperature.

In addition, the control device 90 returns the set pressure of the variable relief valve 72 to the predetermined set pressure in a case where the temperature of the operation fluid (the fluid temperature) measured by the first measurement device 91 is not equal to or less than the predetermined temperature (the low temperature).

Meanwhile, the control device 90 may be provided with a second measurement device (sensor) 95 that is configured to measure (detect) a temperature of outside air (an outside temperature). The control device 90 may change the set pressure of the variable relief valve 72 on the basis of the temperature of outside air measured by the second measurement device 95. The outside temperature is a temperature of a periphery of the work machine 1 or a temperature of a periphery of the devices mounted on the work machine 1, for example.

In particular, the variable relief valve 72 is opened in a case where the temperature of the operation fluid is equal to or less than a predetermined temperature and the temperature of outside air measured by the second measurement device 95 is equal to or less than a predetermined temperature. For example, the set pressure of the variable relief valve 72 is lowered in a case where the outside temperature measured by the second measurement device 95 is low equal to or less than the degree below freezing and the fluid temperature measured by the first measurement device 91 is low.

Meanwhile, the operation valve 72 is constituted of the variable relief valve 72 in the embodiment mentioned above, the variable relief valve 72 being configured to change the set pressure. However, the operation valve 72 may be constituted of an electromagnetic proportional valve (a proportional valve). Also in that case, the proportional valve 72 is opened in the case where the temperature (the fluid temperature) of the operation fluid is equal to or less than the predetermined temperature (low), the temperature being measured by the first measurement device 91, and the proportional valve 72 is closed in the case where the fluid temperature is not equal to or less than the predetermined temperature.

In addition, in the case where the second measurement device 95 is provided, the proportional valve 72 is opened in the case where the temperature of the operation fluid is equal to or less than the predetermined temperature and the temperature of outside air measured by the second measurement device 95 is equal to or less than the predetermined temperature, and is closed in other cases.

The control device 90 may control the proportional valve 72 in the similar manner to the variable relief valve 72.

The hydraulic system according to the embodiment easily warms up the operation fluid in the fluid tube from the operation valve for operating a hydraulic device to the hydraulic device. In addition, the hydraulic system according to the embodiment improves a responsibility of the anti-stall control, the anti-stall control preventing the engine stall. Moreover, the hydraulic system according to the embodiment improves the traveling performance of the work machine. Furthermore, the hydraulic system according to the embodiment easily brakes the work machine and releases the braking.

Second Embodiment

Figure 4:
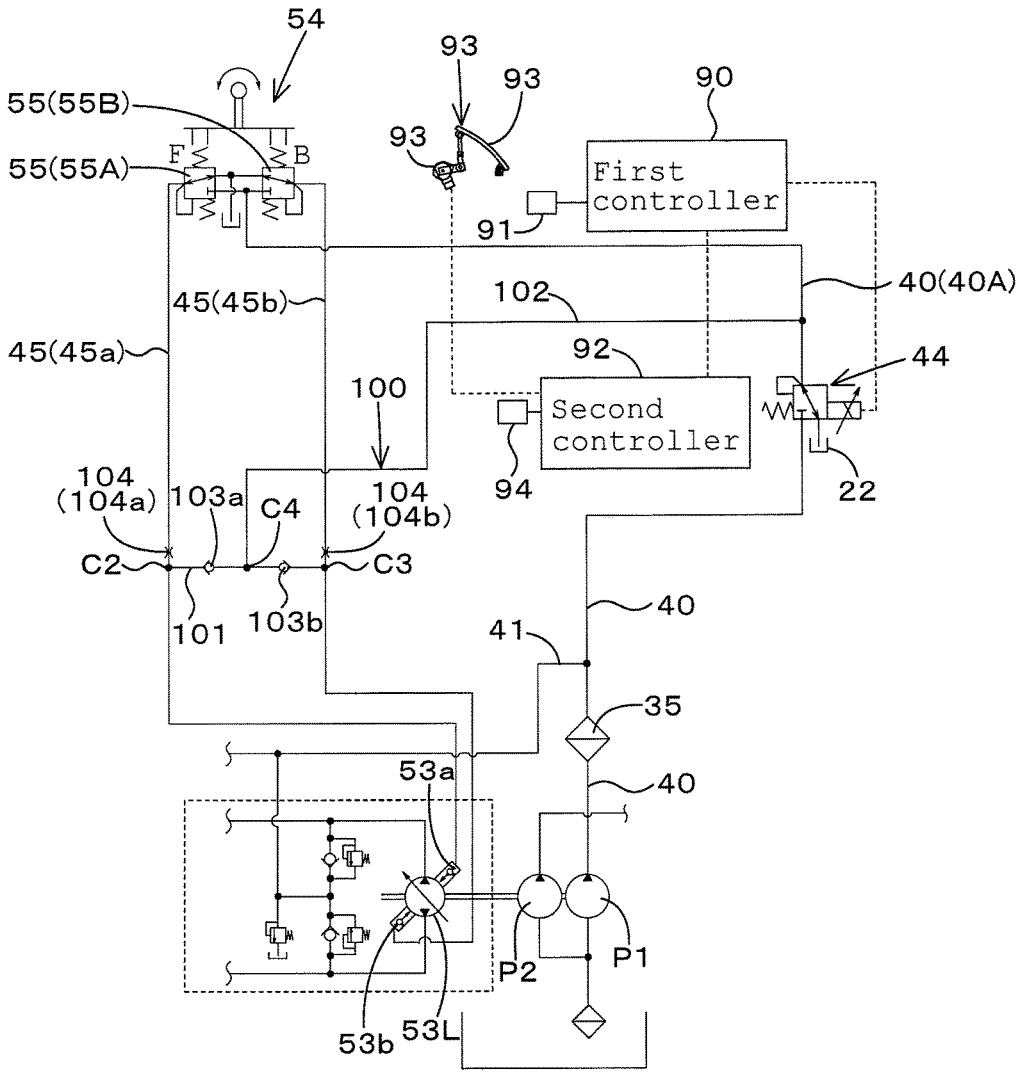
FIG. 4 is a view illustrating a hydraulic system for travel (a hydraulic circuit) for a work machine according to a second embodiment of the present invention.

FIG. 4 is a view illustrating a hydraulic system according to a second embodiment of the present invention. The hydraulic system for travel according to the second embodiment can be applied to the hydraulic system according to the first embodiment described above. Thus, explanations of configurations similar to the configurations of the first embodiment will be omitted.

As shown in FIG. 4, the hydraulic system is provided with a third fluid tube (a third fluid path) 100 in the output fluid tube 40. The third fluid tube 100 connects the second fluid tube 45 to a section 40A that is positioned between the plurality of operation valves 55 and the proportional valve 44.

The third fluid tube 100 includes a first communication fluid tube (a first communication fluid path) 101 and a second communication fluid tube (a second communication fluid path) 102. The first communication fluid tube 101 is a fluid tube (a fluid path) connecting an intermediate portion of the first travel fluid tube 45*a* to an intermediate portion of the second travel fluid tube 45*b*.

Meanwhile, the first communication fluid tube 101 may be a fluid tube connecting an intermediate portion of the third travel fluid tube 45*b* to the fourth travel fluid tube 45*d*.

The second communication fluid tube 102 is a fluid tube (a fluid path) connecting an intermediate portion of the first communication fluid tube 101 to the section 40A of the output fluid tube 40. Hereinafter, a connecting portion connecting the first travel fluid tube 45*a* to the first communication fluid tube 101 is referred to as "a connecting portion C2", a connecting portion connecting the second travel fluid tube 45*b* to the first communication fluid tube 101 is referred to as "a connecting portion C3", and a connecting portion connecting the first communication fluid tube 101 to the second communication fluid tube 102 is referred to as "a connecting portion C4".

In that case, check valves 103*a* and 103*b* are disposed on each of a section between the connecting portion C2 and the connecting portion C4 in the first communication fluid tube 101 and a section between the connecting portion C3 and the connecting portion C4 in the first communication fluid tube 101.

The check valve 103*a* allows the operation fluid to flow from the first travel fluid tube 45*a* to the second communication fluid tube 102 and blocks the flowing of the operation fluid flowing from the second communication fluid tube 102 to the first travel fluid tube 45*a*. The check valve 103*b* allows the operation fluid to flow from the second travel fluid tube 45*b* to the second communication fluid tube 102 and blocks the flowing of the operation fluid flowing from the second communication fluid tube 102 to the second travel fluid tube 45*b*.

That is, each of the check valves 103*a* and 103*b* allows the operation fluid to flow from the second fluid tube 45 to the output fluid tube 40 (the section 40A) and blocks the flowing of the operation fluid flowing from the output fluid tube 40 (the section 40A) to the second fluid tube 45.

In addition, the travel fluid tube (the second fluid tube) 45 is provided with a throttle portion 104 that is configured to reduce a flow rate of the operation fluid flowing from the operation valve 55 to the third fluid tube 100 (the first communication fluid tube 101). The throttle portion 104 includes a first throttle portion 104*a* and a second throttle portion 104*b*.

The first throttle portion 104*a* is a throttle disposed on an upper stream (on a side of the operation valve 55) of the connecting portion C2 of the first travel fluid tube 45*a*. The second throttle portion 104*b* is a throttle disposed on an upper stream of the connecting portion C2 of the second travel fluid tube 45*b*.

In the case where the anti-stall control is performed, the aperture of the operation valve 44 is set on the basis of the drop amount, and thereby the pressure of the secondary side of the operation valve 55(the pressure of the operation fluid in the second fluid tube 45) is reduced.

In a case where a path (the second fluid tube 45) from the operation valve 55 to the travel pumps 53L and 53R is long or a throttle portion is disposed on the second fluid tube 45, a time for the reduction of the pressure of the secondary side of the operation valve 55 (the pressure of the operation fluid in the second fluid tube 45) is long, and thus resulting in a response delay.

The hydraulic system for the work machine described above includes the third fluid tube 100 and the check valve 103. The third fluid tube 100 connects the second fluid tube 45 to the section 40A positioned between the operation valve 55 and the proportional valve 44. The check valve 103 is disposed on the third fluid tube 100. Thus, the operation fluid in the second fluid tube 45 can be discharged (drained) through the third fluid tube 100 and the proportional valve 44 in a case where the revolution speed of the engine widely drops, that is, in a case where the drop amount is large.

In this manner, the response delay mentioned above can be prevented. That is, in the case where the revolution speed of the engine widely drops, the pressure of the operation fluid can be rapidly reduced in the second fluid tube 45, and thereby the engine stall is prevented.

In addition, even in a case where the throttle portion 104 is disposed between the operation valve 55 and a portion connected to the third fluid tube 100 on the second fluid tube 45, the pressure of the operation fluid can be rapidly reduced in the second fluid tube 45 as described above, and thereby the engine stall is prevented.

The hydraulic system according to the embodiment easily warms up the operation fluid in the fluid tube from the operation valve for operating a hydraulic device to the hydraulic device. In addition, the hydraulic system according to the embodiment improves a responsibility of the anti-stall control, the anti-stall control preventing the engine stall. Moreover, the hydraulic system according to the embodiment improves the traveling performance of the work machine. Furthermore, the hydraulic system according to the embodiment easily brakes the work machine and releases the braking.

Third Embodiment

Figure 5:
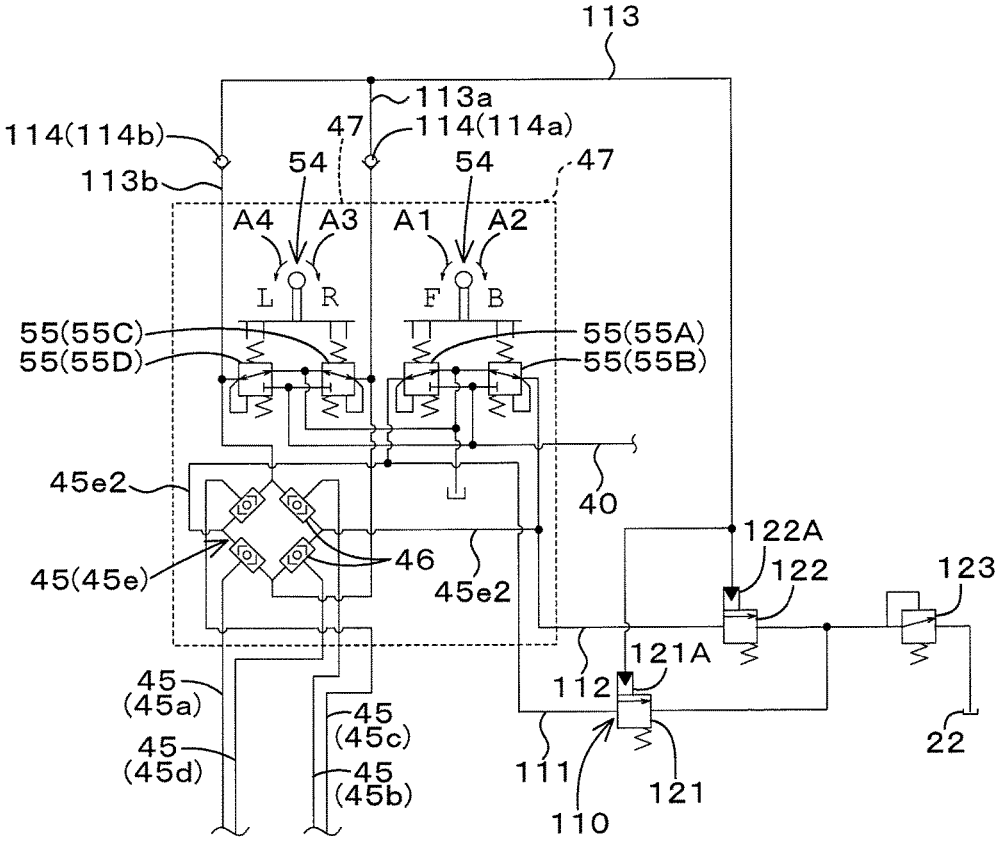
FIG. 5 is a view illustrating a hydraulic system for travel (a hydraulic circuit) for a work machine according to a third embodiment of the present invention.

FIG. 5 is a view illustrating a hydraulic system according to a third embodiment of the present invention. The hydraulic system for travel according to the third embodiment can be applied to the hydraulic systems according to the first embodiment and the second embodiment described above. Thus, explanations of configurations similar to the configurations of the first embodiment and the second embodiment will be omitted.

As shown in FIG. 5, the hydraulic system according to the embodiment includes a pressure changing portion (a pressure changer) 110. The pressure changing portion 110 is configured to differentiates the pressures of the operation fluids applied from the travel operation device 47to the hydraulic devices from each other in a case where operation manners of the operation device (the travel operation device) 47 is various.

For example, the pressure changing portion 110 differentiates a first pressure of the operation fluid from a second pressure of the operation fluid. The first pressure is applied from the operation valve 55 to the hydraulic devices such as the travel pumps 53L and 53R in a case where the operation member 54 is operated to one direction (for example, forward). The second pressure is applied from the operation valve 55 to the hydraulic devices such as the travel pumps 53L and 53R in a case where the operation member 54 is operated to the other direction (for example, backward).

For convenience of the explanation, the operation valve 55A will be referred to as the first operation valve 55A, the operation valve 55B will be referred to as the second operation valve 55B, the operation valve 55C will be referred to as the third operation valve 55C, and the operation valve 55D will be referred to as the fourth operation valve 55D in the embodiment.

In particular, the pressure changing portion 110 includes a first variable relief valve 121 and a second variable relief valve 122.

A port (an input port) of the first variable relief valve 121 is connected to the first operation valve 55A among the operation valves 55 (the first operation valve 55A and the second operation valve 55B) to be operated when the operation member 54 is operated (moved) to a first direction.

A discharge fluid tube 111 is connected to a connection tube (a connection path) 45*d* 2 that is connected to an output port of the first operation valve 55A. An input port of the first variable relief valve 121 is connected to the discharge fluid tube 111.

The second variable relief valve 122 is connected to the second operation valve 55B among the operation valves 55 (the first operation valve 55A and the second operation valve 55B) to be operated when the operation member 54 is operated (moved) to a first direction.

A discharge fluid tube 112 is connected to the connection tube (the connection path) 45*d* 2 that is connected to an output port of the second operation valve 55B. An input port of the second variable relief valve 122 is connected to the discharge fluid tube 112.

The discharge fluid tube 111 and the discharge fluid tube 112 are confluent with each other on the downstream sides of the first variable relief valve 121 and the second variable relief valve 122. A relief valve 123 is disposed on a section being on a downstream side of the confluence between the discharge fluid tube 111 and the discharge fluid tube 112. The discharge fluid tube 111 and the discharge fluid tube 112 are connected to the operation fluid tank 22 and the like, the discharge fluid tube 111 and the discharge fluid tube 112 being disposed on a downstream side of the relief valve 123.

A pressure-receiving portion 121A of the first variable relief valve 121 is connected to the third operation valve 55C and the fourth operation valve 55D by a fluid tube (a fluid path) 113. A pressure-receiving portion 122A of the second variable relief valve 122 is connected to the third operation valve 55C and the fourth operation valve 55D by the fluid tube (the fluid path) 113.

A check valve 114 is disposed on an intermediate portion of the fluid tube 113. The check valve 114 includes a check valve 114*a* and a check valve 114*b*. The check valve 114*a* is disposed on a fluid tube (a fluid path) 113*a* connected to the operation valve 55D, the fluid tube 113*a* being included in the fluid tube 113. The check valve 114*b* is disposed on a fluid tube (a fluid path) 113*b* connected to the operation valve 55D, the fluid tube 113*b* being included in the fluid tube 113.

For example, in a case where the first operation valve 55A being swingable is operated (moved) to the first direction (the machine width direction), the third operation valve 55C and the fourth operation valve 44D both being swingable may be operated (moved) to a second direction (the forward direction and the backward direction). In that case, the operations of the third operation valve 55C and the fourth operation valve 55D change the pressure of the operation fluids applied to the pressure-receiving portions of the first variable relief valve 121 and the second variable relief valve 122. In this manner, the set pressures of the first variable relief valve 121 and the second variable relief valve 122 can be reduced (lowered).

When the set pressures of the first variable relief valve 121 and the second variable relief valve 122 is equal to or more than a predetermined pressure, the first variable relief valve 121 and the second variable relief valve 122 relief the operation fluid, and thus the pressure applied to the second fluid tube 45 can be changed in the case where the first operation valve 55A is operated.

That is, when the third operation valve 55C and the fourth operation valve 55D are operated (moved) under the operation of the first operation valve 55A, the pressures of the operation fluids applied to the first travel fluid tube 45*a* and the third ravel fluid tube 45*c* can be changed, and thus a turning speed of the work machine 1 can be changed.

Additionally, in a case where the third operation valve 55C and the fourth operation valve 55D are operated (moved) under the operation of the second operation valve 55B to the other direction (backward), the pressures of the operation fluids applied to the second travel fluid tube 45*b* and the fourth ravel fluid tube 45*d* can be changed, the pressures being generated when the second operation valve 55B is operated by changing the set pressures of the first variable relief valve 121 and the second variable relief valve 122. That is, the turning speed of the work machine 1 can be changed also in the case where the third operation valve 55C and the fourth operation valve 55D are operated under the operation of the second operation valve 55B.

As described above, the pressure changing portion 110 differentiates a third pressure of the operation fluid from a fourth pressure of the operation fluid. The third pressure is applied from the first operation valve 55A to the travel pumps 53L and 53R in a case where the operation member 54 is operated to one direction (for example, leftward). The fourth pressure is applied from the second operation valve 55B to the travel pumps 53L and 53R in a case where the operation member 54 is operated to the other direction (for example, backward). In this manner, that configuration improves a responsibility in starting the turn from the straight traveling.

For convenience of the explanations, the operation valve 55A is referred to as the first operation valve, the operation valve 55B is referred to as the second operation valve, the operation valve 55C is referred to as the third operation valve, the operation valve 55D is referred to as the fourth operation valve, the valve connected to the input port of the first variable relief valve 121 is referred to as the first operation valve, and the valve connected to the input port of the second variable relief valve 122 is referred to as the second operation valve in the embodiment mentioned above. However, the first operation valve and the second operation valve are not limited to the embodiment described above. Each of the first operation valve and the second operation valve may correspond to any one of the operation valve 55A, the operation valve 55B, the operation valve 55C, and the operation valve 55D, and thus all of the combinations may be employed.

In addition, the input port of the first variable relief valve 121 may be connected to the third operation valve, and the second variable relief valve 122 may be connected to the fourth operation valve.

Moreover, the pressure changing portion 110 may differentiate the pressure of the operation fluid applied from the first operation valve or the second operation valve to the hydraulic device from the pressure of the operation fluid applied from the third operation valve or the fourth operation valve to the hydraulic device.

The hydraulic system according to the embodiment easily warms up the operation fluid in the fluid tube from the operation valve for operating a hydraulic device to the hydraulic device. In addition, the hydraulic system according to the embodiment improves a responsibility of the anti-stall control, the anti-stall control preventing the engine stall. Moreover, the hydraulic system according to the embodiment improves the traveling performance of the work machine. Furthermore, the hydraulic system according to the embodiment easily brakes the work machine and releases the braking.

Fourth Embodiment

Figure 6:
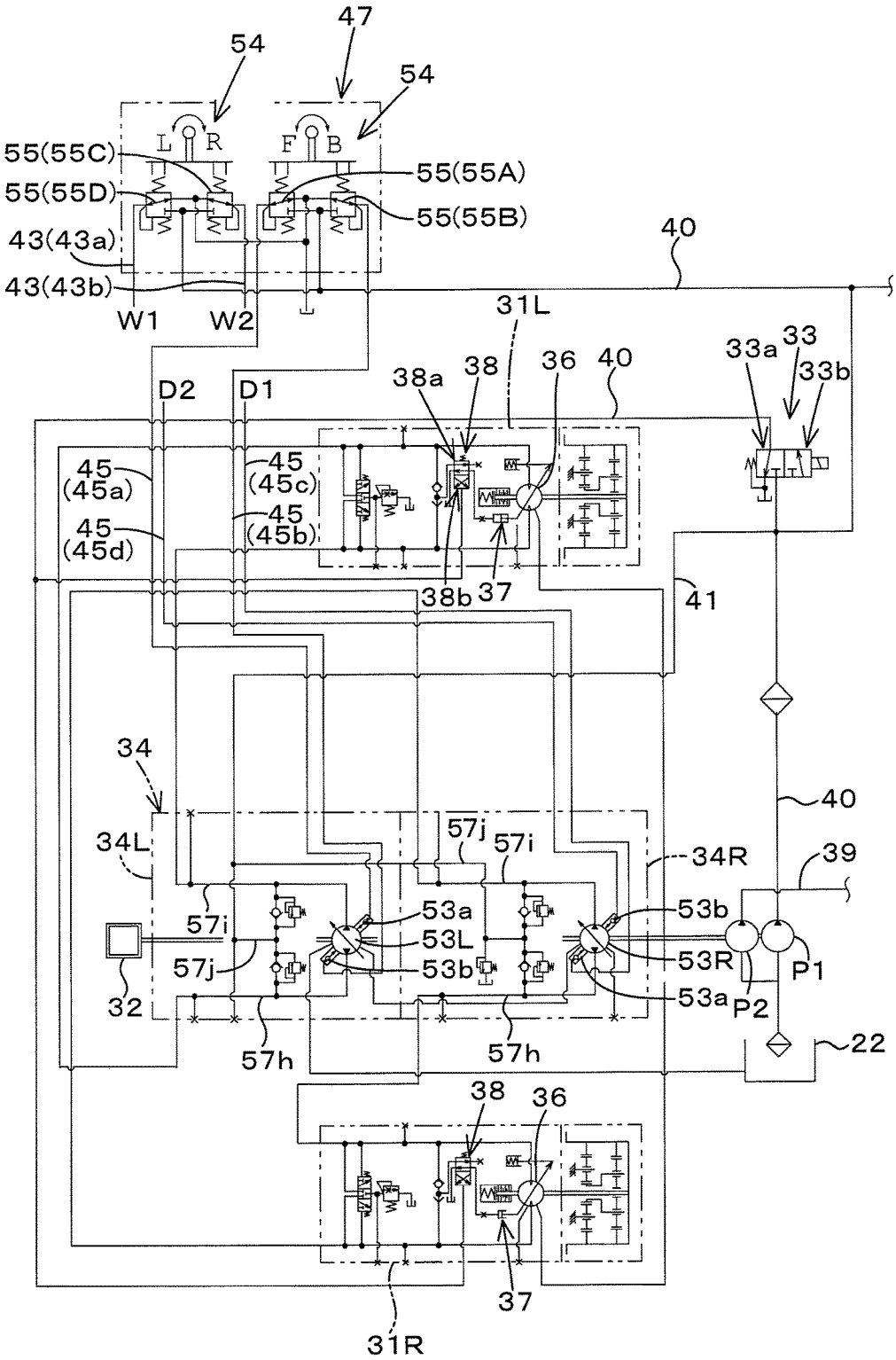
FIG. 6 is a view illustrating a hydraulic system for travel (a hydraulic circuit) for a work machine according to a fourth embodiment of the present invention.
Figure 7:
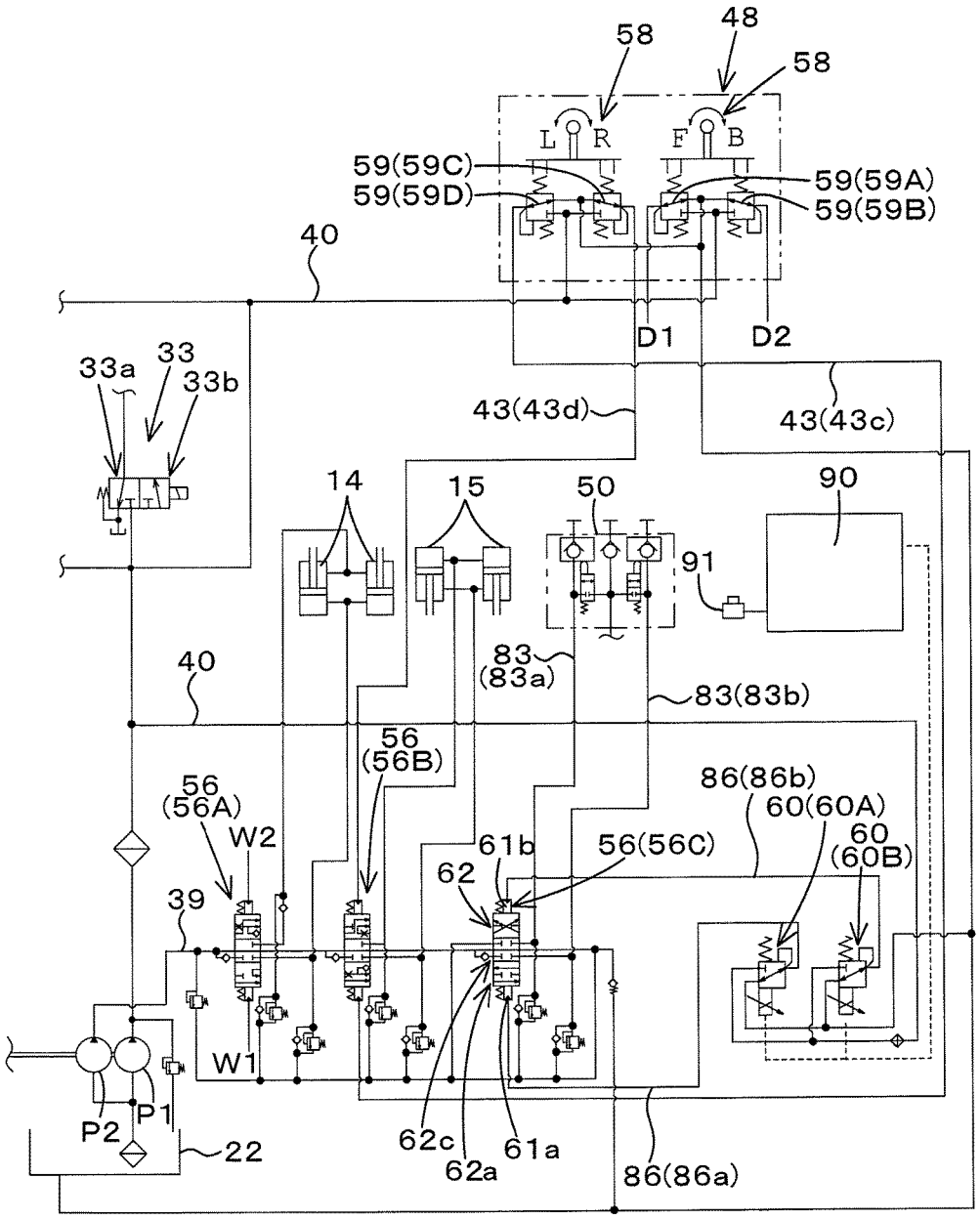
FIG. 7 is a view illustrating a hydraulic system for work (a hydraulic circuit) for a work machine according to the fourth embodiment.

FIG. 6 and FIG. 7 show a hydraulic system according to a fourth embodiment of the present invention. The hydraulic system according to the fourth embodiment can be applied to the hydraulic systems according to the first embodiment to the third embodiment described above. Thus, explanations of configurations similar to the configurations of the first embodiment to the third embodiment will be omitted.

In the embodiments described above, the traveling (the forward traveling, the backward traveling, the leftward traveling, and the rightward traveling) of the work machine 1 is controlled singularly by the operation member 54. In the fourth embodiment, the traveling of the work machine 1 is controlled by a plurality of operation members. For example, the operation member (the operation lever) 54 is arranged to the left of the operator seat 8, and the operation member (the operation lever) 58 is arranged to the right of the operator seat 8. Then, the operation valve 55 may be operated by the two operation levers, the operation lever 54 and the operation lever 58.

As shown in FIG. 6, the operation device 47 is arranged to the left of the operator seat 8, and is capable of performing an operation (a traveling operation) relating to the traveling of the work machine 1 and an operation (a working operation) relating to the working by the work machine 1.

As shown in FIG. 7, the operation device 48 is arranged to the right of the operator seat 8, and is capable of performing the operation (the traveling operation) relating to the traveling of the work machine 1 and the operation (the working operation) relating to the working by the work machine 1.

For convenience of the explanations, the operation device 47 will be referred to as a first operation device 47, and the operation device 48 will be referred to as a second operation device 48. In addition, the operation member 54 will be referred to as a first operation member 54, and the operation member 58 will be referred to as a second operation member 48.

The first operation member 54 is a lever configured to perform a first operation to be moved in the forward direction and the backward direction (in the first direction) and a second operation to be moved in the machine width direction (in the second direction). In the first operation member 54, the first operation is allocated to the traveling operation, and the second operation is allocated to the working operation.

That is, the first operation member 54 serves as both of an operation member for traveling (a travel operation member) and an operation member for working (a work operation member). Meanwhile, the first operation member 54 is not limited to the lever, and may be constituted of another member configured to at least perform the first operation and the second operation independently.

The plurality of operation valves 55 are disposed on an lower portion of the first operation member 54. The plurality of operation valves 55 includes the operation valve 55A, the operation valve 55B, the operation valve 55C, and the operation valve 55D. The operation valve 55A, the operation valve 55B, the operation valve 55C, and the operation valve 55D are connected to the discharge fluid tube 40.

Each of the operation valve 55A and the operation valve 55B is constituted of a valve that is configured to be operated in the first operation, and provides the movements corresponding to the traveling operation. Each of the operation valve 55C and the operation valve 55D is constituted of a valve that is configured to be operated in the second operation, and provides the movements corresponding to the working operation.

The second operation member 58 is a lever configured to perform a first operation to be moved in the forward direction and the backward direction (in the first direction) and a second operation to be moved in the machine width direction (in the second direction). In the second operation member 54, the first operation is allocated to the traveling operation, and the second operation is allocated to the working operation.

That is, the second operation member 58 serves as both of an operation member for traveling (a travel operation member) and an operation member for working (a work operation member). Meanwhile, the second operation member 58 is not limited to the lever, and may be constituted of another member configured to at least perform the first operation and the second operation independently.

The plurality of operation valves 59 are disposed on an lower portion of the second operation member 58. The plurality of operation valves 59 include the operation valve 59A, the operation valve 59B, the operation valve 59C, and the operation valve 59D. The operation valve 59A, the operation valve 59B, the operation valve 59C, and the operation valve 59D are connected to the discharge fluid tube 40.

Each of the operation valve 59A and the operation valve 59B is constituted of a valve that is configured to be operated in the first operation, and provides the movements corresponding to the traveling operation. Each of the operation valve 59C and the operation valve 59D is constituted of a valve that is configured to be operated in the second operation, and provides the movements corresponding to the working operation.

As described above, the operation valve 55A, the operation valve 55B, the operation valve 59A, the operation device 59B of the plurality of the operation valves is operated in accordance with the traveling operation. The operation valve 55C, the operation valve 55D, the operation valve 59C, the operation device 59D of the plurality of the operation valves is operated in accordance with the working operation.

For convenience of the explanation, each of the operation valve 55A, the operation valve 55B, the operation valve 59A, the operation device 59B may be referred to as a travel operation valve. In addition, each of the operation valve 55C, the operation valve 55D, the operation valve 59C, the operation device 59D may be referred to as a work operation device.

Referring to FIG. 6 and FIG. 7, connections of the travel operation valve and the work operation valve will be explained next. Reference numerals (D1, D2, W1, and W2) shown in FIG. 6 and FIG. 7 indicates the connection targets of the fluid tubes.

The travel operation valve is connected to the travel fluid tube (the second fluid tube) 45. The travel fluid tube 45 includes a first travel fluid tube 45*a*, a second travel fluid tube 45*b*, a third travel fluid tube 45*c*, and a fourth travel fluid tube 45*d*. In the embodiment, the first travel fluid tube 45*a* is constituted of a fluid tube connected to the forward-movement pressure-receiving portion 53*a* of the travel pump 53L and connected to the operation valve 55A.

The second travel fluid tube 45*b* is constituted of a fluid tube connected to the backward-movement pressure-receiving portion 53*b* of the travel pump 53L and connected to the operation valve 55B. The third travel fluid tube 45*c* is constituted of a fluid tube connected to the forward-movement pressure-receiving portion 53*a* of the travel pump 53R and connected to the operation valve 59A. The fourth travel fluid tube 45*d* is constituted of a fluid tube connected to the backward-movement pressure-receiving portion 53*b* of the travel pump 53R and connected to the operation valve 59B.

When the first operation member 54 is tilted forward, a pilot pressure is outputted from the operation valve 55A. The pilot pressure is applied to the forward-movement pressure-receiving portion 53*a* of the travel pump 53L. When the second operation member 58 is tilted forward, a pilot pressure is outputted from the operation valve 59A. The pilot pressure is applied to the forward-movement pressure-receiving portion 53*a* of the travel pump 53R.

When the first operation member 54 is tilted backward, a pilot pressure is outputted from the operation valve 55B. The pilot pressure is applied to the backward-movement pressure-receiving portion 53*b* of the travel pump 53L. When the second operation member 58 is tilted backward, a pilot pressure is outputted from the operation valve 59B. The pilot pressure is applied to the backward-movement pressure-receiving portion 53*b* of the travel pump 53R.

Thus, when the first operation member 54 and the second operation member 58 are tilted forward, the travel motor (the HST motor) 36 turns forward at a speed proportional to the tilting amounts (the swinging amounts) of the first operation member 54 and the second operation member 58. As the result, the work machine 1 travels forward and straight.

When the first operation member 54 and the second operation member 58 are tilted backward, the travel motor 36 turns backward at a speed proportional to the tilting amounts (the tilting extents) of the first operation member 54 and the second operation member 58. As the result, the work machine 1 travels backward and straight.

In addition, when one of the first operation member 54 and the second operation member 58 is tilted forward and the other is tilted backward, the travel motor 36 arranged to the left and the travel motor 36 arranged to the right turn in different directions from each other. As the result, the work machine 2 turns rightward or leftward.

As described above, the forward and backward movements of the first operation member 54 and the forward and backward movements of the second operation member 58 provide the traveling operations for making the work machine 1 travel forward, backward, rightward, and leftward.

In addition, the work operation valve is connected to the work fluid tube 43. The work fluid tube 43 includes a first work fluid tube 43*a*, a second work fluid tube 43*b*, a third work fluid tube 43*c*, and a fourth work fluid tube 43*d*.

The first work fluid tube 43*a* is constituted of a fluid tube connected to the first control valve 56A and to the operation valve 55D. The second work fluid tube 43*b* is constituted of a fluid tube connected to the first control valve 56A and to the operation valve 55C.

The third work fluid tube 43*c* is constituted of a fluid tube connected to the second control valve 56B and to the operation valve 59D. The fourth work fluid tube 43*d* is constituted of a fluid tube connected to the second control valve 56B and to the operation valve 59C.

When the first operation member 54 is tilted leftward, a pilot pressure of the pilot fluid is set, the pilot fluid being to be outputted from the operation valve 55D. The pilot pressure is applied to the first control valve 56A, and thereby the boom cylinder 14 is stretched to move the boom 10 upward.

When the first operation member 54 is tilted rightward, a pilot pressure of the pilot fluid is set, the pilot fluid being to be outputted from the operation valve 55C. The pilot pressure is applied to the first control valve 56A, and thereby the boom cylinder 14 is shortened to move the boom 10 downward.

When the second operation member 58 is tilted leftward, a pilot pressure of the pilot fluid is set, the pilot fluid being to be outputted from the operation valve 59D. The pilot pressure is applied to the second control valve 56B, and thereby the bucket cylinder 15 is shortened to make the bucket 11 perform the shoveling movement.

When the second operation member 58 is tilted rightward, a pilot pressure of the pilot fluid is set, the pilot fluid being to be outputted from the operation valve 59C. The pilot pressure is applied to the second control valve 56B, and thereby the bucket cylinder 15 is stretched to make the bucket 11 perform the dumping movement.

As described above, the rightward and leftward movements of the first operation member 54 and the rightward and leftward movements of the second operation member 58 provide the upward and downward movements of the boom 10 and the working operations such as the dumping movement and the shoveling movement of the bucket.

The hydraulic system according to the fourth embodiment is capable of releasing the braking state of the travel device 5 when the travel operation valves (the operation valve 55A, the operation valve 55B, the operation valve 59A, and the operation valve 59B).

For convenience of the explanations, the operation valve 55A will be referred to as the first operation valve 55A, the operation valve 55B will be referred to as the second operation valve 55B, the operation valve 59A will be referred to as the third operation valve 59A, and the operation valve 59B will be referred to as the fourth operation valve 55C. The braking of the travel device 5 will be explained below.

Figure 8A:
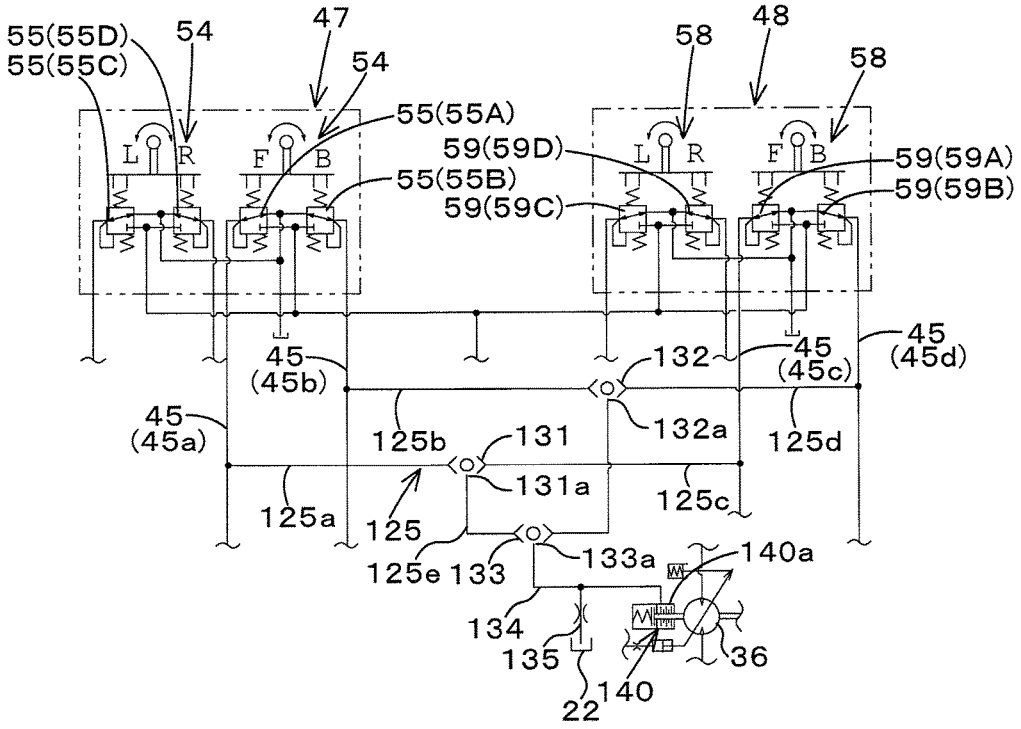
FIG. 8A is a view illustrating a relation between an operation device, a travel fluid tube, a select valve, and a brake device according to the fourth embodiment.
Figure 8B:
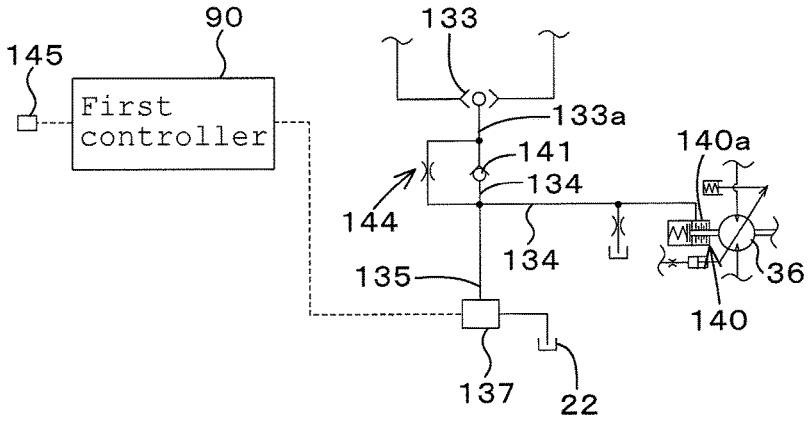
FIG. 8B is a view illustrating a first modified example of the relation between the operation device, the travel fluid tube, the select valve, and the brake device according to the fourth embodiment.

FIG. 8A and FIG. 8B are views illustrating the operation device, the travel fluid tube, the braking device, and the like.

As shown in FIG. 8A, a branched fluid tube 125 is connected to the travel fluid tube (the second fluid tube) 45.

In particular, the branched fluid tube 125 includes a first branched fluid tube 125*a*, a second branched fluid tube 125*b*, a third branched fluid tube 125*c*, a fourth branched fluid tube 125*d*, and a fifth branched fluid tube 125*e*.

The first branched fluid tube 125*a* is constituted of a fluid tube branched from an intermediate portion of the first travel fluid tube 45*a*. The second branched fluid tube 125*b* is constituted of a fluid tube branched from an intermediate portion of the second travel fluid tube 45*b*. The third branched fluid tube 125*c* is constituted of a fluid tube branched from an intermediate portion of the third travel fluid tube 45*c*. The fourth branched fluid tube 125*d* is constituted of a fluid tube branched from an intermediate portion of the fourth travel fluid tube 45*d*.

The first branched fluid tube 125*a* and the third branched fluid tube 125*c* are connected to a first select valve 131. The second branched fluid tube 125*b* and the fourth branched fluid tube 125*d* are connected to a second select valve 132. The first select valve 131 and the second select valve 132 are connected to the fifth branched fluid tube 125*e*. The fifth branched fluid tube 125*e* is provided with a third select valve 133.

The first select valve (shuttle valve) 131 includes an output port 131*a*. The output port 131*a* is configured to output higher one of a pressure of the operation fluid (the operation fluid outputted from the first operation valve 55A) of the first branched fluid tube 125*a* and a pressure of the operation fluid (the operation fluid outputted from the third operation valve 59A) of the third branched fluid tube 125*c*.

The second select valve (shuttle valve) 132 includes an output port 132*a*. The output port 132*a* is configured to output higher one of a pressure of the operation fluid (the operation fluid outputted from the second operation valve 55B) of the second branched fluid tube 125*b* and a pressure of the operation fluid (the operation fluid outputted from the fourth operation valve 59B) of the fourth branched fluid tube 125*d*.

The third select valve (shuttle valve) 133 includes an output port 133*a*. The output port 133*a* is configured to output higher one of a pressure of the operation fluid outputted from the output port 131*a* of the first select valve 131 and a pressure of the operation fluid outputted from the output port 132*a* of the second select valve 132.

A fourth fluid tube 134 is connected to the output port 133*a* of the third select valve (the shuttle valve) 133. The brake device 140 is connected to the fourth fluid tube 134.

In addition, a fifth fluid tube 135 is connected to an intermediate portion of the fourth fluid tube 140. The fifth fluid tube 135 is constituted of a discharge fluid tube configured to discharge (drain) the operation fluid.

The brake device 140 is constituted of a device configured to brake the travel device 5, a second disk, and releases the braking. In particular, the brake device 140 includes a first disk and a spring. The first disk is disposed on an output shaft of the travel motor 36. The second disk is configured to be movable. The spring pushed the second disk to the first disk such that the second disk is contacted to the first disk.

In addition, the brake device 140 includes a housing portion (a housing case) 140*a*. The housing portion 140*a* houses the first disk, the second disk, and the spring. The fourth fluid tube 134 is connected to a portion housing the second disk in the housing portion 140*a*. In a storage portion of the housing portion 140*a*, when the pilot fluid is supplied to satisfy a predetermined pressure in the storage portion, the second disk is moved toward a side opposite to a side of the braking, thereby releasing the braking provided by the brake device 140.

On the other hand, when the pilot pressure is reduced to the predetermined pressure or less in the storage portion of the housing portion 140*a*, the second disk is moved toward a side where the second disk is contacted to the first disk, thereby braking the travel motor 36.

In this manner, when any one of the travel operation valves, that is, the first operation valve 55A, the second operation valve 55B, the third operation valve 59, and the fourth operation valve 55C is operated, the pressure of the operation fluid outputted from the operation valve having been operated is applied to the fourth fluid tube 134 through the first select valve 131 and the second select valve 132. Thus, the brake device 140 releases the braking in the case where any one of the traveling operations (the forward traveling, the backward traveling, and the turning) is performed, that is, in the case where the first operation member 54 or the second operation member 58 is operated.

Meanwhile, as shown in FIG. 8B, a check valve (a first check valve) 141 may be disposed on the fourth fluid tube 134. The first check valve 141 allows the operation fluid to flow from the third select valve 133 to the brake device 140 and blocks the flowing of the operation fluid flowing from the brake device 140 to the third select valve 133.

In addition, a switch valve 137 may be disposed on the fifth fluid tube 135. The switch valve 137 is constituted of a valve configured to be switched to discharge (drain) the operation fluid included in the fifth fluid tube 135, that is, a two-position switch valve configured to be switched to a first position and to a second position. The switch valve 137 is switched by a switch (a parking switch) 145 connected to the control device 90 and the like.

The parking switch 145 is a switch configured to be turned on and tuned off. The control device 90 demagnetizes a solenoid of the switch valve 137 to hold the switch valve 137 at the first position in a case where the parking switch 145 is turned on. In this manner, the operation fluid in the fifth fluid tube 135 is discharged (drained) to the operation fluid tank 22 and the like through the switch valve 137.

The control device 90 magnetizes the solenoid of the switch valve 137 to hold the switch valve 137 at the second position in a case where the parking switch 145 is turned off. In this manner, the operation fluid in the fifth fluid tube 135 is not discharged (drained) to the operation fluid tank 22 and the like.

That is, the operation fluids of the fifth fluid tube 135 and the fourth operation fluid 134 are discharged (drained) to the operation fluid tank 22 and the like in the case where the switch valve 137 is switched to the first position, and thus the brake device 140 is set to be in the braking state.

On the other hand, the operation fluids of the fifth fluid tube 135 and the fourth operation fluid 134 are not discharged (drained) to the operation fluid tank 22 and the like in the case where the switch valve 137 is switched to the second position, and thus the brake device 140 is set to be in the released state.

A bypass fluid tube 144 may be disposed on each of the fourth fluid tube 134 and the fifth fluid tube 135, the bypass fluid tube 144 having a throttle portion 143 configured to reduce a flow rate of the operation fluid.

Figure 8C:
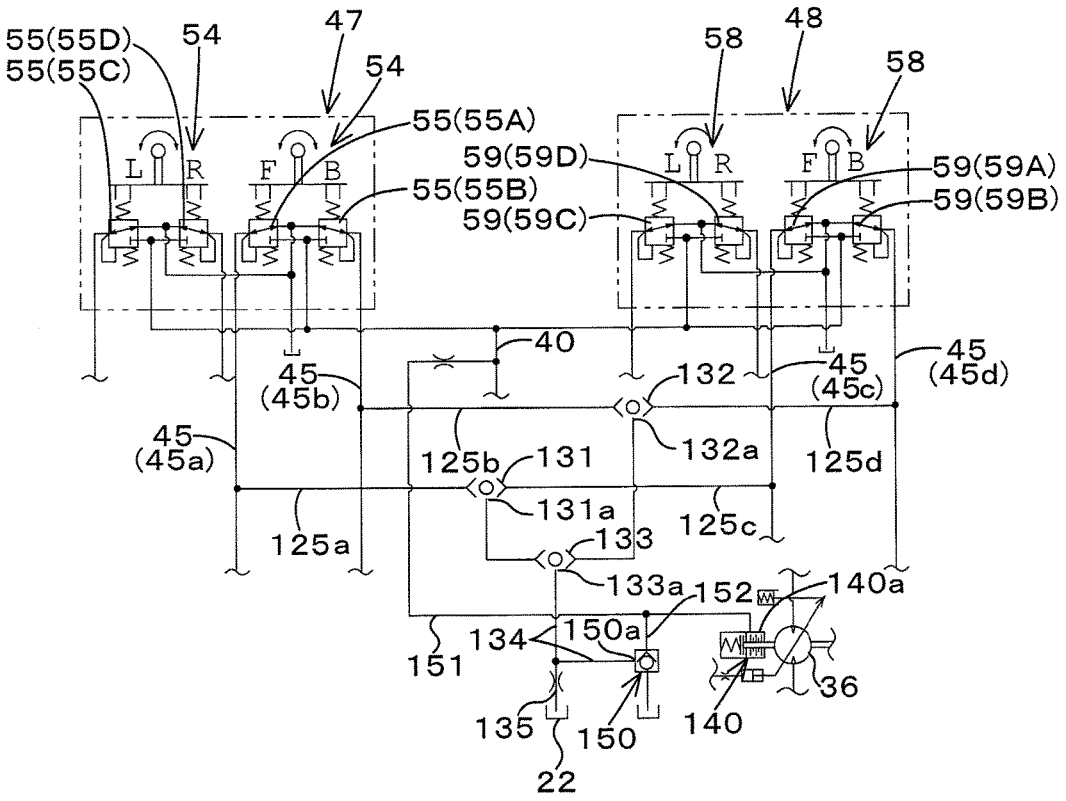
FIG. 8C is a view illustrating a second modified example of the relation between the operation device, the travel fluid tube, the select valve, and the brake device according to the fourth embodiment.

Meanwhile, as shown in FIG. 8C, a pilot check valve 150 may be disposed on the fourth fluid tube 134, and in this manner the braking of the control device 140 can be released. In particular, the discharge fluid tube 40 is provided with a branched fluid tube 151 branched from the discharge fluid tube 40. The brake device 140 is connected to the branched fluid tube 151.

A discharge fluid tube 152 is connected to an intermediate portion of the branched fluid tube 151. A pilot check valve 10 is disposed on the discharge fluid tube 152. The fourth fluid tube 134 is connected to a pressure-receiving portion 150*a* of the pilot check valve 150.

In the hydraulic system shown in FIG. 8C, the pressure of the operation fluid is increased in the fourth fluid tube 134 in the case where any one of the traveling operations (the forward traveling, the backward traveling, and the turning) is performed, that is, in the case where the first operation member 54 or the second operation member 58 is operated. The increased pressure of the operation fluid is applied to the pressure-receiving portion 150*a* of the pilot check valve 150. When the pressure of the operation fluid is applied to the pressure-receiving portion 150*a* of the pilot check valve 150, the pilot check valve 150 is closed.

In this manner, the pressure of the operation fluid of the branched fluid tube 151 can be applied to the brake device 140, and thereby the brake device 140 is set to be in the released state.

Meanwhile, in a case where the traveling operation is not performed, the pressure of the operation fluid of the fourth fluid tube 134 is lowered (reduced), thereby the pilot check valve 150 is opened. In this manner, the opening of the pilot check valve 150 reduces the pressure of the operation fluid in the branched fluid tube 151, and thereby the brake device 140 is set to be in the braking state.

The hydraulic system for the work machine mentioned above includes the first select valve 131, the second select valve 132, the third select valve 133, the fourth fluid tube 134, and the brake device 140 connected to the fourth fluid tube 134. In this manner, when the operation member 54 arranged to the left of the operator seat 8 and the operation member 58 arranged to the right of the operator seat 8 are operated, the control device 140 is capable of releasing the braking of the travel device 5 only by operating the operation members 54 and 58 in the work machine configured to operate the travel device 5.

For example, when either one of the operation members 54 and 58 is operated, the pressure of the operation fluid can be applied to the brake device 140, and thereby the braking is easily released. In addition, when both of the operation members 54 and 58 are set to the neutral position, the brake device 140 easily brakes the travel device 5.

In the embodiment mentioned above, the HST pump (the travel pump) 66 and the travel motor 36 are controlled by the operation fluid (the pilot fluid) under the HST control. However, the HST pump (the travel pump) 66 and the travel motor 36 may be electrically controlled.

That is, in the HST control, the swash plate of the travel pump or the travel motor may be controlled by an electromagnetic proportional valve and the like, and may be controlled by another method.

In the embodiment mentioned above, the discharge fluid tube configured to discharge (drain) the operation fluid is connected to the operation fluid tank 22. However, the connection target of the discharge fluid tube is not limited, and may be a suction portion of the hydraulic pump and may be other portions.

In addition, each of the first hydraulic pump P1 and the second hydraulic pump P2 may be constituted of a variable displacement pump having a swash plate, and may be constituted of another type of pump.

Each of the operation valves shown in FIG. 8 may be constituted of a proportional valve having a potentiometer configured to electrically detect the operation amounts (the operation extents of the operation members 54 and 58.

In the embodiment mentioned above, the engine stall is prevented by the first control device 90 controlling the aperture of the operation valve (the proportional valve) 44. However, instead of that configuration, the engine stall may be prevented by the actuation valve of the variable relief valve 72 and the like.

Figure 9A:
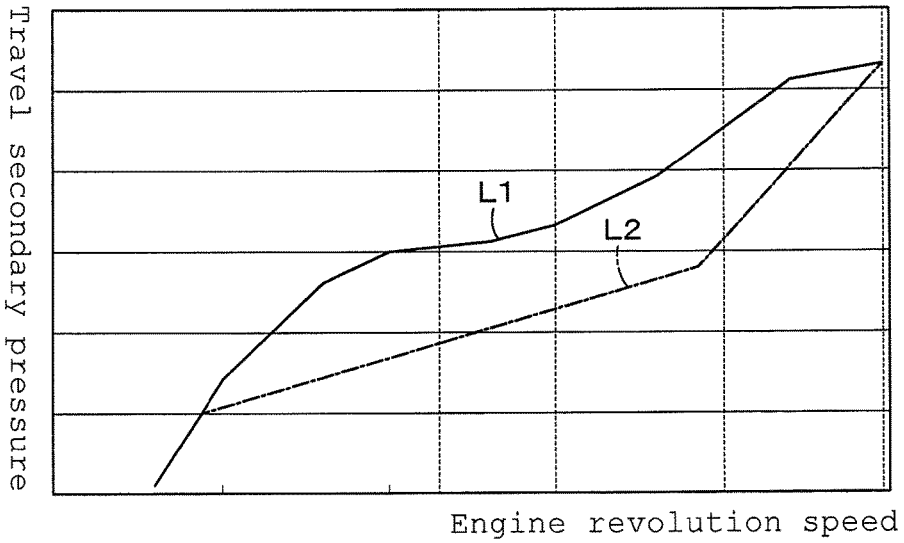
FIG. 9A is a view illustrating a relation between an engine revolution speed, a travel secondary pressure, and a control line according to the fourth embodiment.

As shown in FIG. 9A, the engine stall may be prevented by using the control lines L1 and L2 representing the relation between the travel secondary pressure and the engine revolution speed. The travel secondary pressure is a pressure of the operation fluid flowing from the operation valves 55 (the operation valve 55A, the operation valve 55B, the operation valve 55C, and the operation valve 55D) to the travel pumps (the HST pumps) 53L and 53R in the travel fluid tubes 45 (the first travel fluid tube 45*a*, the second travel fluid tube 45*b*, the third travel fluid tube 45*c*, and the fourth travel fluid tube 45*d*)

When the drop amount of the engine revolution speed is less than a predetermined amount, the first control device 90 adjusts the aperture of the actuation valve (the variable relief valve) 72 such that a relation between the travel secondary pressure and the actual revolution speed of the engine corresponds to the control line L1. In addition, when the drop amount of the engine revolution speed is equal to or more than the predetermined amount, the first control device 90 adjusts the aperture of the actuation valve (the variable relief valve) 72 such that a relation between the travel secondary pressure and the actual revolution speed of the engine corresponds to the control line L2.

In a case where a fluid temperature of the operation fluid measured by the measurement device 91 is high, the variable relief valve 72 changes the aperture on the basis of the control lines L1 and L2 shown in FIG. 9A. Meanwhile, in a case where the fluid temperature of the operation fluid measured by the measurement device 91 is low, the set pressure of the variable relief valve 72 is changed by the first control device 90, and thereby the travel secondary pressure can be adjusted so as not to be equal to or more than the predetermined pressure as shown in the control lines L1 and L2 of FIG. 9B.

Figure 9B:
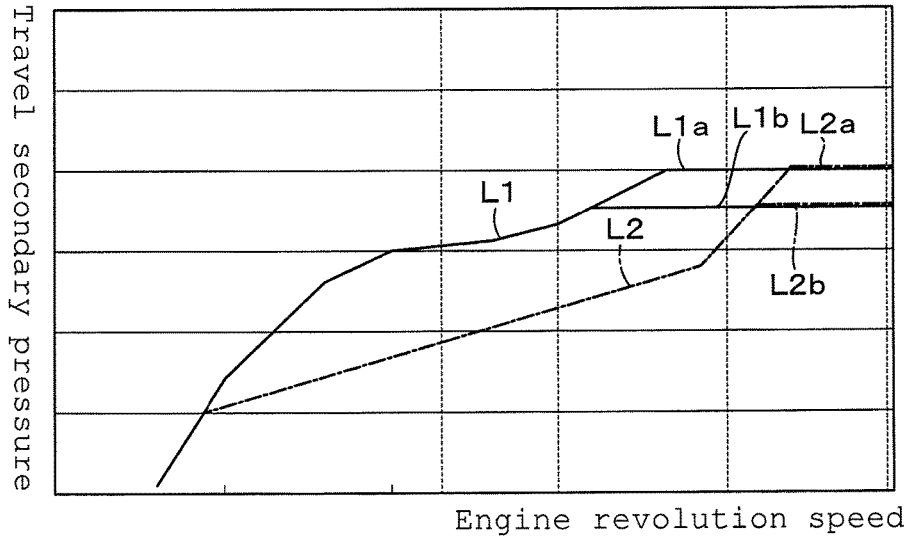
FIG. 9B is a view illustrating a case where the travel secondary pressure has an upper limitation.

Meanwhile, values (upper limit vales of the travel secondary pressure) of the control lines L1*a*, L1*b*, L2*a*, and L2*b* may be set on the basis of the fluid temperature as shown in FIG. 9B. For example, in a case where the fluid temperature is low, −15° C., the travel secondary pressure is set referring to the control lines L1*a* and L2*a*. In addition, in a case where the fluid temperature is low, −20° C., the travel secondary pressure is set referring to the control lines L1*b* and L2*b*. That is, the lower the fluid temperature is, the more suppressed (the lower) the travel secondary pressure is in the control lines L1 and L2.

The fluid temperatures at which the control lines L1*a*, L1*b*, L2*a*, and L2*b* are set are not limited to the values described above. In addition, the number of the control lines defining the travel secondary pressure at the low temperature is not limited to the number mentioned above. As described above, a plurality of control lines defining the upper limitation of the travel secondary pressure are prepared for each of predetermined low temperatures, and thereby the work machine 1 is capable of warming up the operation fluid even in traveling.

The hydraulic system according to the embodiment easily warms up the operation fluid in the fluid tube from the operation valve for operating a hydraulic device to the hydraulic device. In addition, the hydraulic system according to the embodiment improves a responsibility of the anti-stall control, the anti-stall control preventing the engine stall. Moreover, the hydraulic system according to the embodiment improves the traveling performance of the work machine. Furthermore, the hydraulic system according to the embodiment easily brakes the work machine and releases the braking.

Fifth Embodiment

Figure 10:
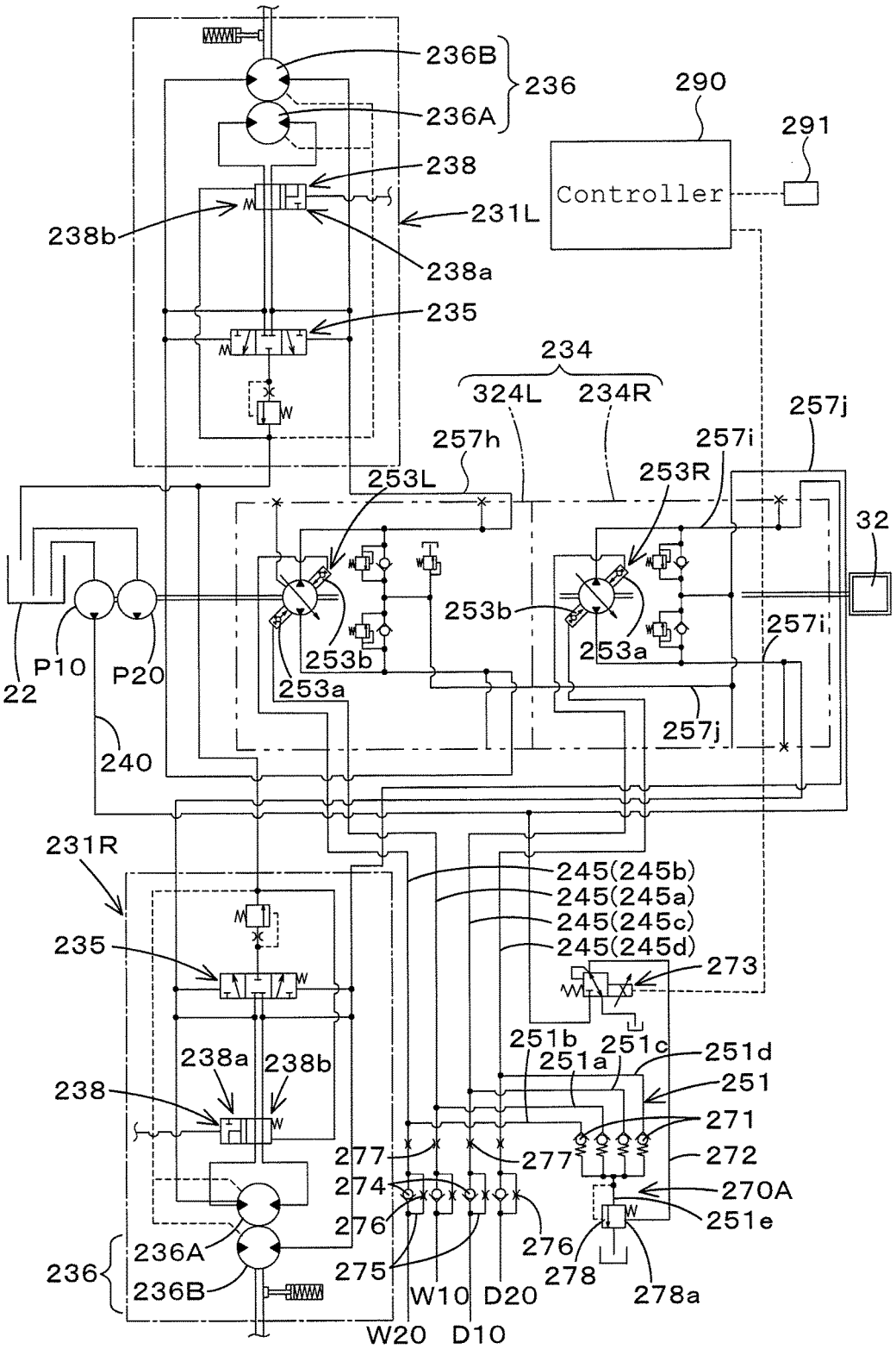
FIG. 10 is a schematic view illustrating a hydraulic system for travel (a hydraulic circuit) according to a fifth embodiment of the present invention.

FIG. 10 shows a hydraulic system for travel employed as a hydraulic system for a work machine according to a fifth embodiment of the present invention. A whole configuration of the work machine is similar to the configurations of the embodiments described above. Thus, the explanations of the configurations will be omitted.

As shown in FIG. 10, the hydraulic system includes a first hydraulic pump P10, a left travel motor device (a first travel motor device) 231L, a right travel motor (a second travel motor device) 231R, a prime mover 32, and a travel drive device 234.

The first hydraulic pump P10 is configured to output the operation fluid that is stored in the tank 22. The first hydraulic pump P10 is a pump configured to be driven by a motive power of the prime mover 32, and is constituted of a constant-displacement gear pump. The first hydraulic pump P10 outputs the operation fluid mainly used for the control.

For convenience of the explanation, the tank 22 for storing the operation fluid is referred to as an operation fluid tank. In addition, of the operation fluid outputted from the first hydraulic pump P10, the operation fluid used for the control is referred to as a pilot fluid, and a pressure of the pilot fluid is referred to as a pilot pressure.

The output fluid tube (the output fluid path) 40 is disposed on an output side of the first hydraulic pump P10, the output fluid tube 40 being configured to supply the operation fluid (the pilot fluid). The output fluid tube (a first fluid tube) 240 is provided with the first travel motor device 231L and the second travel motor device 231R.

The prime mover 32 is constituted of an electric motor, an engine, or the like. In the embodiment, the prime mover 32 is the engine. Meanwhile, the prime mover 32 may be a hybrid type having the electric motor and the engine, and may be a type only having the electric motor.

The travel drive device 234 is a device configured to drive the first travel motor device 231L and the second travel motor device 232R. The travel drive device 234 includes a drive circuit (a left drive circuit) 234L and a drive circuit (a right drive circuit) 234R, the drive circuit 234L being configured to drive the first travel motor 231L, the drive circuit 234R being configured to drive the second travel motor 231R.

Each of the left drive circuit 234L and the right drive circuit 234R includes the travel pumps (travel hydraulic pumps) 253L and 253R, the speed-changing fluid tubes 257*h* and 257*i*, and a second charge fluid tube 257*j*.

Each of the speed-changing fluid tubes 257*h* and 257*i* is a fluid tube connecting the travel pumps 253L and 253R to the travel motor 36. The second charge fluid tube 257*j* is a fluid tube connected to the speed-changing fluid tubes 257*h* and 257*i* and configured to charge the operation fluid from the first hydraulic pump P10 to the speed-changing fluid tubes 257*h* and 257*i*.

Each of the travel pumps 253L and 253R is constituted of a variable-displacement axial pump having a swash plate configured to be driven by a motive power of the prime mover 32. Each of the travel pumps 253L and 253R includes a forward-movement pressure-receiving portion 253*a* and a backward-movement pressure-receiving portion 253*b*. The pilot pressure is applied to the forward-movement pressure-receiving portion 253*a* and to the backward-movement pressure-receiving portion 253*b*. An angle of swash plate is changed by the pilot pressure applied to the forward-movement pressure-receiving portion 253*a* and to the backward-movement pressure-receiving portion 253*b*.

The angle of the swash plate is changed, and thereby the changing of the angle changes outputs of the travel pumps 253L and 253R (discharge amounts of the operation fluid) and an output direction of the operation fluid.

The first travel motor device 231L is constituted of a motor configured to supply a motive power to a drive shaft of the travel device 5, the travel device 5 being disposed on the left side of the machine body 2. The second travel motor device 231R is constituted of a motor configured to supply a motive power to a drive shaft of the travel device 5, the travel device 5 being disposed on the right side of the machine body 2.

The first travel motor device 231L includes a travel motor 236, a forward-backward switch valve 235, and a travel control valve (a hydraulic switch valve) 238. The operation fluid can be supplied to the travel motor 236, to the forward-backward switch valve 235, and to the travel control valve 238.

The travel motor 236 is constituted of a cam motor (a radial piston motor). The travel motor 236 varies a displacement (a motor displacement) in operating, and thereby changes revolutions and torques of the output shaft.

In particular, the travel motor 236 includes a first motor 236A and a second motor 236B. When the first motor 236A and the second motor 236B are driven, the motor displacement is increased, and thereby the travel motor 236 is shifted to a first speed.

In addition, when either one of the first motor 236A and the second motor 236B is driven, the motor displacement is decreased, and thereby the travel motor 236 is shifted to a second speed.

The travel control valve 238 is constituted of a two-position switch valve configured to be switched to a first portion 238*a* and to a second position 238*b*. The travel control valve 238 is switched by a switch 291 and the like.

In particular, the switch 291 is connected to the control device 290. In a case where the travel control valve 238 is set to the first speed by the switch 291, the control device 290 switches a hydraulic switch valve connected to the pressure-receiving portion of the travel control device 238 by a fluid tube, and thereby switches the travel control valve 238 to the second position 238*b*.

In a case where the travel control valve 238 is set to the second speed by the switch 291, the control device 290 switches the hydraulic switch valve, and thereby switches the travel control valve 238 to the first position 238*a*. As described above, the travel control valve 238 is switched, and thereby the speeds of the travel motors 236 (the first motor 236A and the second motor 236B) are changed.

A hydraulic system for work will be explained below.

As shown in FIG. 12, the hydraulic system includes a plurality of control valves 56 and an operation hydraulic pump (a second hydraulic pump) P20.

The second hydraulic pump P20 is constituted of a constant-displacement gear pump that is a pump installed on a position different from the position of the first hydraulic pump P10. The second hydraulic pump P20 is configured to output the operation fluid stored in the operation fluid tank 22. The second hydraulic pup P20 outputs the operation fluid mainly used for activating a hydraulic actuator.

A fluid tube (a main fluid path) 239 is disposed on an output side of the second hydraulic pump P20. A plurality of control valves 256 are connected to the main fluid tube 239. The control valve 256 is constituted of a valve configured to switch a flow direction of the operation fluid with use of the pilot pressure of the pilot fluid.

In addition, the control valve 256 is a valve configured to control (drive) the hydraulic actuators such as the boom, the bucket, the hydraulic crusher, the hydraulic breaker, the angle broom, the earth auger, the pallet fork, the sweeper, the mower, the snow blower.

The plurality of control valves 256 include a first control valve 256A, a second control valve 256B, and a third control valve 256C.

The first control valve 256A is a valve configured to control the hydraulic cylinder (the boom cylinder) 14 for controlling the boom. The second control valve 256B is a valve configured to control the hydraulic cylinder (the bucket cylinder) 15 for controlling the bucket.

The third control valve 256C is a valve configured to control the hydraulic actuators (the hydraulic cylinder, the hydraulic motor) attached to an auxiliary attachment such as the hydraulic crusher, the hydraulic breaker, the angle broom, the earth auger, the pallet fork, the sweeper, the mower, the snow blower.

Each of the first control valve 256A and the second control valve 256B is constituted of three-position switch valve having a direct-acting spool that is configured to be driven by the pilot pressure. Each of the first control valve 256A and the second control valve 256B is switched by the pilot pressure to a neutral position, to a first position different from the neural position, and to a second positon different from the neutral position and the first position.

The boom cylinder 14 is connected to the first control valve 256A by a fluid tube. The bucket cylinder 15 is connected to the second control valve 256B by a fluid tube.

A supply-discharge fluid tube (a supply-discharge fluid path) 283 is connected to the third control valve 256C.

One end of the supply-discharge fluid tube 283 is connected to a supply-discharge port of the third control valve 256C. An intermediate portion of the supply-discharge fluid tube 283 is connected to the connection member 50. The other end of the supply-discharge fluid tube 283 is connected to the auxiliary hydraulic actuator.

In particular, the supply-discharge fluid tube 283 includes a first supply-discharge fluid tube 283*a*. The first supply-discharge fluid tube 283*a* connects a first supply-discharge port of the third control valve 256C to a first port of the connection member 50. In addition, the supply-discharge fluid tube 283 includes a second supply-discharge fluid tube 283*b*. The second supply-discharge fluid tube 283*b* connects a second supply-discharge port of the third control valve 256C to a second port of the connection member 50.

That is, when the third control valve 256C is operated, the operation fluid is supplied from the third control valve 256C toward the first supply-discharge fluid tube 283*a*, and the operation fluid is supplied from the third control valve 256C toward the second supply-discharge fluid tube 283*b*.

As shown in FIG. 10, the first operation device 247 is arranged to the left of the operator seat 8, and the second operation device 248 is arranged to the right of the operator seat 8. the first operation device 247 and the second operation device 248 perform an operation (a traveling operation) relating to the traveling of the work machine 1 and an operation (a working operation) relating to the working by the work machine 1.

In other words, the first operation device 247 and the second operation device 248 are operation devices configured to operate the hydraulic devices for travel (the travel motor 236 and the travel pumps 253L and 253R) and the hydraulic device for work (the first control valve 256A, the second control valve 256B, the third control valve 256C, the boom cylinder 14, the bucket cylinder 15, the hydraulic cylinder disposed on the auxiliary attachment, and the hydraulic motor).

The first operation device 247 and the second operation device 248 will be explained below in detail.

The first operation device 247 is constituted of a device configured to perform both of the traveling operation and the working operation, and includes a first operation member 254. The first operation member 254 is a lever configured to perform a first operation and a second operation, the first operation being moved to the forward direction and to the backward direction, the second operation being moved to the lateral direction (the machine width direction) different from the forward direction and the backward direction.

In other words, the second operation member 254 is constituted of a lever configured to be moved in one direction (for example, forward and leftward) and in the other direction (for example, backward and rightward) different from the one direction.

In the first operation member 254, the first operation is allocated to the traveling operation, and the second operation is allocated to the working operation. That is, the first operation member 254 serves as both of an operation member for traveling (a travel operation member) and an operation member for working (a work operation member).

Meanwhile, the first operation member 254 is not limited to the lever, and may be constituted of another member configured to at least perform the first operation and the second operation independently.

The plurality of operation valves 255 are disposed on an lower portion of the first operation member 254. The plurality of operation valves 255 includes the operation valve 255A, the operation valve 255B, the operation valve 255C, and the operation valve 255D. The operation valve 255A, the operation valve 255B, the operation valve 255C, and the operation valve 255D are connected to the discharge fluid tube 240.

The operation valve 255A is constituted of a valve activated by the forward movement (the forward operation) of the first operation (the forward movement and the backward movement). The pressure of the operation fluid to be outputted is changed in accordance with an operation amount (the operation) of the forward movement. The operation valve 255B is constituted of a valve activated by the backward movement (the backward operation) of the first operation (the forward movement and the backward movement). The pressure of the operation fluid to be outputted is changed in accordance with an operation amount (the operation) of the backward movement.

That is, each of the operation valve 255A and the operation valve 255B is constituted of a valve that is configured to be operated in the first operation, and provides the movements corresponding to the traveling operation.

The operation valve 255C is constituted of a valve activated by the leftward movement (the leftward operation) of the second operation (the leftward movement and the rightward movement). The pressure of the operation fluid to be outputted is changed in accordance with an operation amount (the operation) of the leftward movement. The operation valve 255D is constituted of a valve activated by the rightward movement (the rightward operation) of the second operation (the leftward movement and the rightward movement). The pressure of the operation fluid to be outputted is changed in accordance with an operation amount (the operation) of the rightward movement.

That is, each of the operation valve 255C and the operation valve 255D is constituted of a valve that is configured to be operated in the second operation, and provides the movements corresponding to the working operation.

The second operation device 248 is constituted of a device configured to perform both of the traveling operation and the working operation, and includes a second operation member 258. The second operation member 258 is a lever configured to perform a first ration and a second operation, the first operation being moved to the forward direction and to the backward direction, the second operation being moved to the lateral direction (the machine width direction) different from the forward direction and the backward direction.

In other words, the second operation member 258 is constituted of a lever configured to be moved in one direction (for example, forward and leftward) and in the other direction (for example, backward and rightward) different from the one direction.

In the second operation member 258, the first operation is allocated to the traveling operation, and the second operation is allocated to the working operation. That is, the second operation member 258 serves as both of an operation member for traveling (a travel operation member) and an operation member for working (a work operation member).

Meanwhile, the second operation member 258 is not limited to the lever, and may be constituted of another member configured to at least perform the first operation and the second operation independently.

The plurality of operation valves 259 are disposed on an lower portion of the second operation member 258. The plurality of operation valves 259 include the operation valve 259A, the operation valve 259B, the operation valve 259C, and the operation valve 259D. The operation valve 259A, the operation valve 259B, the operation valve 259C, and the operation valve 259D are connected to the discharge fluid tube 240.

The operation valve 259A is constituted of a valve activated by the forward movement (the forward operation) of the first operation (the forward movement and the backward movement). The pressure of the operation fluid to be outputted is changed in accordance with an operation amount (the operation) of the forward movement. The operation valve 259B is constituted of a valve activated by the backward movement (the backward operation) of the first operation (the forward movement and the backward movement). The pressure of the operation fluid to be outputted is changed in accordance with an operation amount (the operation) of the backward movement.

That is, each of the operation valve 259A and the operation valve 259B is constituted of a valve that is configured to be operated in the first operation, and provides the movements corresponding to the traveling operation.

The operation valve 259C is constituted of a valve activated by the leftward movement (the leftward operation) of the second operation (the leftward movement and the rightward movement). The pressure of the operation fluid to be outputted is changed in accordance with an operation amount (the operation) of the leftward movement. The operation valve 259D is constituted of a valve activated by the rightward movement (the rightward operation) of the second operation (the leftward movement and the rightward movement). The pressure of the operation fluid to be outputted is changed in accordance with an operation amount (the operation) of the rightward movement.

That is, each of the operation valve 259C and the operation valve 259D is constituted of a valve that is configured to be operated in the second operation, and provides the movements corresponding to the working operation.

As described above, the operation valve 255A, the operation valve 255B, the operation valve 259A, and the operation valve 259B of the plurality of operations valves are operated corresponding to the traveling operation. The operation valve 255C, the operation valve 255D, the operation valve 259C, and the operation valve 259D are operated corresponding to the working operation.

For convenience of the explanations, each of the operation valve 255A, the operation valve 255B, the operation valve 259A, and the operation valve 259B may be referred to as a travel operation valve. Of the travel operation valves, the operation valve 255A is referred to as "a first operation valve", the operation valve 255A being configured to be activated by the movement to one direction (for example, forward) of the first operation member 254. The operation valve 255B is referred to as "a second operation valve", the operation valve 255B being configured to be activated by the movement to the other direction (for example, backward) of the first operation member 254. The operation valve 259A is referred to as "a third operation valve", the operation valve 259A being configured to be activated by the movement to one direction (for example, forward) of the second operation member 258. The operation valve 259B is referred to as "a fourth operation valve", the operation valve 259B being configured to be activated by the movement to the other direction (for example, backward) of the second operation member 258.

A relation between the travel operation valve, the work operation valve, and the hydraulic device will be explained below. Reference numerals "W10", "W20", "D10", and "D20" shown in FIG. 10 and FIG. 11 indicate connection targets of the fluid tubes.

The travel operation valve is connected to the travel pumps 253L and 253R by the travel fluid tube 245, the travel pumps 253L and 253R being one of the hydraulic devices for travel (the travel hydraulic devices). The travel fluid tube 245 includes a first travel fluid tube 245*a*, a second travel fluid tube 245*b*, a third travel fluid tube 245*c*, and a fourth travel fluid tube 245*d*.

The first travel fluid tube 245*a* is constituted of a fluid tube connecting the first operation valve 255A to the forward-movement pressure-receiving portion 253*a* of the travel pump 253L. The second travel fluid tube 245*b* is constituted of a fluid tube connecting the second operation valve 255B to the backward-movement pressure-receiving portion 253*b* of the travel pump 253L.

The third travel fluid tube 245*c* is constituted of a fluid tube connecting the third operation valve 259A to the forward-movement pressure-receiving portion 253*a* of the travel pump 253R. The fourth travel fluid tube 245*d* is constituted of a fluid tube connecting the fourth operation valve 259B to the backward-movement pressure-receiving portion 253*b* of the travel pump 253R.

When the second operation member 254 is titled forward, the first operation valve 255A is operated to output the pilot pressure from the first operation valve 255A. The pilot pressure is applied to the forward-movement pressure-receiving portion 253*a* of the travel pump 253L.

When the second operation member 258 is titled forward, the third operation valve 259A is operated to output the pilot pressure from the third operation valve 259A. The pilot pressure is applied to the forward-movement pressure-receiving portion 253*a* of the travel pump 253R.

When the first operation member 254 is titled backward, the second operation valve 255B is operated to output the pilot pressure from the second operation valve 255B. The pilot pressure is applied to the backward-movement pressure-receiving portion 253*b* of the travel pump 253L.

When the second operation member 258 is titled backward, the fourth operation valve 259B is operated to output the pilot pressure from the fourth operation valve 259B. The pilot pressure is applied to the backward-movement pressure-receiving portion 253*b* of the travel pump 253R.

In this manner, when the first operation member 254 and the second operation member 258 are tilted forward, the travel motor (the HST motor) 236 turns forward at a speed proportional to the tilting amounts (the swinging amounts) of the first operation member 254 and the second operation member 258. As the result, the work machine 1 travels forward and straight.

When the first operation member 254 and the second operation member 258 are tilted backward, the travel motor 236 turns backward at a speed proportional to the tilting amounts (the tilting extents) of the first operation member 254 and the second operation member 258. As the result, the work machine 1 travels backward and straight.

In addition, when one of the first operation member 254 and the second operation member 258 is tilted forward and the other is tilted backward, the travel motor 236 arranged to the left and the travel motor 236 arranged to the right turn in different directions from each other. As the result, the work machine 2 turns rightward or leftward.

As described above, the forward and backward movements of the first operation member 254 and the forward and backward movements of the second operation member 258 provide the traveling operations for making the work machine 1 travel forward, backward, rightward, and leftward.

In addition, the work operation valve is connected to the control valve 256 by the work fluid tube 246, the control valve 256 being one of the hydraulic devices for work (the operation hydraulic devices). The work fluid tube 246 includes a first work fluid tube 246*a*, a second work fluid tube 246*b*, a third work fluid tube 246*c*, and a fourth work fluid tube 246*d*.

The first work fluid tube 246*a* is constituted of a fluid tube connecting the operation valve 255C to a pressure-receiving portion of the first control valve 256A. The second work fluid tube 246*b* is constituted of a fluid tube connecting the operation valve 255D to the pressure-receiving portion of the first control valve 256A.

The third work fluid tube 246*c* is constituted of a fluid tube connecting the operation valve 259C to a pressure-receiving portion of the second control valve 256B. The fourth work fluid tube 246*d* is constituted of a fluid tube connecting the operation valve 259D to the pressure-receiving portion of the second control valve 256B.

When the first operation member 254 is tilted leftward, the operation valve 255C is operated to set the pilot pressure of the pilot fluid, the pilot fluid being outputted from the operation valve 255C. The pilot pressure is applied to the pressure-receiving portion of the first control valve 256A, and thereby the boom cylinder 14 is stretched to move the boom 10 upward.

When the first operation member 254 is tilted rightward, the operation valve 255D is operated to set the pilot pressure of the pilot fluid, the pilot fluid being outputted from the operation valve 255D. The pilot pressure is applied to the pressure-receiving portion of the first control valve 256A, and thereby the boom cylinder 14 is shortened to move the boom 10 downward.

When the second operation member 258 is tilted leftward, the operation valve 259C is operated to set the pilot pressure of the pilot fluid, the pilot fluid being outputted from the operation valve 259C. The pilot pressure is applied to the pressure-receiving portion of the second control valve 256B, and thereby the bucket cylinder 15 is shortened to make the bucket 11 perform the shoveling movement.

When the second operation member 258 is tilted rightward, the operation valve 259D is operated to set the pilot pressure of the pilot fluid, the pilot fluid being outputted from the operation valve 259D. The pilot pressure is applied to the pressure-receiving portion of the second control valve 256B, and thereby the bucket cylinder 15 is stretched to make the bucket 11 perform the dumping movement.

As described above, the rightward and leftward movements of the first operation member 254 and the rightward and leftward movements of the second operation member 258 provide the upward and downward movements of the boom 10 and the working operations such as the dumping movement and the shoveling movement of the bucket.

Meanwhile, the hydraulic system is provided with a circuit capable of reducing a pressure (depressurizing) the operation fluid of the travel fluid tube 245.

Figure 11:
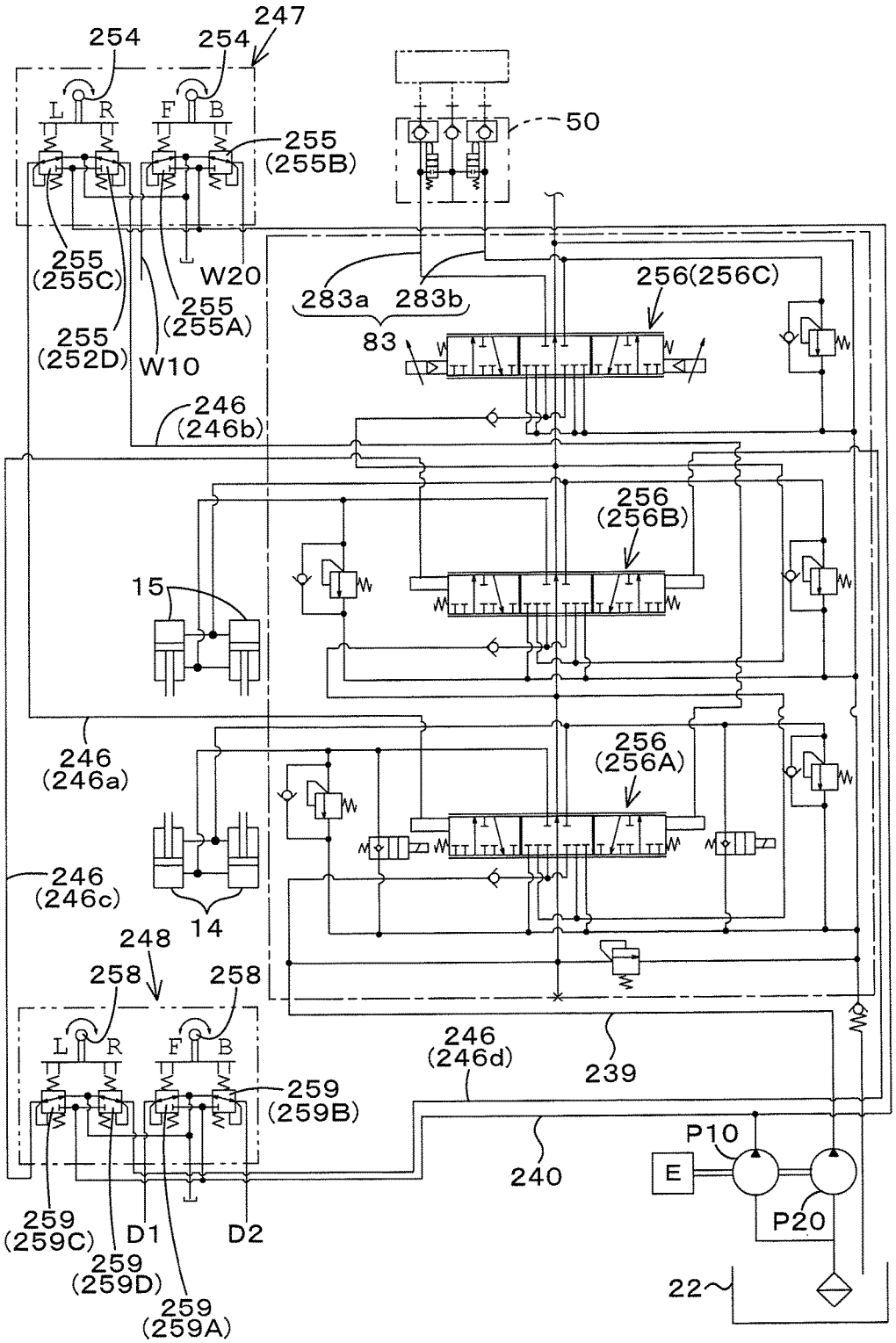
FIG. 11 is a schematic view illustrating a hydraulic system for work (a hydraulic circuit) according to the fifth embodiment.

As shown in FIG. 11, a discharge fluid tube 251 for discharging the operation fluid is connected to a travel fluid tube (a travel fluid path) 245 that connects the travel operation valve to the travel pumps 253L and 253R, one of the hydraulic devices.

An actuation valve 270A is disposed on the discharge fluid tube 251. The actuation valve 270 is constituted of a valve configured to reduce a pressure of the operation fluid in the discharge fluid tube 251, that is, a valve configured to reduce a pressure of the operation fluid in the travel fluid tube 245 that is connected to the discharge fluid tube 251.

In other words, the actuation valve 270A is constituted of a valve configured to reduce a pressure (a secondary pressure) of the operation fluid set by at least one of the plurality of operation valves 255.

The discharge fluid tube 251 and the actuation valve 270A will be explained below in detail.

The discharge fluid tube 251 is a fluid tube connected to the travel operation valve, that is, at least one of the first operation valve 255A, the second operation valve 255B, the third operation valve 259A, and the fourth operation valve 259B.

In particular, the discharge fluid tube 251 includes a first discharge fluid tube 251*a*, a second discharge fluid tube 251*b*, a third discharge fluid tube 251*c*, a fourth discharge fluid tube 251*d*, and a fifth discharge fluid tube 251*e*.

The first discharge fluid tube 251*a* is a fluid tube branching from an intermediate portion of the first travel fluid tube 245*a*. The second discharge fluid tube 251*b* is a fluid tube branching from an intermediate portion of the second travel fluid tube 245*b*.

The third discharge fluid tube 251*c* is a fluid tube branching from an intermediate portion of the third travel fluid tube 245*c*. The fourth discharge fluid tube 251*d* is a fluid tube branching from an intermediate portion of the fourth travel fluid tube 245*d*.

The fifth discharge fluid tube 251*e* is a fluid tube connecting the first discharge fluid tube 251*a*, the second discharge fluid tube 251*b*, the third discharge fluid tube 251*c*, and the fourth discharge fluid tube 251*d*. An actuation valve 270A is disposed on an intermediate portion of the fifth discharge fluid tube 251*c*.

A check valve 271 is disposed on each of the first discharge fluid tube 251*a*, the second discharge fluid tube 251*b*, the third discharge fluid tube 251*c*, and the fourth discharge fluid tube 251*d*. The check valve 271 is configured to allow the operation fluid to flow from the travel fluid tube 245 toward the fifth discharge fluid tube 251*e* (the actuation valve 270A) and blocks the flowing of the operation fluid flowing from the discharge side toward the fifth discharge fluid tube 251*e* (the actuation valve 270A).

The actuation valve 270A includes a relief valve 278 configured to change the set pressure of the actuation valve 270A. For example, the relief valve 278 is constituted of a balanced relief valve configured to vary the set pressure on the basis of a pressure of the operation fluid, and includes a pressure-receiving portion 78*a* configured to receive a pressure of the operation fluid. In addition, the relief valve 278 may be constituted of a variable relief valve.

When a pressure of the operation fluid is applied to the pressure-receiving portion 78*a*, the set pressure is varied in accordance with a pressure of the operation fluid applied to the pressure-receiving portion 78*a*. For example, the set pressure is increased in accordance with increment of the pressure of the operation fluid applied to the pressure-receiving portion 78*a*, and the set pressure is decreased in accordance with decrement of the pressure of the operation fluid applied to the pressure-receiving portion 78*a*.

In addition, the actuation valve 270A includes a proportional valve 273. The proportional valve 273 is connected to the pressure-receiving portion 78*a* of the relief valve 278 by the fluid tube 72. The output fluid tube 240 is connected to the proportional valve 273, and the operation fluid can be supplied from the first hydraulic pump P10 to the proportional valve 273. The proportional valve 273 is constituted of an electromagnetic proportional valve configured to magnetize the solenoid of the proportional valve 273 to change the aperture of the proportional valve 273. The proportional valve 273 is controlled by the control device 290.

For example, the control device 290 outputs a control signal to magnetize the solenoid of the proportional valve 273 in accordance with a degree of the suppression in a case of suppressing a traveling speed of the work machine even when the traveling operation is performed. In this manner, the aperture of the proportional valve 273 is increased and decreased on the basis of the control signal from the control device 290.

When the pressure of the operation fluid applied to the pressure-receiving portion 78*a* of the relief valve 278, the set pressure of the relief valve 278 is reduced, and the operation fluid in the travel fluid tube 245 is discharged (drained) to the operation fluid tank and the like through the discharge fluid tube 251. In this manner, a revolution speed of the travel motor 236 is reduced, and thereby a traveling speed of the work machine is suppressed.

For example, in a case of forbidding the traveling of the work machine, the control device 290 outputs a control signal to minimize the aperture of the proportional valve 273. In this manner, the aperture of the proportional valve 273 is minimized, the pressure of the operation fluid applied to the pressure-receiving portion 278*a* of the relief valve 278 is minimized, and thereby the set pressure of the relief valve 278 is minimized.

When the set pressure of thee relief valve 278 is minimized, almost of all the operation fluid in the travel fluid tube 245 is discharged (drained) to the operation fluid tank and the like through the discharge fluid tube 251, and thereby the revolution speed of the travel motor 236 falls to zero. In this manner, the traveling of the work machine can be forbidden, that is, the traveling can be stopped.

Thus, when the pressure on the secondary side of the travel operation valve is fallen to zero by the proportional valve 273, the work device 4 can be operated with the work machine 1 stopped.

In the embodiment described above, the relief valve 278 is constituted of a valve that has the pressure-receiving portion 278*a* configured to receive a pressure of the operation fluid and is configured to reduce the set pressure with use of the pressure of the operation fluid applied to the pressure-receiving portion 278*a*. However, the relief valve 278 may be constituted of an electromagnetic proportional relief valve instead of that valve.

In that case, the control device 290 directly changes the set pressure of the relief valve 278 without the proportional valve 273 mentioned above by outputting a control signal to the relief valve 278.

Meanwhile, the travel fluid tube (fluid path) 245 may be provided with a check valve and a throttle portion. In particular, a check valve 274 is disposed on each of the first travel fluid tube 245*a*, the second travel fluid tube 245*b*, the third travel fluid tube 245*d*, and the fourth travel fluid tube 245*e*.

The check valve 274 allows the operation fluid to flow from the operation valve side (for example, the first operation valve 255A) to the side of the relief valve 278 and blocks the flowing of the operation fluid flowing from the side of the relief valve 278 to the operation valve side.

A bypass fluid tube (a bypass fluid path) 275 is disposed on an inlet side and an outlet side of the check valve 274, and a throttle portion 276 is disposed on the bypass fluid tube 275. In addition, a throttle portion 277 is disposed on a section of the travel fluid tube 245 between the check valve 274 and a connecting portion connected to the discharge fluid tube 251.

Figure 12A:
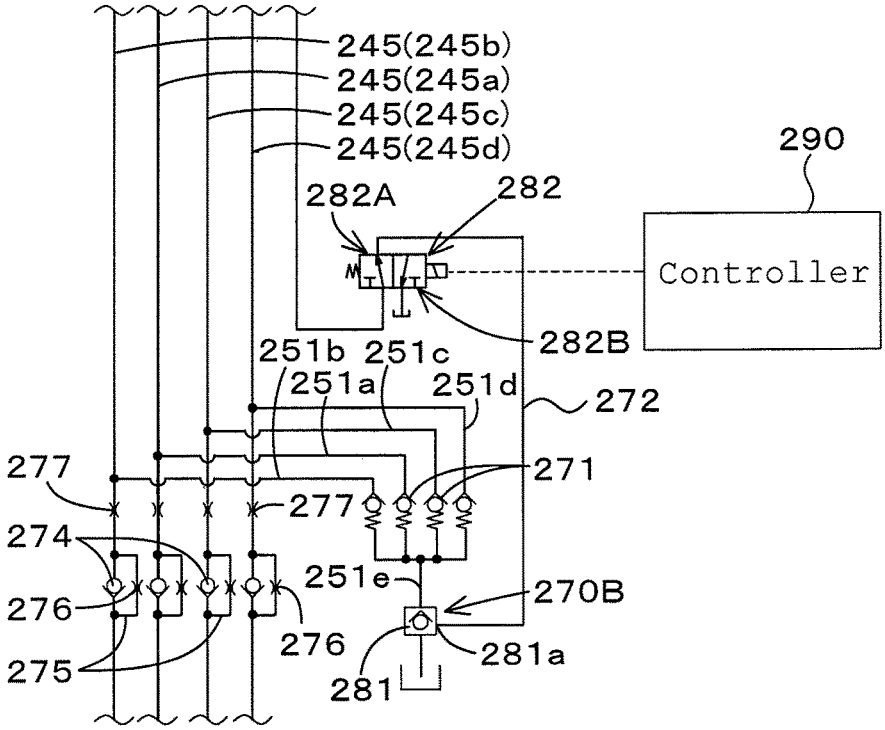
FIG. 12A is a view illustrating a first modified example of the hydraulic system according to the fifth embodiment.
Figure 12B:
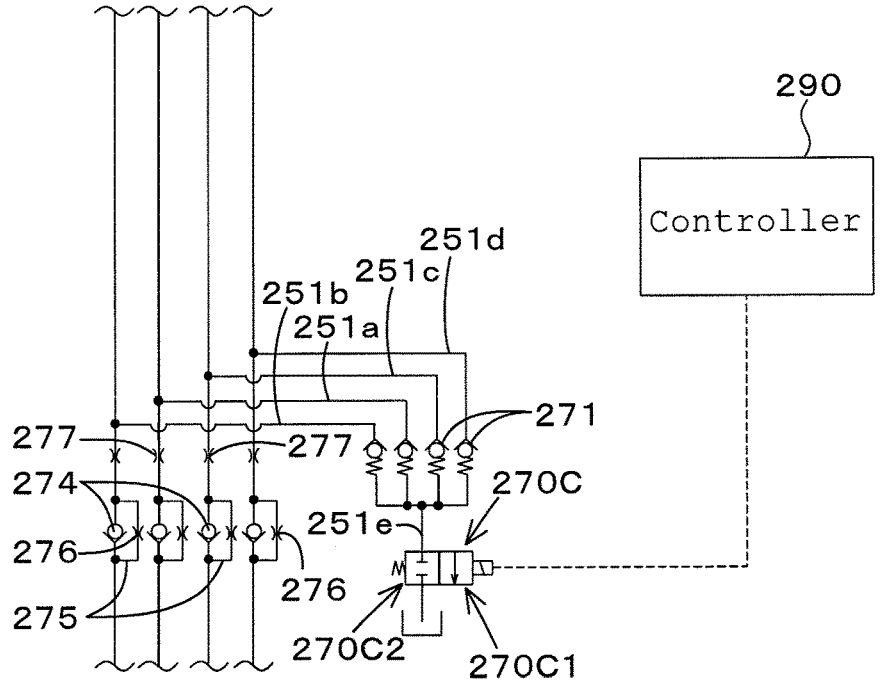
FIG. 12B is a view illustrating a second modified example of the hydraulic system according to the fifth embodiment.

FIG. 12A is a view illustrating a first modified example of the hydraulic system. FIG. 12B is a view illustrating a second modified example of the hydraulic system. The modified examples will be explained below.

As shown in FIG. 12A, an actuation valve 270B includes a pilot check valve 181 and a switch valve 282. The pilot check valve 181 is configured to block the discharging of the operation fluid in the discharge fluid tube 251 on the basis of the pressure of the operation fluid applied to the pressure-receiving portion 281*a*. The switch valve 282 is connected to the pilot check valve 181 by the fluid tube 272.

The switch valve 282 is a switch valve configured to be switched to a first position 282A and to a second position 282B, and is constituted of a two-position switch valve configured to magnetize the solenoid to be switched to the positions, for example. The switch valve 282 is switched to the first position 282A or to the second position 282B in accordance with the control signal of the control device 290.

When the pressure of the operation fluid applied to the pressure-receiving portion 281*a* of the pilot check valve 181 is equal to or more than a predetermined value after the switch valve 282 is switched to the first position 282A, the pilot check valve 181 is closed to block the discharging of the operation fluid in the discharge fluid tube 251.

Thus, when the pilot check valve 181 blocks the discharging of the operation fluid of the discharge fluid tube 251, the pressure of the operation fluid in the travel fluid tube 245 is increased and decreased in accordance with the traveling operation. In this manner, the first operation device 247 and the second operation device 248 are capable of changing the revolution speed of the travel motor 236.

On the other hand, when the pressure of the operation fluid applied to the pressure-receiving portion 281*a* of the pilot check valve 181 is equal to or more than a predetermined value after the switch valve 282 is switched to the second position 282B in accordance with the control signal of the control device 290, the pilot check valve 181 is opened to allows the operation fluid in the discharge fluid tube 251 to be discharged (drained).

Thus, when the pilot check valve 181 allows the operation fluid in the discharge fluid tube 251 to be discharged (drained), the operation fluid in the travel fluid tube 245 is discharged (drained) from the discharge fluid tube 251 to the operation fluid tank 22 and the like.

As the result, both of the first operation device 247 and the second operation device 248 are capable of reducing the revolution speed of the travel motor 236, thereby suppressing the traveling speed of the work machine and forbidding the traveling of the wok machine.

Meanwhile, the pilot check valve 181 is closed when the pressure of the operation fluid applied to the pressure-receiving portion 281*a* is equal to or more than a predetermined value and is opened when the pressure of the fluid tube is less than the predetermined value. However, instead of that configurations, the pilot check valve may be opened when the pressure of the operation fluid applied to the pressure-receiving portion 281*a* is equal to or more than a predetermined value and is closed when the pressure of the fluid tube is less than the predetermined value.

In that case, the switch valve 282 is switched to the first position 282A in the case of suppressing the traveling speed of the work machine or forbidding the traveling of the work machine.

As shown in FIG. 12B, the actuation valve 270C is constituted of a switch valve configured to be switched to a first position 270C1 and to a second position 270C2, the first position 270C1 being provided for allowing the operation fluid in the discharge fluid tube 251 to be discharged (drained), the second position 270C2 being provided for blocking the discharging of the operation fluid in the discharge fluid tube 251. For example, the actuation valve 270C is constituted of a two-position switch valve configured to magnetize the solenoid to be switched.

The switch valve 270C is connected to the control device 290, and is switched to the first position 270C1 or the second position 270C2 in accordance with the control signal. In the case of suppressing the traveling speed of the work machine or forbidding the traveling of the work machine, the control device 290 switches the switch valve 270C to the first position 270C1. In the case of allowing the traveling of the work machine in accordance with the traveling operation, the control device 290 switches the switch valve 270C to the second position 270C2.

In the embodiment mentioned above, all of the first travel fluid tube 245*a*, the second travel fluid tube 245*b*, the third travel fluid tube 245*c*, and the fourth travel fluid tube 245*d* are connected to the discharge fluid tube 251. However, the discharge fluid tube 251 may be disposed on any one of the first travel fluid tube 245*a*, the second travel fluid tube 245*b*, the third travel fluid tube 245*c*, and the fourth travel fluid tube 245*d*, and any one of the actuation valve 270A, the actuation valve 70B, and the actuation valve 70C.

In other words, any one of the actuation valve 270A, the actuation valve 70B, and the actuation valve 70C may be disposed on the discharge fluid tube 251 connected to at least one of the first operation valve 255A, the second operation valve 255B, the third operation valve 259A, and the fourth operation valve 259B.

In this manner, the movements of the hydraulic devices for travel can be suppressed or forbidden under the various conditions. For example, the traveling of the work machine such as the forward traveling, the backward traveling, the rightward turning, and the leftward turning can be suppressed (restricted).

In addition, the discharge fluid tube 251 may be disposed on the work fluid tube 246, and any one of the actuation valves 270A, 270B, and 270C may be disposed on the discharge fluid tube 251.

In other words, the operation valve 255C serves as the first operation valve, the operation valve 255D serves as the second operation valve, the operation valve 259C serves as the third operation valve, the operation valve 259D serves as the fourth operation valve. And furthermore, any one of the actuation valves 270A, 270B, and 270C may be disposed on the discharge fluid tube 251 connected to at least one of the first operation valve 255C, the second operation valve 255D, the third operation valve 259C, and the fourth operation valve 259D.

In this manner, the movements of the hydraulic devices for work can be suppressed or forbidden under the various conditions.

The discharge fluid tube 251 may be disposed on both of the travel fluid tube 245 and the work fluid tube 246, and further any one of the actuation valves 270A, 270B, and 270C may be disposed on the discharge fluid tube 251.

The check valve 274, the bypass fluid tune 275, the throttle portions 276 and 277 may be employed in the case where the discharge fluid tube 251 is disposed on the fluid tubes (the travel fluid tube 245 and the work fluid tube 246).

In addition, the actuation valve is constituted of a valve configured to perform the control relating to the discharging of the operation fluid in the discharge fluid tube 251, and is not limited to the actuation valves 270A, 270B, and 270C mentioned above.

The check valve for setting the differential pressure may be disposed on the fluid tube on the downstream side connected to the discharge fluid tube 251 or to the pressure-receiving portion 70*a*.

Rates of springs of the check valves 71 may be different in each of the first discharge fluid tube 251*a*, the second discharge fluid tube 251*b*, the third discharge fluid tube 251*c*, the fourth discharge fluid tube 251*d*, and the fifth discharge fluid tube 251*e*.

A hydraulic system for a work machine includes a hydraulic pump configured to output an operation fluid, a hydraulic device configured to be operated by the operation fluid, an operation member configured to operate the hydraulic device, a plurality of operation valves configured to change a pressure of the operation fluid in accordance with the operation of the operation member, a discharge fluid tube connected to at least one of the plurality of operation valves, the discharge fluid tube being configured to discharge (drain) the operation fluid, and an operation valve disposed on the discharge fluid tube, the operation valve being configured to reduce the pressure of the operation fluid in the discharge fluid tube.

A hydraulic system for a work machine includes a hydraulic pump configured to output an operation fluid, a hydraulic device configured to be operated by the operation fluid, a first operation device configured to operate the hydraulic device, including a first operation member configured to be operated (moved) to one direction and to the other direction, a first operation valve configured to change a pressure of the operation fluid in accordance with the movement of the first operation member to the one direction, and a second operation valve configured to change the pressure of the operation fluid in accordance with the movement of the first operation member to the other direction, a second operation device configured to operate the hydraulic device, including a second operation member configured to be operated (moved) to one direction and to the other direction, a third operation valve configured to change a pressure of the operation fluid in accordance with the movement of the second operation member to the one direction, and a fourth operation valve configured to change the pressure of the operation fluid in accordance with the movement of the second operation member to the other direction, a discharge fluid tube connected to at least one of the first operation valve, the second operation valve, the third operation valve, and the fourth operation valve, the discharge fluid tube being configured to discharge (drain) the operation fluid, and an operation valve disposed on the discharge fluid tube, the operation valve being configured to reduce the pressure of the operation fluid in the discharge fluid tube.

The operation valve includes a relief valve configured to change the set pressure.

The operation valve includes a proportional valve connected to a pressure-receiving portion of the relief valve, the proportional valve being configured to change a pressure of the operation fluid applied to the pressure-receiving portion.

The hydraulic system mentioned above includes a fluid tube connecting the plurality of operation valves to the hydraulic device and being connected to the discharge fluid tube, and a check valve disposed on the discharge fluid tube, the check valve being configured to allow the operation fluid to flow from the fluid tube toward the operation valve and blocks the flowing of the operation fluid from a discharge side toward the fluid tube.

The hydraulic system mentioned above includes a fluid tube connecting the hydraulic device to the first operation valve, to the second operation valve, to the third operation valve, and to the fourth operation valve and being connected to the discharge fluid tube, and a check valve disposed on the discharge fluid tube, the check valve being configured to allow the operation fluid to flow from the fluid tube toward the operation valve and blocks the flowing of the operation fluid from a discharge side toward the fluid tube.

The operation valve includes a pilot check valve configured to block the discharging of the operation fluid in the discharge fluid tube on the basis of the pressure of the operation fluid applied to the pressure-receiving portion.

The operation valve includes a switch valve configured to be switched between a first position and a second position, the first position being to allow the discharging of the operation fluid in the discharge fluid tube, the second position being to block the discharging of the operation fluid in the discharge fluid tube.

The hydraulic device is a travel pump configured to change an output on the basis of the pressure of the operation fluid.

The hydraulic system according to the embodiment is capable of easily reducing (lowering) the pressure in the fluid tube connected to the hydraulic system and the like.

Sixth Embodiment

Figure 13:
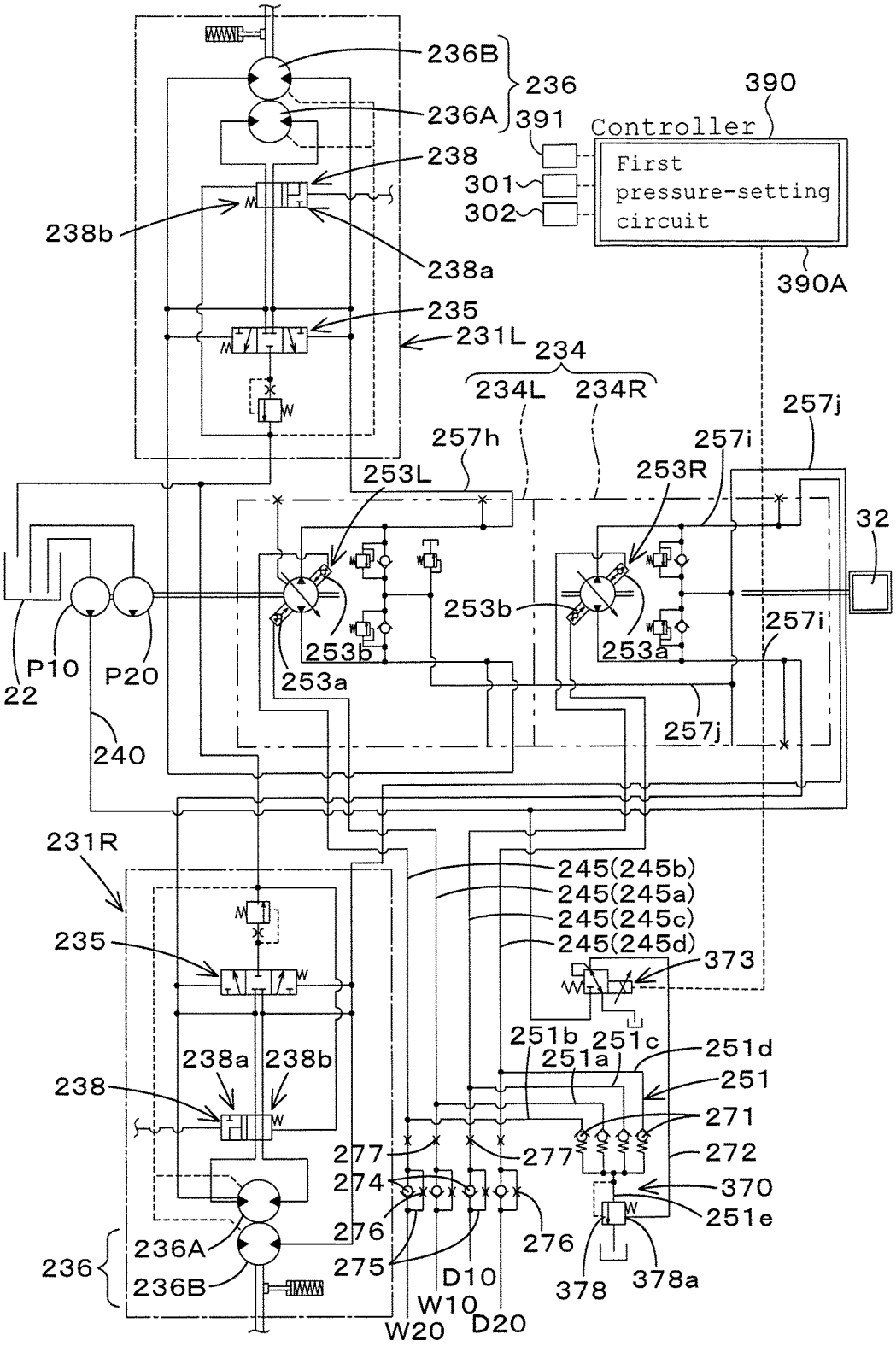
FIG. 13 is a schematic view illustrating a hydraulic system for travel (a hydraulic circuit) according to a sixth embodiment of the present invention.
Figure 14:
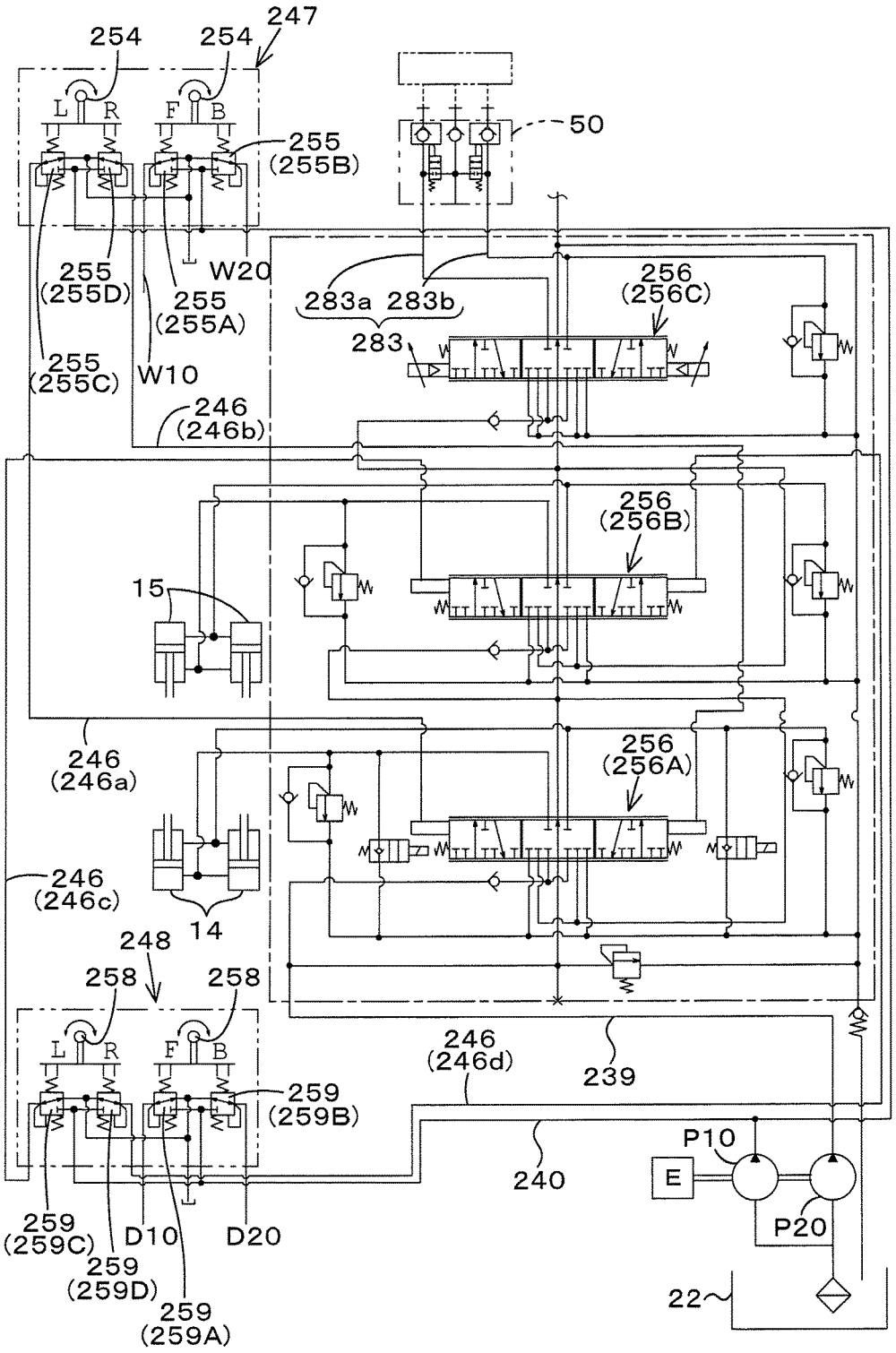
FIG. 14 is a schematic view illustrating a hydraulic system for work (a hydraulic circuit) according to the sixth embodiment.

FIG. 13 illustrates a hydraulic system for travel serving as a hydraulic system for the work machine according to a sixth embodiment of the present invention. The work machine according to the present embodiment has the configurations similar to the configurations of the work machine described in the above-mentioned embodiments. Thus, the explanation of the configurations of the work machine will be omitted. A hydraulic system for travel illustrated in FIG. 13 is similar to the hydraulic system for travel according to the fifth embodiment. Thus, the explanation of the same configurations will be omitted.

Each of a travel pump 253L and a travel pump 253R is constituted of a variable displacement axial pumps having a swash plate (a variable displacement pump) that is configured to be driven by a motive power of the prime mover 32. For convenience of the explanation, the travel pump 253L may be referred to as a first variable displacement pump, and the travel pump 253R may be referred to as a second variable displacement pump.

Each of the travel pump (the first variable displacement pump) 253L and the travel pump (the second variable displacement pump) 253R includes the forward-movement pressure-receiving portion 53*a* and the backward-movement pressure-receiving portion 53*b*. The pilot pressure is applied to a forward-movement pressure-receiving portion 253*a* and a backward-movement pressure-receiving portion 253*b*.

An angle of the swash plate is changed by the pilot pressure applied to a forward-movement pressure-receiving portion 253*a* and the backward-movement pressure-receiving portion 253*b*. When the angle of the swash plate is changed, the changing changes the outputs (output amounts of the operation fluid, that is, a displacement) of the travel pump (the first variable displacement pump) 253L and the travel pump (the second variable displacement pump) 253R and changes the directions of the outputs of the operation fluid.

Thus, the first operation device 247 and the second operation device 248 are operation devices configured to change at least the displacement of the travel pump (the first variable displacement pump) 253L and the displacement of the travel pump (the second variable displacement pump) 253R.

An operation valve 370 includes a relief valve 378 and a proportional valve 373. The relief valve 378 is configured to change a set pressure of the relief valve 378. The proportional valve 373 is connected to the relief valve 378 by a fluid tube (a fluid path) 272. For example, the relief valve 378 is a balanced relief valve configured to vary a set pressure of the relief valve 378 on the basis of the pressure of the operation fluid. The relief valve 378 has a pressure-receiving portion 378*a* configured to receiving the pressure of the operation fluid.

The fluid tube 272 is connected to the pressure-receiving portion 378*a* of the relief valve 378. The proportional valve 373 is connected to the fluid tube 272. An output fluid tube (an output fluid path) 40 is connected to the proportional valve 373, and thus the operation fluid from a first hydraulic pump P100 can be supplied to the proportional valve 373.

The proportional valve 373 is an electromagnetic proportional valve configured to magnetize a solenoid to change an aperture of the electromagnetic proportional valve, and is controlled by the control device (the controller) 390. For example, the control device 390 outputs a control signal to the proportional valve 373, and thereby increases and decreases the aperture of the proportional valve 373.

When the aperture of the proportional valve 373 is increased and decreased, the pressure of the operation fluid also changes in accordance with the increasing and decreasing of the aperture, the pressure being applied to the pressure-receiving portion 378*a* of the relief valve 378. In this manner, the set pressure of the relief valve 378 is changed.

For example, when the set pressure of the relief valve 378 is low, the operation fluid of the travel fluid tube 245 is discharged (drained) through the discharge fluid tube 251. In this manner, the pressure of the operation fluid applied to the travel fluid tube 245 is reduced.

As described above, the pressure of the operation fluid is reduced in the travel fluid tube 245, and thereby the pressures of the operation fluid applied to the forward-movement pressure-receiving portion 253*a* and to the backward-movement pressure-receiving portion 253*b* are reduced in the travel pump 253L and the travel pump 253R.

That is, the control device 390 and the operation valves 370 (the relief valve 378 and the proportional valve 373) are capable of changing the displacements of the travel pump 253L and the travel pump 253R independently from the operations of the operation devices (the first operation device 247 and the second operation device 248).

A control to the operation valves 370 performed by the control device 390 will be explained below.

A revolution speed detection device (a detection device) 301 and a temperature detection device (a detection device) 302 are connected to the control device 390. The revolution speed detection device 301 is a device configured to detect a revolution speed of the prime mover. The revolution speed detection device 301 detects an engine revolution speed in a case where the prime mover is an engine, and detects a motor revolution speed in a case where the prime mover is an electric motor. The temperature detection device 302 measures a temperature of the operation fluid (referred to as a fluid temperature).

The control device 390 controls a revolution speed of the prime mover, and controls a set value of the relief valve 378, that is, the pressure in the travel fluid tube 245 in accordance with the fluid temperature detected by the temperature detection device 302. The revolution speed of the prime mover is detected by the revolution speed detection device 301.

For convenience of the explanation, the revolution speed of the prime mover is the engine revolution speed. In addition, the pressure in the travel fluid tube 245 is referred to as "a temperature-restricting pressure", the pressure being controlled on the basis of the engine revolution speed and the fluid temperature.

The control device 390 includes a first pressure-setting circuit (a first pressure-setting portion) 390A. The first pressure-setting circuit 390A is configured to set the temperature-restricting pressure. The first pressure-setting circuit 390A is constituted of a computer program stored in the control device 390, an electric circuit, an electronic circuit, or the like.

The first pressure-setting circuit 390A sets the set pressure (the temperature-restricting pressure) of the relief valve 378 on the basis of the engine revolution speed and the fluid temperature. In the embodiment, the first pressure-setting circuit 390A sets the set pressure (the temperature-restricting pressure) of the relief valve 378 on the basis of a plurality of threshold values related to the operation fluid (a plurality of threshold values related to the fluid temperature) and the engine revolution speed set in accordance with the plurality of threshold values.

The first pressure-setting circuit 390A may set the temperature-restricting pressure of the relief valve 378 on the basis of the engine revolution speed and one of the fluid temperatures.

Figure 15:
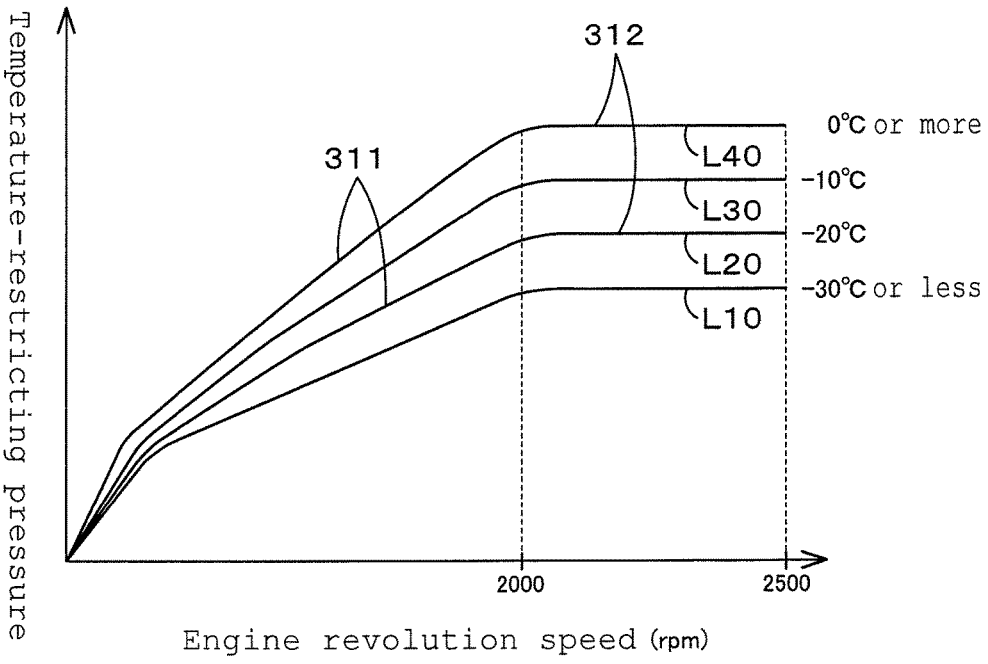
FIG. 15 is a view illustrating a relation between an engine revolution speed, an oil temperature, and a set pressure of a relief valve (a temperature-restricting pressure) according to the sixth embodiment.

FIG. 15 is a view illustrating a relation between the engine revolution speed, the fluid temperature, and the set pressure of the relief valve 378 (the temperature-restricting pressure).

The control device 390 stores a first control information (a first control map) showing a relation between the engine revolution speed and the temperature-restricting pressure for each of the plurality of the fluid temperatures, for example.

For example, the control device 390 stores a first control line L1, a second control line L2, a third control line L3, and a fourth control line L4. The first control line L1 shows a relation between the engine revolution speed and the temperature-restricting pressure under a condition where the fluid temperature is −30° C. (degrees) or less. The second control line L2 shows a relation between the engine revolution speed and the temperature-restricting pressure under a condition where the fluid temperature is −20° C. (degrees). The third control line L3 shows a relation between the engine revolution speed and the temperature-restricting pressure under a condition where the fluid temperature is −10° C. (degrees). The fourth control line L4 shows a relation between the engine revolution speed and the temperature-restricting pressure under a condition where the fluid temperature is 0° C. (degrees) or more.

In other words, the control device 390 has a plurality of control lines (the first control line L10, the second control line L20, the third control line L30, and the fourth control line L40) representing a plurality of threshold values of the fluid temperature (−30° C., −20° C., −10° C., and 0° C.).

Meanwhile, the control device 390 may store a function (a control function) serving as the first control information, the function being used for calculating the plurality of control lines (the first control line L10, the second control line L20, the third control line L30, and the fourth control line L40). And, the control device 390 may store some data serving as the first control information, the data representing the plurality of control lines (the first control line L10, the second control line L20, the third control line L30, and the fourth control line L40). Moreover, the control device 390 may store a parameter serving as the first control information, the parameter being used for obtaining the plurality of control lines (the first control line L10, the second control line L20, the third control line L30, and the fourth control line L40). Thus, the first control information is not limited to a specific type of information.

In addition, the fluid temperature, the engine revolution speed, and the temperature-restricting pressure are not limited to the values (the threshold values) shown in FIG. 15.

In each of the first control line 10L, the second control line L20, the third control line L30, and the fourth control line L40, the temperature-restricting pressure reduces in accordance with reduction of the engine revolution speed from the maximum value (2500 rpm).

In each of the first control line 10L, the second control line L20, the third control line L30, and the fourth control line L40, the temperature-restricting pressure is constant in a case where the engine revolution speed is at a predetermined revolution speed (2000 rpm) or more.

In each of the first control line 10L, the second control line L20, the third control line L30, and the fourth control line L40, the temperature-restricting pressure increases in accordance with increment of the fluid temperature at the identical engine revolution speed.

In addition, each of the plurality of the control lines includes a reducing section 311 and a constant section 312. The reducing section 311 reduces the temperature-restricting pressure in accordance with the reduction of the engine revolution speed. The constant section 312 keep the temperature-restricting pressure constant regardless of the reduction of the engine revolution speed.

The first pressure-setting circuit 390A monitors the engine revolution speed detected by the revolution speed detection device 301 (referred to as a detected revolution speed) and monitors the fluid temperature (a detected fluid temperature) detected by the temperature detection device 302.

The first pressure-setting circuit 390A obtains the temperature-restricting pressure on the basis of the detected revolution speed, the detected fluid temperature, and the first control information. That is, the first pressure-setting circuit 390A obtains the temperature-restricting pressure on the basis of the plurality of fluid temperatures and the engine revolution speeds, the engine revolution speeds being set based on the plurality of fluid temperatures.

The control device 390 outputs a control signal to the proportional valve 373, and thereby sets the temperature-restricting pressure obtained by the first pressure-setting circuit 390A. The control device 390 sets the aperture of the proportional valve 373, and thereby changes the set pressure of the relief valve 378 on the basis of the engine revolution speed and the fluid temperature.

According to the hydraulic system described above, the first pressure-setting circuit 390A increases the temperature-restricting pressure of the relief valve 378 in a case where the fluid temperature is 0° C. or more and a viscosity of the operation fluid is low, for example.

Thus, in a case where the viscosity of the operation fluid is low, the displacements of the first variable displacement pump 253L and the second variable displacement pump 253R are varied in accordance with the operation devices (the first operation device 247 and the second operation device 248, and thereby a traveling speed of the work machine 1 is changed.

Meanwhile, in a case where the fluid temperature is −30° C. or less and the viscosity of the operation fluid is high, the first pressure-setting circuit 390A reduces the temperature-restricting pressure. In that case, the displacements of the first variable displacement pump 253L and the second variable displacement pump 253R are reduced, and thereby the operation fluid is warmed up with the traveling speed of the work machine 1 reduced.

In addition, the temperature-restricting pressure is reduced depending on each of the fluid temperatures in a case where the engine revolution speed is reduced. That is, in the case where an output power of the engine is reduced, the displacements of the first variable displacement pump 253L and the second variable displacement 253R are reduced, and thereby the work machine 1 is capable of continuing works.

Figure 16:
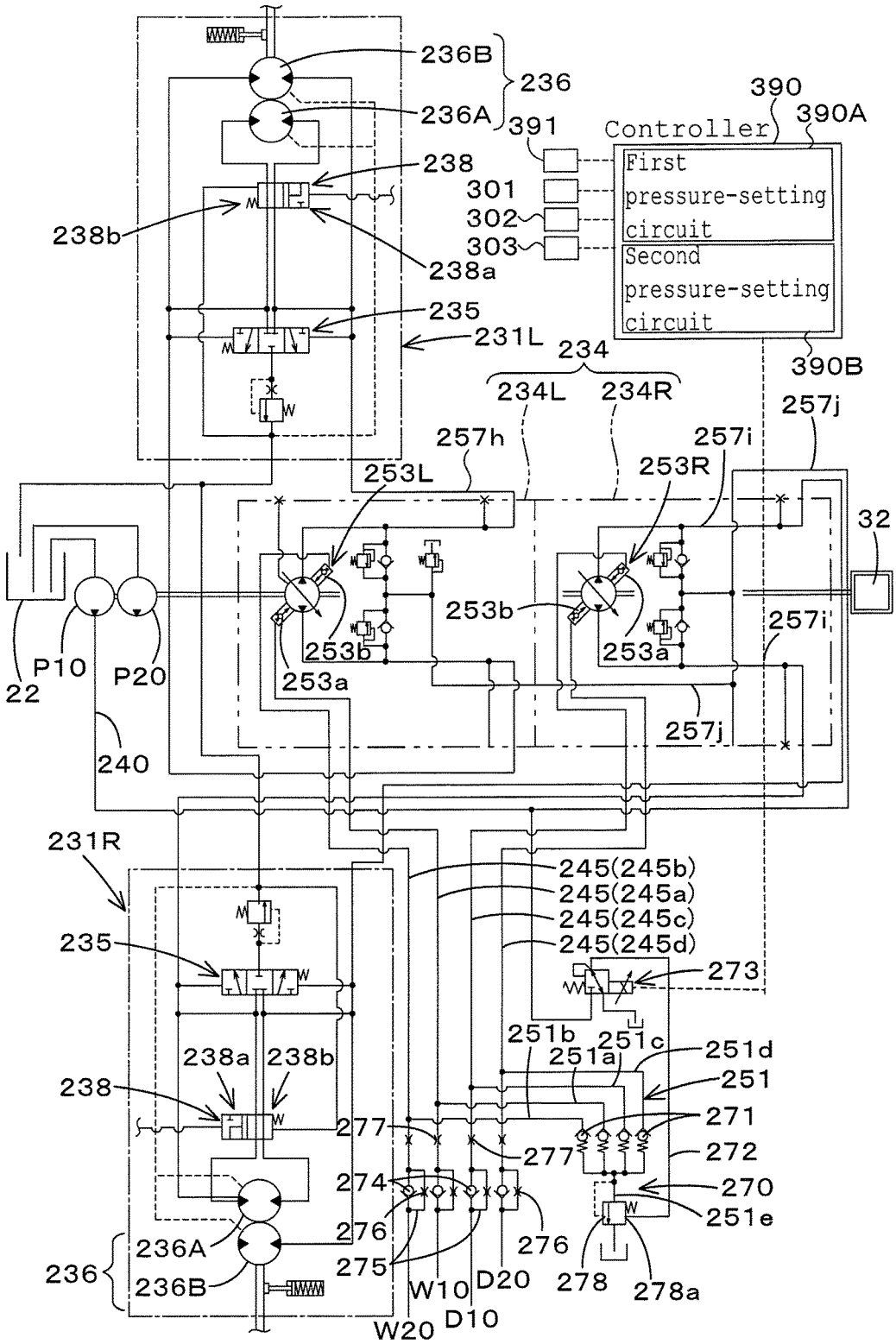
FIG. 16 is a schematic view illustrating a first modified example of the hydraulic system for travel according to the sixth embodiment.

Meanwhile, the work machine 1 may restrict the traveling speed of the work machine 1. FIG. 16 is a view illustrating a hydraulic system (a hydraulic circuit) capable of restricting the traveling speed. That is, FIG. 16 is a view illustrating a first modified example of the hydraulic system described above.

In the restriction of the traveling speed, the control device 390, the operation valve 370, or the like fixes an upper value of the set pressure of the operation valve to a predetermined value, and sets upper limitation values of the first variable displacement pump 253L and the second variable displacement pump 253R. In this manner, even when the operation device is operated, the traveling speed is restricted such that the traveling speed does not exceeds a predetermined traveling speed. For convenience of the explanation, the restriction of the traveling speed will be referred to as a vehicle speed restriction.

For example, a restriction switch 303 is connected to the control device 390, the restriction switch 390 being configured to select whether to perform the vehicle speed restriction or not. The restriction switch 303 may be a manual switch capable of being operated by an operator and may be an automatic switch such as a sensor capable of being switched automatically.

When the restriction switch 303 is turned on, the control device 390 executes a process of the vehicle speed restriction. When the restriction switch 303 is turned off, the control device 390 does not execute the process of the vehicle speed restriction.

As shown in FIG. 16, the control device 390 includes a second pressure-setting circuit (a second pressure-setting portion) 390B. The second pressure-setting circuit 390B is constituted of a computer program stored in the control device 390, an electric circuit, an electronic circuit, or the like, which are stored in the control device 390.

The second pressure-setting circuit 390B sets the set pressure of the relief valve 378 in the vehicle speed restriction. For convenience of the explanation, the pressure of in the travel fluid tube 245 is referred to as "a travel-restricting pressure", the pressure being set in the vehicle speed restriction.

FIG. 16 is a view illustrating a relation between the engine revolution speed, the fluid temperature, and the set pressures of the relief valve 378 (the travel-restricting pressure, the temperature-restricting pressure).

The control device 390 stores a second control information (a second control map) showing a relation between the engine revolution speed and the temperature-restricting pressure in the vehicle speed restriction, for example. That is, the control device 390 has a fifth control line L50. The fifth control line L50 is used in the vehicle speed restriction.

The fifth control line L50 sets an upper limitation of the set pressure of the relief valve 378 in each of the first control line L10, the second control line L20, the third control line L30, and the fourth control line L40. The fifth control line L50 is a control line that lowers the travel-restricting pressure than the temperature-restricting pressure set by the first pressure-setting circuit 390A.

Figure 17:
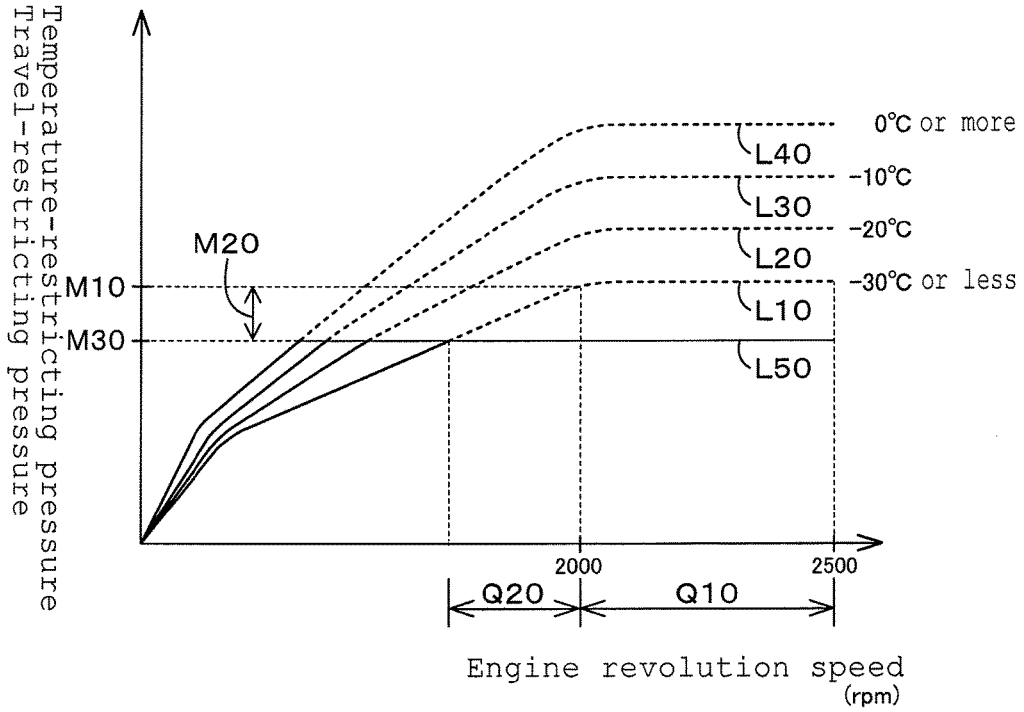
FIG. 17 is a view a view illustrating a relation between the engine revolution speed, the oil temperature, and a set pressure of the relief valve (a travel-restricting pressure, the temperature-restricting pressure) according to the sixth embodiment.

In a case where the vehicle speed restriction is not performed, the first pressure-setting circuit 390A sets the temperature-restricting pressure on the basis of the plurality of control lines (the first control line L10, the second control line L20, the third control line L30, and the fourth control line L40). For example, in a case where the engine revolution speed is in a range Q10 on the control line L10 as shown in FIG. 17, the temperature-restricting pressure is set to a range M10.

In addition, in a case where the engine revolution speed is in a range Q20 on the control line L10, the temperature-restricting pressure is set to a range M20. In a case where the vehicle speed restriction is performed under that condition, the second pressure-setting circuit 390B sets an upper limitation of the set pressure (the speed-restricting pressure) of the relief valve 378 to a range M30 in accordance with the fifth control line L50.

That is, in a case where the vehicle speed restriction is performed, the set pressure (the speed-restricting pressure) of the relief valve 378 is fixed to the range M30 even when the engine revolution speed is in the range Q10.

That is, in the case where the vehicle speed restriction is performed, the second pressure-setting circuit 390B lowers the set pressure (the travel-restricting pressure) of the relief valve 378 than the temperature-restricting pressure M10 and the range M20, the temperature-restricting pressure M10 and the range M20 being set the first pressure-setting circuit 390A.

In particular, the second pressure-setting circuit 390B lowers the set pressure of the relief valve 378 than the temperature-restricting pressure regardless of the fluid temperature at any fluid temperature, 0° C. or more, −10° C., −20° C., −30° C. or less.

As described above, the second pressure-setting circuit 390B lowers the set pressure (the travel-restricting pressure) M30 of the relief valve 378 than the range M20 and the temperature-restricting pressure M10 set by the first pressure-setting circuit 390A. In this manner, the operation fluid can be supplied from the relief valve 378 to the operation fluid tank 22 and the like even in the vehicle speed restriction, and thereby the operation fluid is warmed up.

Figure 18:
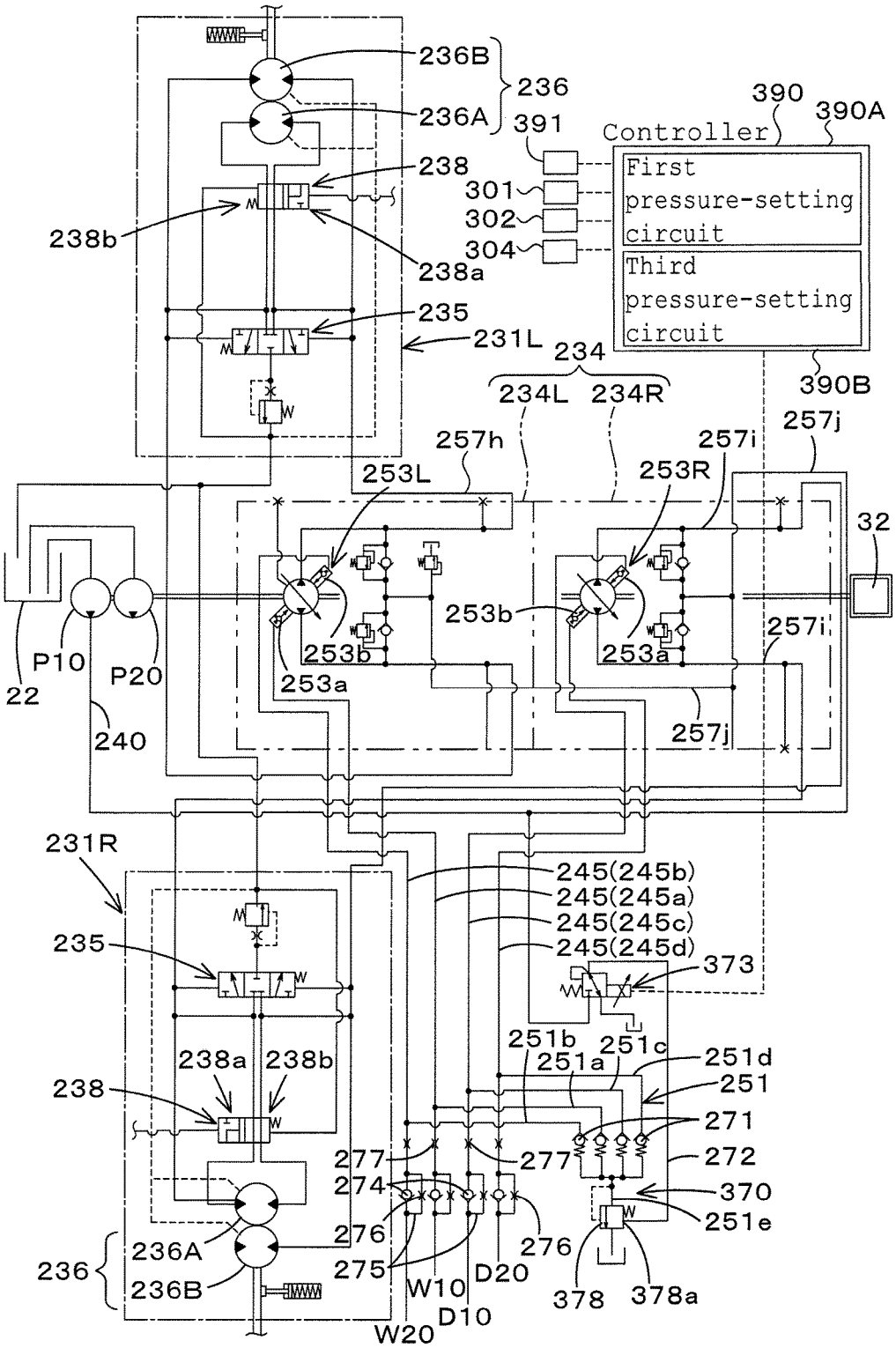
FIG. 18 is a schematic view illustrating a second modified example of the hydraulic system for travel according to the sixth embodiment.

Meanwhile, the work machine 1 may restrict the engine revolution speed. FIG. 18 is a view illustrating a hydraulic system (a hydraulic circuit) capable of restricting the engine revolution speed. That is, FIG. 18 is a view illustrating a second modified example of the hydraulic system described above.

An accelerator 304 is connected to the control device 390. The accelerator 304 is configured to set the engine revolution speed. When the accelerator 304 is operated, an operation amount (an operation extent) of the accelerator 304 is inputted to the control device 390. Then, the control device 390 controls the engine revolution speed in accordance with the operation amount of the accelerator 304.

In a case where the engine revolution speed is restricted, an upper limit of the engine revolution speed is set so as not to exceed a restriction value Q40. The restriction value Q40 is a value lower than the maximum value of the revolution speed of the engine.

That is, in a case where the engine revolution speed is not restricted, the engine revolution speed can be set to the restriction value Q40 or more by the operation of the accelerator. However, in a case where the engine revolution speed is restricted, the control device 390 fixes the upper limit of the engine revolution speed to the restriction value Q40 regardless of the operation of the accelerator 304.

The accelerator 304 is not described in the embodiment described above. However, the work machine 1 is provided with the accelerator 304 obviously.

The engine revolution speed is restricted by the control device 390. The engine revolution speed is restricted when the fluid temperature detected by the temperature detection device 302 is lowered by a predetermined temperature or more, for example.

For convenience of the explanation, the pressure in the travel fluid tube 245 will be referred to as "a revolution speed restricting pressure (a rev.-restricting pressure)" below, the pressure being set under the restriction of the engine revolution speed. In addition, the restriction of the engine revolution speed will be referred to as "a revolution speed restriction" below.

As shown in FIG. 18, the control device 390 includes a third pressure-setting circuit (a third pressure-setting portion) 390C. The third pressure-setting circuit 390C is constituted of a computer program stored in the control device 390, an electric circuit, an electronic circuit, or the like, which are stored in the control device 390. The third pressure-setting circuit 390C sets the set pressure of the relief valve 378 in the revolution speed restriction.

Figure 19:
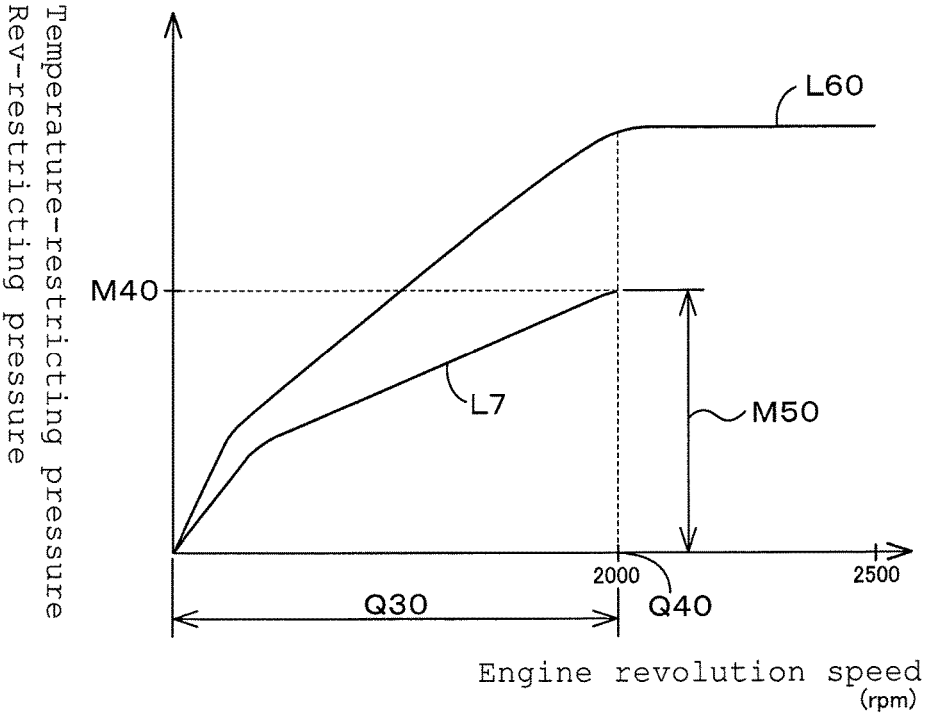
FIG. 19 is a view illustrating a relation between the engine revolution speed, the oil temperature, and a set pressure of the relief valve (a revolution-restricting pressure, the temperature-restricting pressure) according to the sixth embodiment.

FIG. 19 is a view illustrating a relation between the engine revolution speed, the fluid, the set pressures (the temperature-restricting pressure, the rev.-restricting pressure) of the relief valve 378.

As shown in FIG. 19, the control device 390 stores a sixth control line L60 and a seventh control line L70. The sixth control line L60 is used in a case where the fluid temperature is a normal temperature or more (for example, −10° C. or more). The seventh control line L70 is used in a case where the fluid temperature is out of the normal temperature (for example, less than −10° C.).

The sixth control line L60 is used in a case where the fluid temperature is the normal temperature when the revolution speed restriction is not performed. The seventh control line L70 is used in a case where the fluid temperature is out of the normal temperature when the revolution speed restriction is performed.

The upper limit of the engine revolution speed shown in the seventh control line L70 is identical to the restriction value Q40 employed in the revolution speed restriction. Additionally, under the restriction value Q40, that is, in the range Q3 where the revolution speed restriction is not performed. the rev.-restricting pressure set on the seventh control line L70 is lower than the temperature-restricting pressure set on the sixth control line L60.

In a case where the revolution speed restriction is not performed, the first pressure-setting circuit 390A sets the temperature-restricting pressure on the basis of the sixth control line L60. On the other hand, in a case where the fluid temperature is out of the normal temperature and less than −10° C., the third pressure-setting circuit 390C sets the rev.-restricting pressure on the basis of the seventh control line L70.

For example, the control device 390 fixes the operation amount of the accelerator 304 to the restriction value Q40 even when the operation amount of the accelerator 304 is set to the engine revolution speed exceeding the restriction value Q40. On the other hand, the third pressure-setting circuit 390C fixes the rev.-restricting pressure to the rev.-restricting pressure M40 on the basis of the restriction value Q40 and the seventh control line L70.

In addition, when the operation amount of the accelerator 304 is set to be less than the restriction value Q40, the third pressure-setting circuit 390C sets the rev.-restricting pressure to a range M50 in accordance with the engine revolution speed.

That is, in the revolution speed restriction, the third pressure-setting circuit 390C lowers the rev.-restricting pressure than the temperature-restricting pressure set by the first pressure-setting circuit 390A within the range Q30 where the revolution speed restriction is not performed.

As described above, the output powers of the variable displacement pumps (the first hydraulic pump P100, the second hydraulic pump P20) is suppressed under the revolution speed restriction. Under than condition, the operation fluid is supplied from the relief valve 378 to the operation fluid tank 22 and the like, and thereby the operation fluid is warmed up.

The hydraulic system according to the embodiment easily changes the displacement of the variable displacement pump connected to the hydraulic circuit for travel.

Seventh Embodiment

Figure 20:
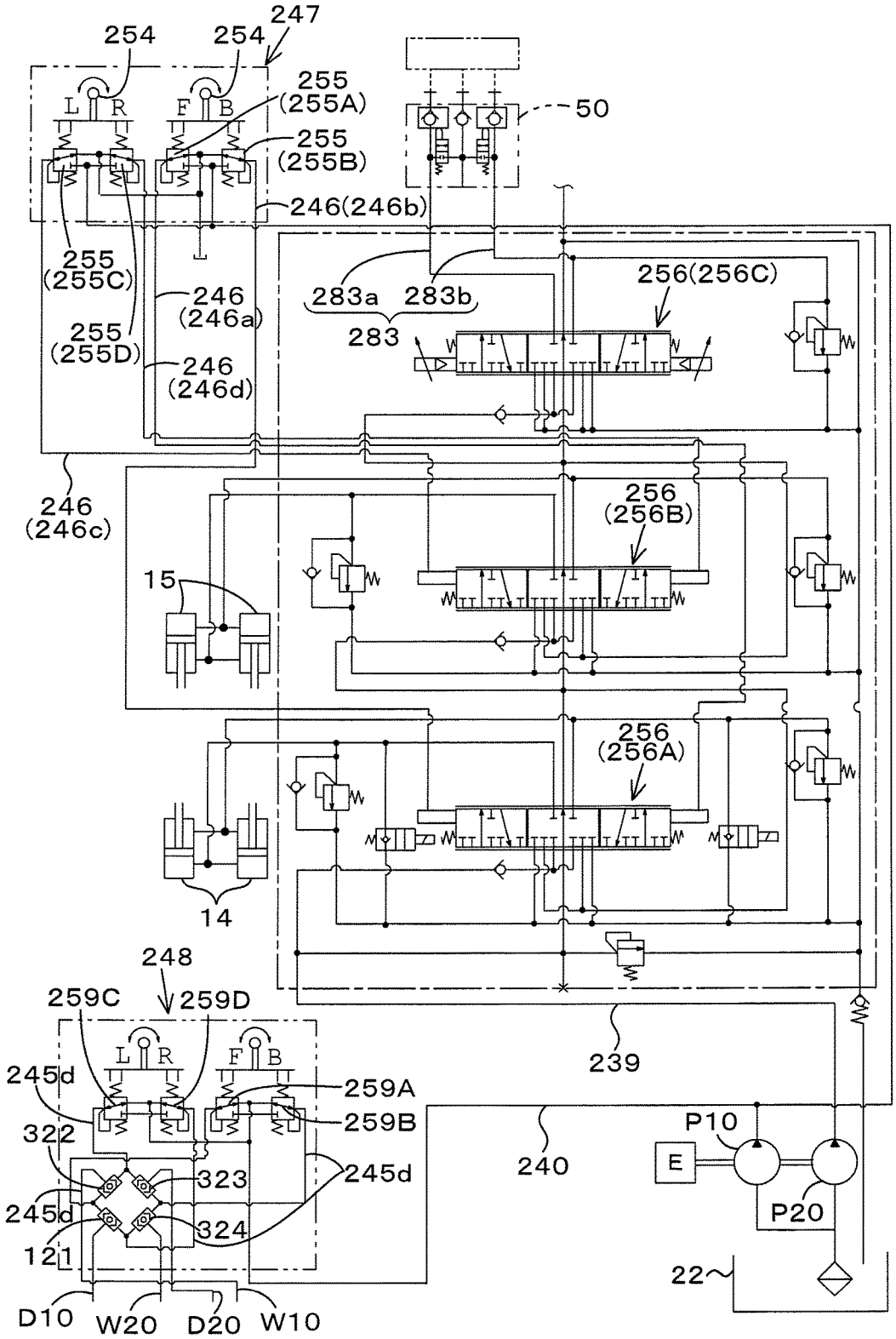
FIG. 20 is a schematic view illustrating a hydraulic system for work according to a seventh embodiment of the present invention.

FIG. 20 is a view illustrating the hydraulic system according to a seventh embodiment of the present invention. Explanations of the configurations similar to the configurations of the embodiments described above will be omitted. The seventh embodiment is different from the sixth embodiment in that the first operation device 247 provides a working operation and the second operation device 248 provides a traveling operation.

The first operation device 247 is provided with an operation valve 255A, an operation valve 255B, an operation valve 255C, and an operation valve 255D, which are working-operation valves.

A first working fluid tube (a first working fluid path) 246*a* connects the operation valve 255A to the pressure-receiving portion of the first control valve 256A. A second working fluid tube (a second working fluid path) 246*b* connects the operation valve 255B to the pressure-receiving portion of the first control valve 256A.

A third working fluid tube (a third working fluid path) 246*c* connects the operation valve 255C to the pressure-receiving portion of the second control valve 256B. A fourth working fluid tube (a fourth working fluid path) 246*d* connects the operation valve 255D to the pressure-receiving portion of the second control valve 256B.

The operation valve 255A, the operation valve 255B, the operation valve 255C, and the operation valve 255D are the working operation valves.

The second operation device 248 is provided with an operation valve 259A, an operation valve 259B, an operation valve 259C, and an operation valve 259D, which are traveling-operation valves. The operation valve 259A, the operation valve 259B, the operation valve 259C, and the operation valve 259D are connected to a plurality of high-pressure select valves (shuttle valves) 321, 322, 323, and 324 by a fifth travel fluid tube 245*d*.

A first travel fluid tube 245*a* connects the shuttle valve 322 to the forward-movement pressure-receiving portion 253*a* of the travel pump 253L. A second travel fluid tube 245*b* connects the shuttle valve 324 to the backward-movement pressure-receiving portion 253*b* of the travel pump 253L.

A third travel fluid tube 245*c* connects the shuttle valve 321 to the forward-movement pressure-receiving portion 253*a* of the travel pump 253R. A fourth travel fluid tube 245*d* connects the shuttle valve 323 to the backward-movement pressure-receiving portion 253*b* of the travel pump 253R. The other configurations are similar to the configurations of the sixth embodiment.

As described above, even in the hydraulic circuit that has the first operation device 247 for the working operation and the second operation device 248 for the traveling operation, the hydraulic circuit is capable of changing the displacement of the first variable discharge pump 253L and the displacement of the second variable discharge pump 253R by discharging the operation fluid included in the travel fluid tube 245 through the discharge fluid tube 251 and the operation valve 370 on the basis of the engine revolution speed and the fluid temperature.

A hydraulic system for a work machine includes a prime mover, a variable displacement pump to be driven by a power of the prime mover, the variable displacement pump being configured to change a displacement of the variable displacement pump, an operation device having an operation member and an operation valve configured to change a pressure of the operation fluid in accordance with an operation of the operation member, the operation device being configured to change the displacement of the variable displacement pump with use of the pressure of the operation fluid changed by the operation valve, a travel fluid tube connecting the operation valve to the variable displacement pump, a discharge fluid tube connected to the travel fluid tube, the discharge fluid tube being configured to discharge (drain) the operation fluid included in the travel fluid tube, an operation valve disposed on the discharge fluid tube, the operation valve being configured to reduce the pressure of the operation fluid in the travel fluid tube, and a control device (a controller) configured to control the operation valve on the basis of a revolution speed of the prime mover and a temperature of the operation fluid.

A hydraulic system for a work machine includes a prime mover, a first variable displacement pump to be driven by a power of the prime mover, the first variable displacement pump being configured to change a displacement of the first variable displacement pump, a second variable displacement pump to be driven by a power of the prime mover, the second variable displacement pump being configured to change a displacement of the second variable displacement pump, a first operation device having a first operation member and a first operation valve configured to change a pressure of the operation fluid in accordance with an operation of the first operation member, the first operation device being configured to change the displacement of the variable displacement pump with use of the pressure of the operation fluid changed by the first operation valve, a second operation device having a second operation member and a second operation valve configured to change a pressure of the operation fluid in accordance with an operation of the second operation member, the second operation device being configured to change the displacement of the variable displacement pump with use of the pressure of the operation fluid changed by the second operation valve, a travel fluid tube connecting the first operation valve and the second operation valve to the first variable displacement pump and the second variable displacement pump, a discharge fluid tube connected to the travel fluid tube, the discharge fluid tube being configured to discharge (drain) the operation fluid included in the travel fluid tube, an operation valve disposed on the discharge fluid tube, the operation valve being configured to reduce the pressure of the operation fluid in the travel fluid tube, and a control device (a controller) configured to control the operation valve on the basis of a revolution speed of the prime mover and a temperature of the operation fluid.

The control device includes a first pressure-setting circuit configured to set a temperature-restricting pressure that is a pressure in the travel fluid tube on the basis of a temperature of the operation fluid and a revolution speed of the prime mover, wherein the operation valve is controlled on the basis of the temperature-restricting pressure.

The control device includes a first pressure-setting circuit configured to set a temperature-restricting pressure that is a pressure in the travel fluid tube on the basis of a plurality of threshold values related to the operation fluid and revolution speeds of the prime mover set in accordance with the plurality of threshold values, wherein the operation valve is controlled on the basis of the temperature-restricting pressure.

The control device includes a second pressure-setting circuit configured to set a travel-restricting pressure in restricting a traveling speed of the work machine, the travel-restricting pressure being a pressure in the travel fluid tube, wherein the second pressure-setting circuit lowers the travel-restricting pressure than the temperature-restricting pressure set by the first pressure-setting circuit in restricting the traveling speed.

The control device includes a third pressure-setting circuit configured to set a revolution-restricting pressure in restricting the revolution speed of the prime mover, the revolution-restricting pressure being a pressure in the travel fluid tube, wherein the operation valve is controlled on the basis of the revolution-restricting pressure.

The third pressure-setting circuit lowers the revolution-restricting pressure than the temperature-restricting pressure in restricting the revolution speed of the prime mover, the temperature-restricting pressure being set by the first pressure-setting circuit in a range of revolution speed where the revolution speed of the prime mover is not restricted.

The hydraulic system according to the embodiment easily changes the displacement of the variable displacement pump connected to the hydraulic circuit for travel.

In the above description, the embodiment of the present invention has been explained. However, all the features of the embodiments disclosed in this application should be considered just as examples, and the embodiments do not restrict the present invention accordingly. A scope of the present invention is shown not in the above-described embodiments but in claims, and is intended to include all modifications within and equivalent to a scope of the claims.

What is claimed is:

1. A hydraulic system for a work machine comprising:

an operation member;

a prime mover;

a hydraulic pump to be driven by the prime mover, the hydraulic pump being configured to output an operation fluid;

a first temperature sensor to measure a temperature of the operation fluid;

a first fluid tube connected to the hydraulic pump;

an operation valve connected to the first fluid tube, the operation valve being configured to control, in accordance with an operation extent of the operation member, a pressure of the operation fluid to be outputted;

a hydraulic apparatus to be driven by the operation fluid outputted from the operation valve;

a second hydraulic tube connecting the operation valve to the hydraulic apparatus;

a discharge fluid tube to discharge the operation fluid included in the second fluid tube; and an actuation valve disposed on the discharge fluid tube, the actuation valve being configured to control an aperture of the actuation valve based on the temperature.

2. The hydraulic system according to claim 1, comprising a throttle disposed between the operation valve and a connecting portion connecting the second fluid tube and the discharge fluid tube to each other.

3. The hydraulic system according to claim 1, wherein the actuation valve is opened when the temperature measured by the first temperature sensor is equal to a predetermined temperature or less.

4. The hydraulic system according to claim 1, comprising a second temperature sensor to measure a temperature of an outside air, wherein the actuation valve is opened when the temperature of the operation fluid is equal to a predetermined temperature or less and the temperature measured by the second temperature sensor is equal to a predetermined temperature or less.

* * * * *